US006382995B1

(12) United States Patent
Bricaud et al.

(10) Patent No.: US 6,382,995 B1
(45) Date of Patent: May 7, 2002

(54) SMART CARD CONNECTOR WITH RETAIN AND EJECT MEANS

(75) Inventors: Hervé Guy Bricaud; Fabrice Valcher, both of Dole (FR)

(73) Assignee: ITT Manufacturing Enterprises, INC, Wilmington, DE (US)

( * ) Notice: Subject to any disclaimer, the term of this patent is extended or adjusted under 35 U.S.C. 154(b) by 0 days.

(21) Appl. No.: 09/693,322

(22) Filed: Oct. 20, 2000

Related U.S. Application Data

(63) Continuation-in-part of application No. PCT/EP99/03450, filed on May 20, 1999, now abandoned.

(51) Int. Cl.[7] ..... H01R 13/62
(52) U.S. Cl. ..... 439/159; 439/328; 439/923
(58) Field of Search ..... 439/159, 155, 439/328, 923, 630

(56) References Cited

U.S. PATENT DOCUMENTS

| | | | | | |
|---|---|---|---|---|---|
| 4,931,622 | A | * | 6/1990 | Ohtsuki et al. | 235/487 |
| 5,151,847 | A | * | 9/1992 | Rautenberg | 361/395 |
| 5,202,551 | A | * | 4/1993 | Parrer et al. | 235/486 |
| 5,473,505 | A | * | 12/1995 | Kessoku et al. | 439/159 |
| 5,655,917 | A | * | 8/1997 | Kaneshige et al. | 439/155 |
| 6,095,868 | A | * | 3/1998 | Hyland et al. | 439/630 |

FOREIGN PATENT DOCUMENTS

| | | |
|---|---|---|
| EP | 0459584 A1 | 5/1991 |
| EP | 0720259 A2 | 7/1996 |
| FR | 2742561 A1 | 6/1997 |

* cited by examiner

*Primary Examiner*—Khiem Nguyen
*Assistant Examiner*—Javaid Nasri
(74) *Attorney, Agent, or Firm*—Roger C. Turner

(57) ABSTRACT

A smart card connector of simple design and small size is provided, which retains a fully inserted smart card until a person deflects a tab (172) that releases the smart card, with the connector including a spring (130A) which then partially ejects the smart card so it can be grasped and removed. The apparatus includes a housing (302A) with a dielectric plastic plate-shaped support (72A) that holds contacts (94) with pad-engaging ends (92) projecting above an upwardly-facing face (106) of the plate to engage contact pads of the smart card. The housing forms a forwardly-opening cavity (88) for receiving the smart card when it is rearwardly inserted therein, the housing having a stop (109) that limits rearward movement of the card to a fully inserted position. A card retainer (304A) has a largely rearwardly-facing shoulder (166A) at the front of the cavity to resist withdrawal of the card until the tab is manually deflected. The spring has a spring end (138) lying at the rear of the cavity and biased toward a position forward of the stop, to directly engage the card rear edge to urge the card forwardly out of the cavity. Thus, manual deflection of the tab allows the spring to automatically push the card partially out of the cavity.

20 Claims, 59 Drawing Sheets

70B
74
C
140
120
91
72B 137
139
134
138
130B
132

74B
70B
120
139
D13
106
101
109
130B
102
C 72B
109
134
100
101
142
103
139
130B
138
140
106
136

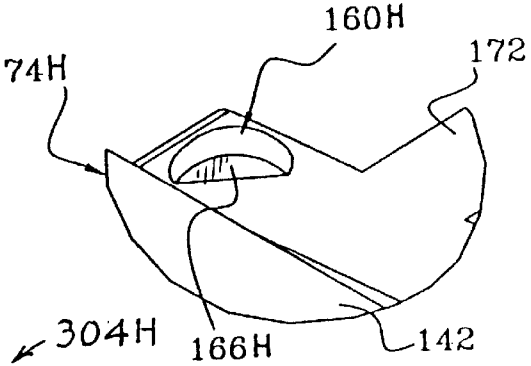
FIG.44
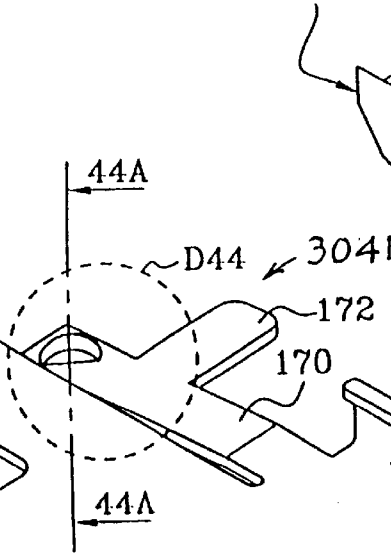
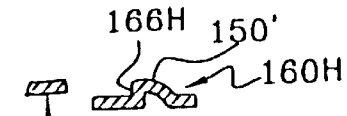
FIG.44A
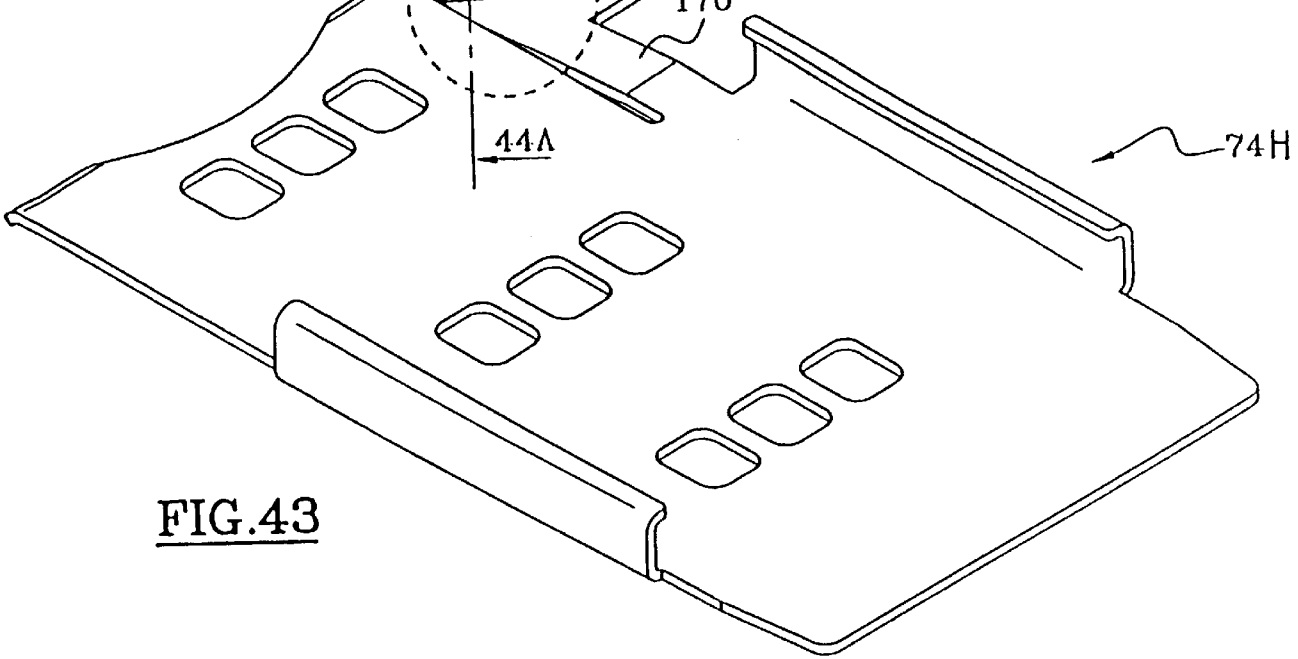
FIG.43

74J
146
142
158
206
162
172
160J
D47
152
150

74J
157
158
146
148
162
172
206
160
166J
142
156
154
150
144
162
172
166J
160
304J
142
150'
150

70N
78
88N
91
C
120
228
226
74N
72N
172
304N
310
130N
142N
88

SMART CARD CONNECTOR WITH RETAIN AND EJECT MEANS

CROSS REFERENCE

This is a continuation-in-part of PCT application PCT/EP99/03450 filed May 20, 1999, abandoned which claims priority from French patent application No. 98 06852 filed May 29, 1998.

BACKGROUND OF THE INVENTION

Smart cards are usually formed by a plate of plastic of perhaps 0.8 mm thickness, with an integrated circuit imbedded in the plastic and with contact pads on a bottom face of the card. Connections between a computer, vending machine, or other electronic device and the pads of the smart card are usually made by inserting the smart card into a card-receiving cavity of a connector. The connector is usually mounted on a circuit board, with contacts having tails soldered to traces on the circuit board and having pad-engaging ends positioned to engage the pads on the fully inserted card. A means is required to keep the card in the cavity after it has been fully inserted, and to later aid in retracting the card. A card connector of relatively simple and compact design, which included means for retaining and partially ejecting the card, where the means were of simple and compact design and easily operable, would be of value.

SUMMARY OF THE INVENTION

In accordance with one embodiment of the present invention, an apparatus for connecting to a smart card is provided, which is of simple and compact design, and which is constructed with simple mechanisms for retaining a fully inserted card, for easily releasing the card, and for partially ejecting the card when it is released to facilitate pullout of the card. The apparatus includes a housing forming a card-receiving cavity and a plate-shaped part of dielectric plastic material that holds contacts with pad-engaging ends that engage the pads on a card lying in the cavity. A card retainer is provided that has a largely rearwardly-facing shoulder at the front of the cavity to resist withdrawal of the card after it has been fully inserted into the cavity. A spring end lies at the rear of the cavity and is positioned to directly engage the card rear edge to urge the card forwardly out of the cavity. When the retainer shoulder is deflected, the spring automatically pushes out the card.

The card retainer is preferably formed by a sheet metal arm having a fixed end that is part of the housing, and a free outer end that is bent to form the shoulder and that can be deflected to remove the card from the cavity. The arm outer end has a tab that is positioned to be manually deflected, to move the shoulder out of the way of a card being moved forwardly out of the cavity. Upon such manual deflection of the tab on the arm, the spring partially ejects the card.

The spring can be formed by a bent wire with one end fixed against deflection and the opposite end lying in the rear of the cavity to be rearwardly deflected by a card during insertion and to thereafter push the card forwardly. The spring can be a coil spring with a front end of the coil spring pressing directly against the rear edge of the card. The spring can be formed by a part of a metal cover of the housing that is of spring temper and that forms a resilient leaf.

The arm of the card retainer can be formed integrally with a metal or plastic part of the card housing, and the arm can extend forwardly or laterally from its fixed end to its free end.

The novel features of the invention are set forth with particularity in the appended claims. The invention will be best understood from the following description when read in conjunction with the accompanying drawings.

BRIEF DESCRIPTION OF THE DRAWINGS

FIGS. 43–44 illustrate another embodiment of the invention with a differently formed stop lip, with FIGS. 43–44 being otherwise similar to FIGS. 41–42, and with FIG. 44 being an enlarged view of detail D44 of FIG. 43.

FIG. 44A is a detailed sectional view taken on line 44A—44A of FIG. 43.

FIGS. 84 and 85 are front and top isometric views of a fifteenth embodiment of the invention, in which the cover is designed for fastening directly to the circuit board, with an ultra thin insulating support on the circuit board to provide an ultra thin connector, with a retractable means for retaining the card and an elastic means for ejecting the card being of the type shown in the embodiment of FIGS. 45–52 where the carrier arm that holds the retainer lip lies under the card.

DESCRIPTION OF THE PREFERRED EMBODIMENTS

I. Limited Description of the Invention

Figure 1:
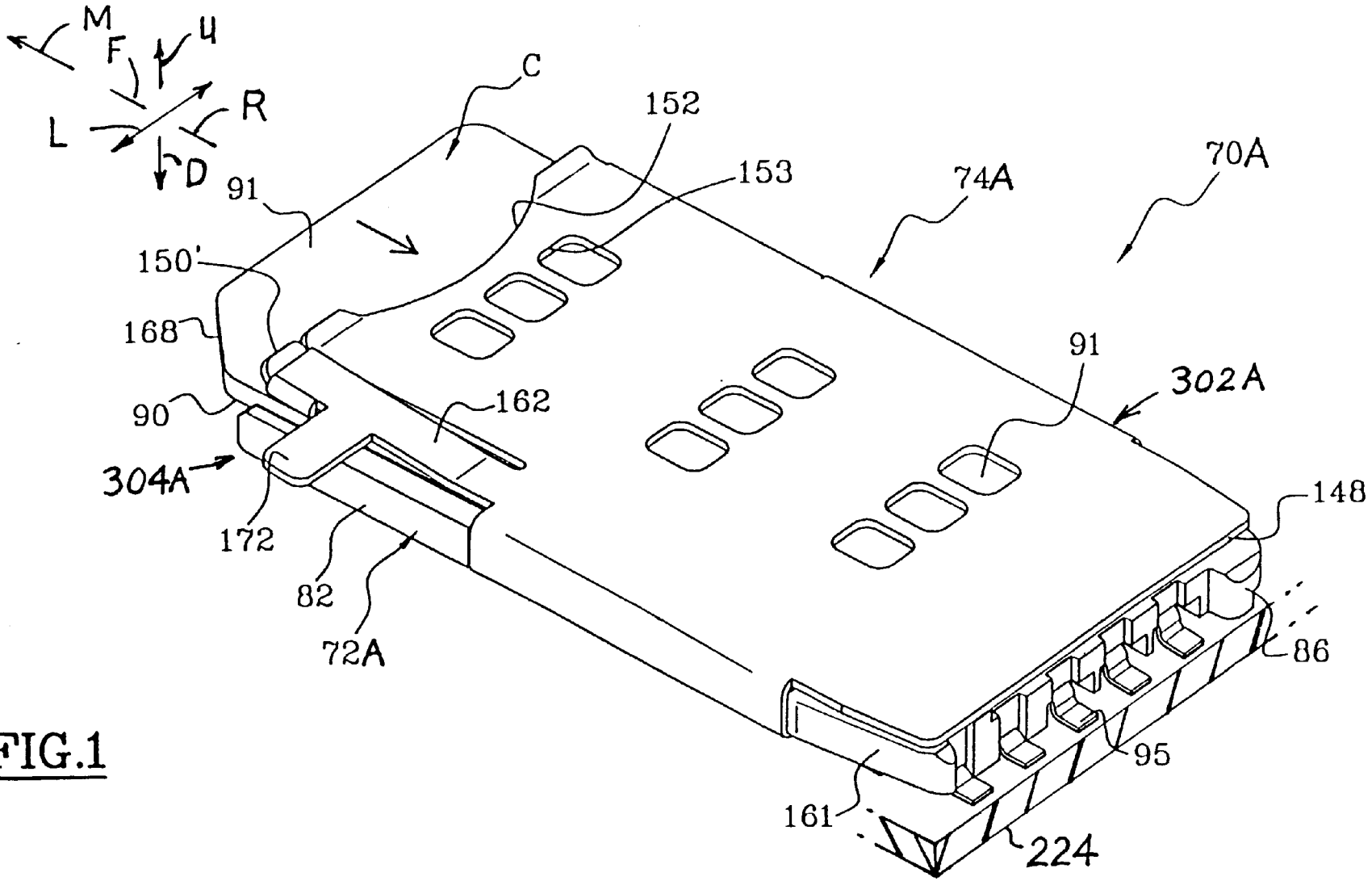
FIG. 1 is an isometric top and rear view of a card connector of a first embodiment of the invention, with a card shown partially inserted into the connector.
Figure 8:
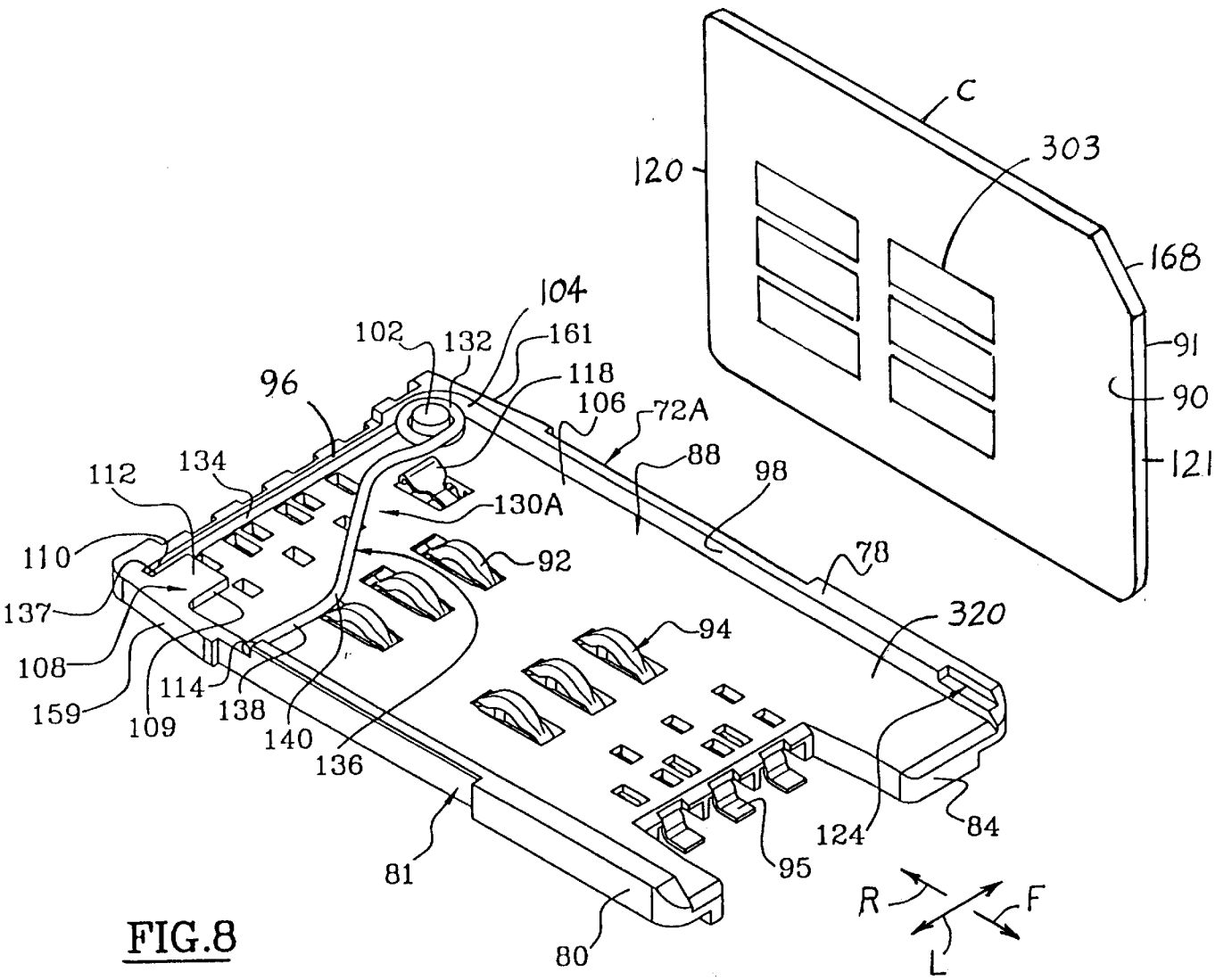
FIG. 8 is a front and top view of the support and spring of the connector of FIG. 1, and also showing the smart card separated from the support.

FIG. 1 illustrates an apparatus for connecting to a smart card C of the MICROSIM type, which has a thickness of 0.8 mm, a width in lateral directions L of about 2 cm, and a length in forward F and rearward R longitudinal directions M of about 3 cm. The apparatus includes an electrical connector 70A which is mounted on a circuit board 224. The connector includes a housing 302A with a dielectric plastic molded support 72A and a sheet metal cover 74A mounted on the support. As shown in FIG. 8, the smart card C has lower and upper faces 90, 91, and has a plurality of contact pads 303 on its lower face. Each of the contact pads are connected to an integrated circuit (not shown) that is embedded in the smart card. The smart card has rear and front edges 120, 121, with the front edge having a polarizing corner 168 in the form of a diagonal or inclined corner edge which is inclined 45° from the front edge 121.

The connector forms a cavity 88 which is filled with the smart card when the smart card is fully installed. The support 72A has a plate-shaped part 320 with an upper face 106. Two rows of contacts 94 are mounted on the support. Each contact has a pad-engaging end 92 that projects above the upper face 106 and a tail 95 that is soldered to a trace on the circuit board. When the card is inserted rearwardly R into the cavity, it moves toward a spring 130A and encounters a free end part 138 of a front leg 136 of the spring. Further rearward movement of the card causes rearward deflection of the spring front leg, until the rear edge of the card abuts a stop 109.

Figures 11, 12, 13, 14:
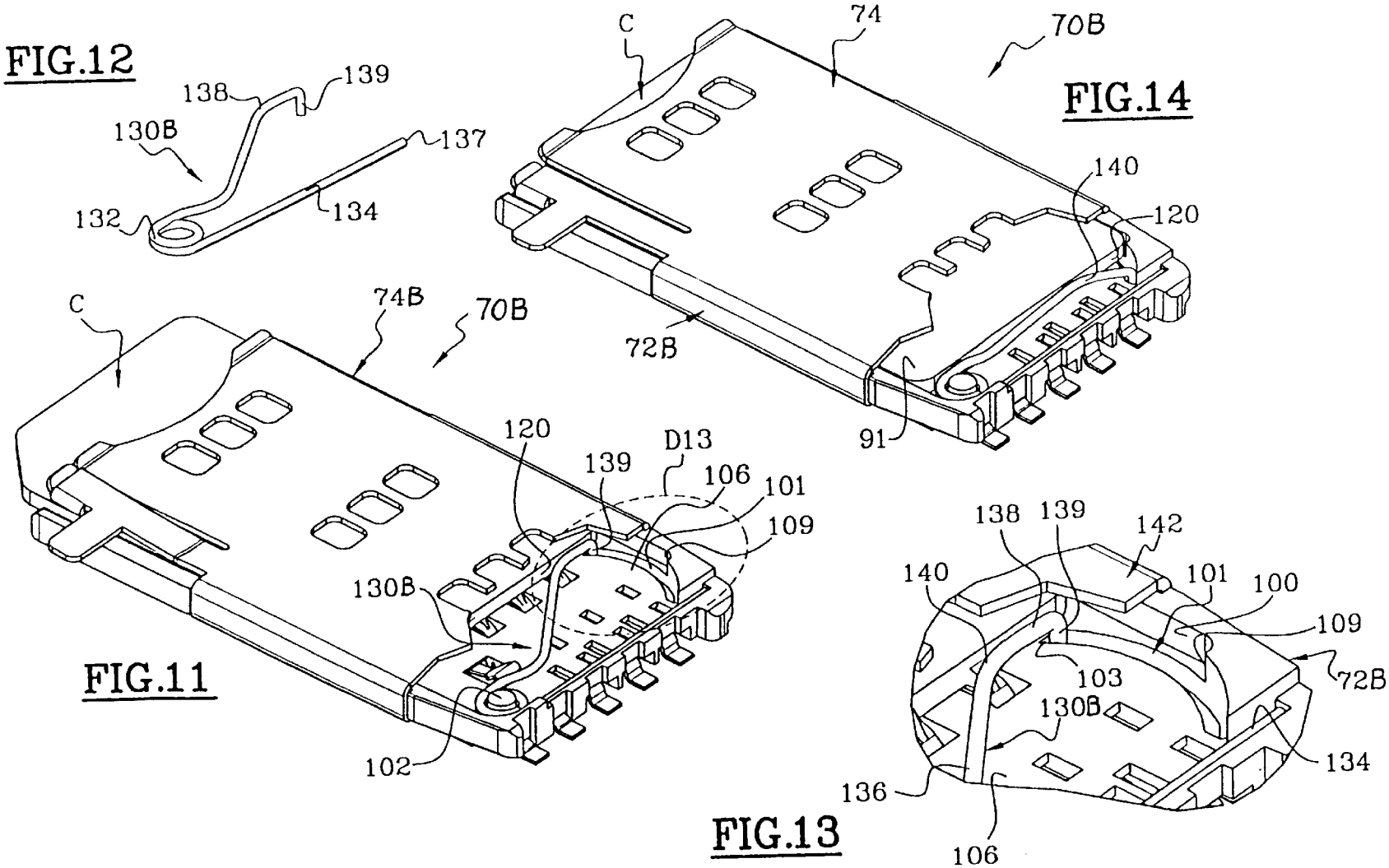
FIG. 11 is a rear and top isometric view of a connector of a second embodiment of the invention, with the view being similar to that of FIG. 9 but with the ejection spring and support being modified.
FIG. 12 is an isometric view of the spring of FIG. 11.
FIG. 13 is an enlarged view of area D13 of FIG. 11.
FIG. 14 is a view similar to that of FIG. 11, but with the card fully inserted.
Figures 15, 16:
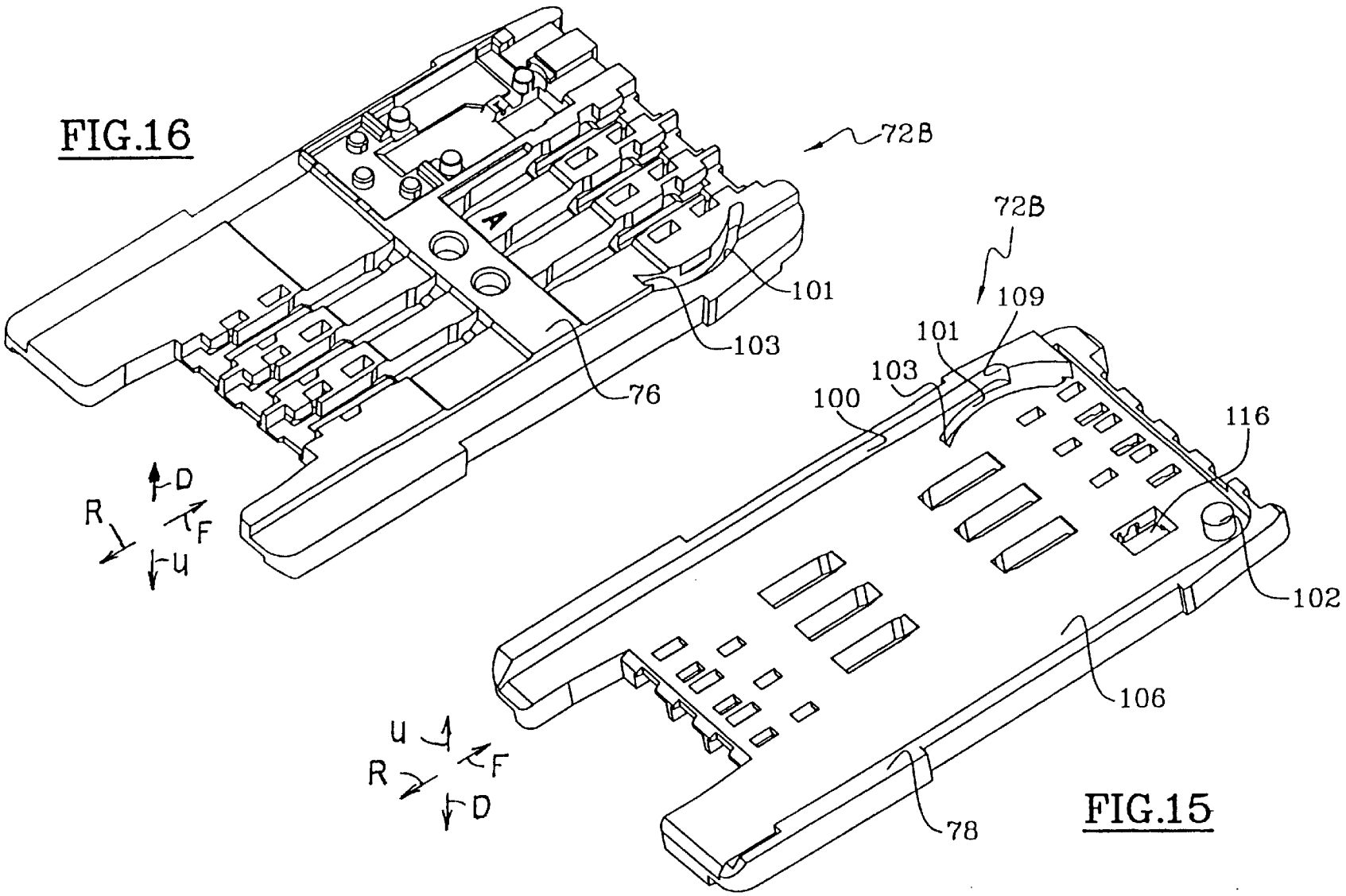
FIG. 15 is a top and rear isometric view of the support of the connector of FIG. 11.
FIG. 16 is an upside-down view of the support of FIG. 15.
Figure 17:
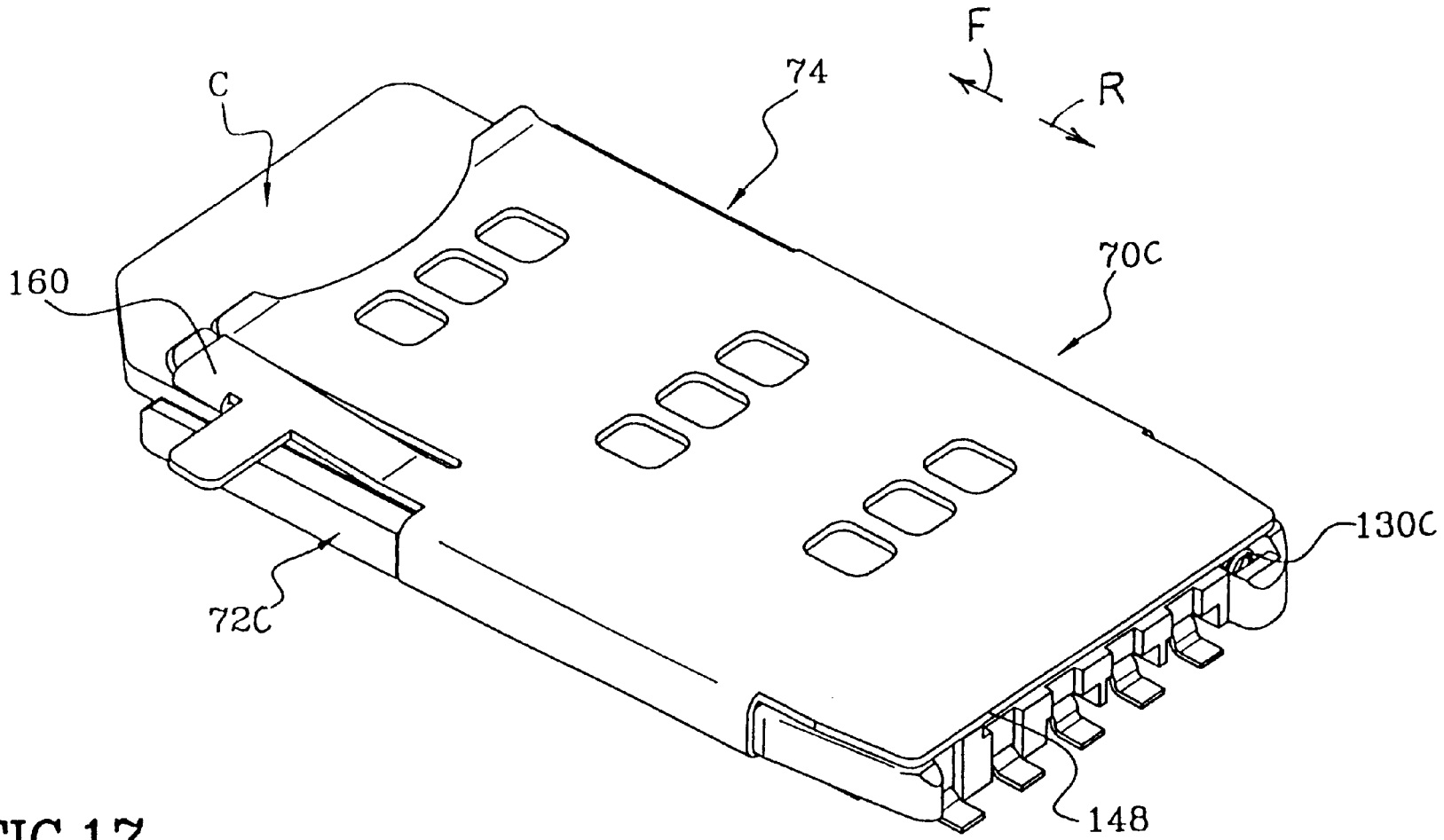
FIG. 17 is a top and rear isometric view of a third embodiment of the invention, which has a different ejection spring.
Figure 19:
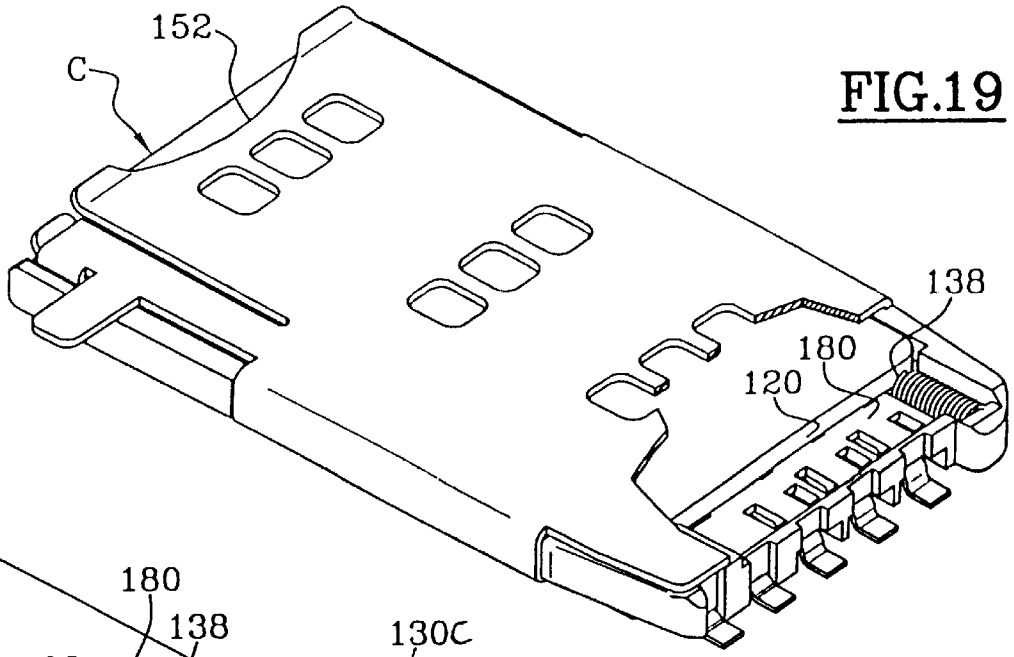
FIG. 19 is a view similar to FIG. 18, but with a card fully inserted.
Figure 18:
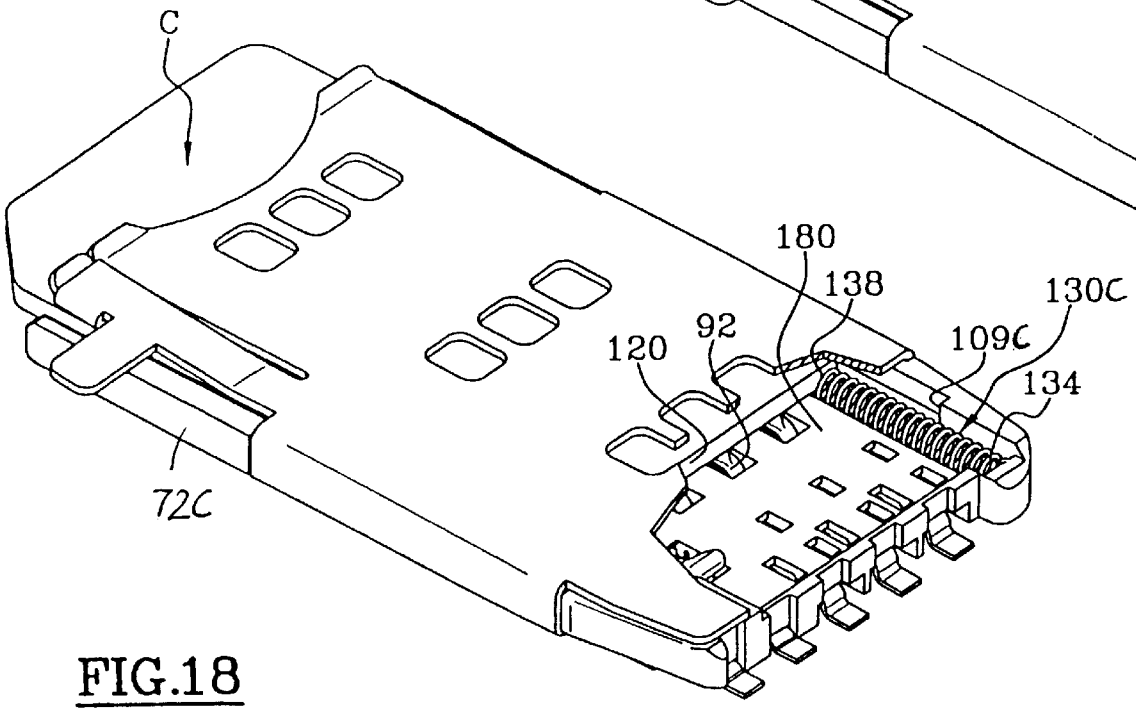
FIG. 18 is a top and rear isometric view of the connector of FIG. 17, with a rear portion of the cover being cut away, and showing the ejector spring at the beginning of its compression by a partially inserted card.
Figures 20, 21:
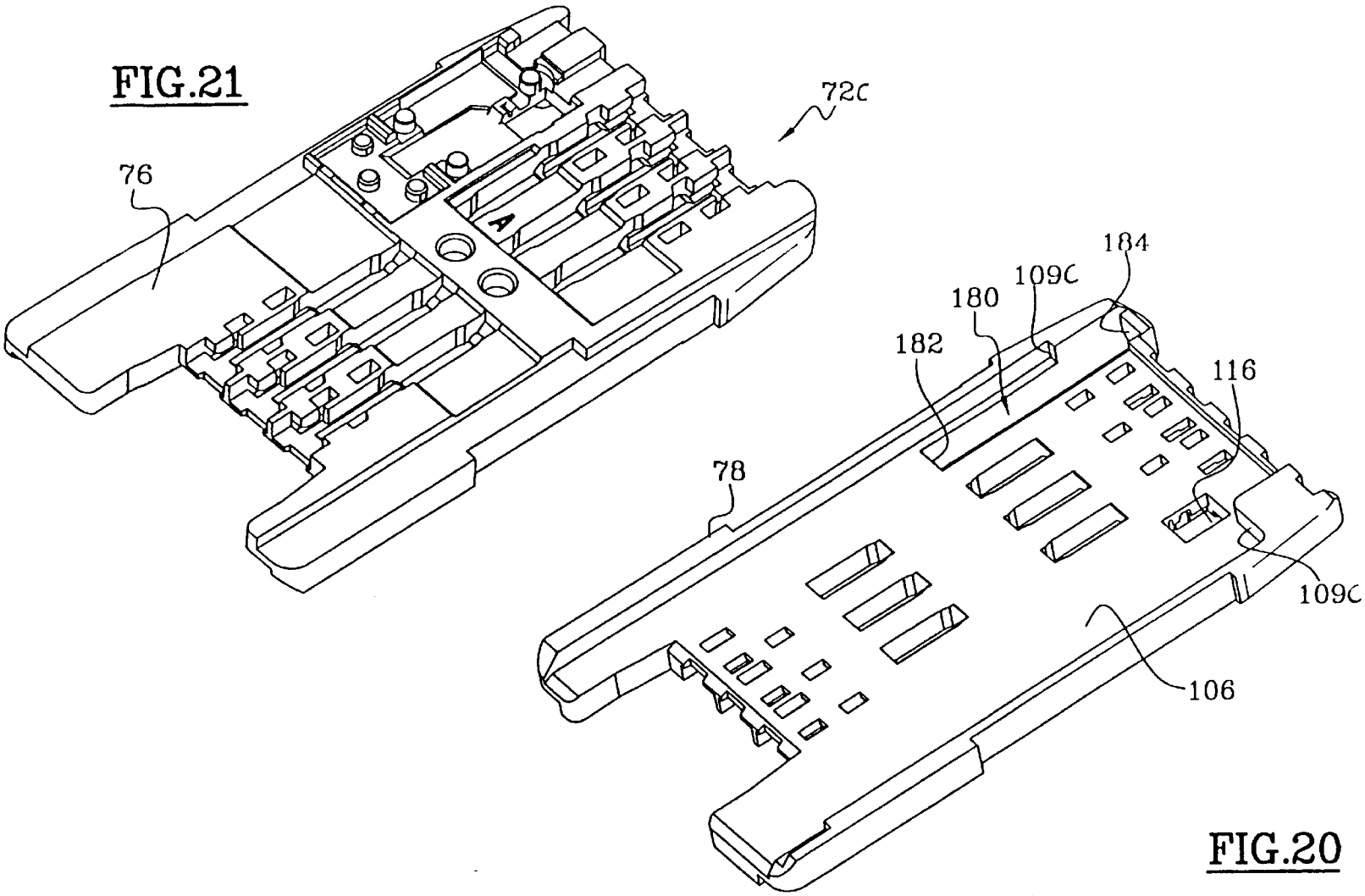
FIG. 20 is a top and front isometric view of the support of the connector of FIG. 17.
FIG. 21 is an upside-down rear and front isometric view of the support of FIG. 20.
Figure 22:
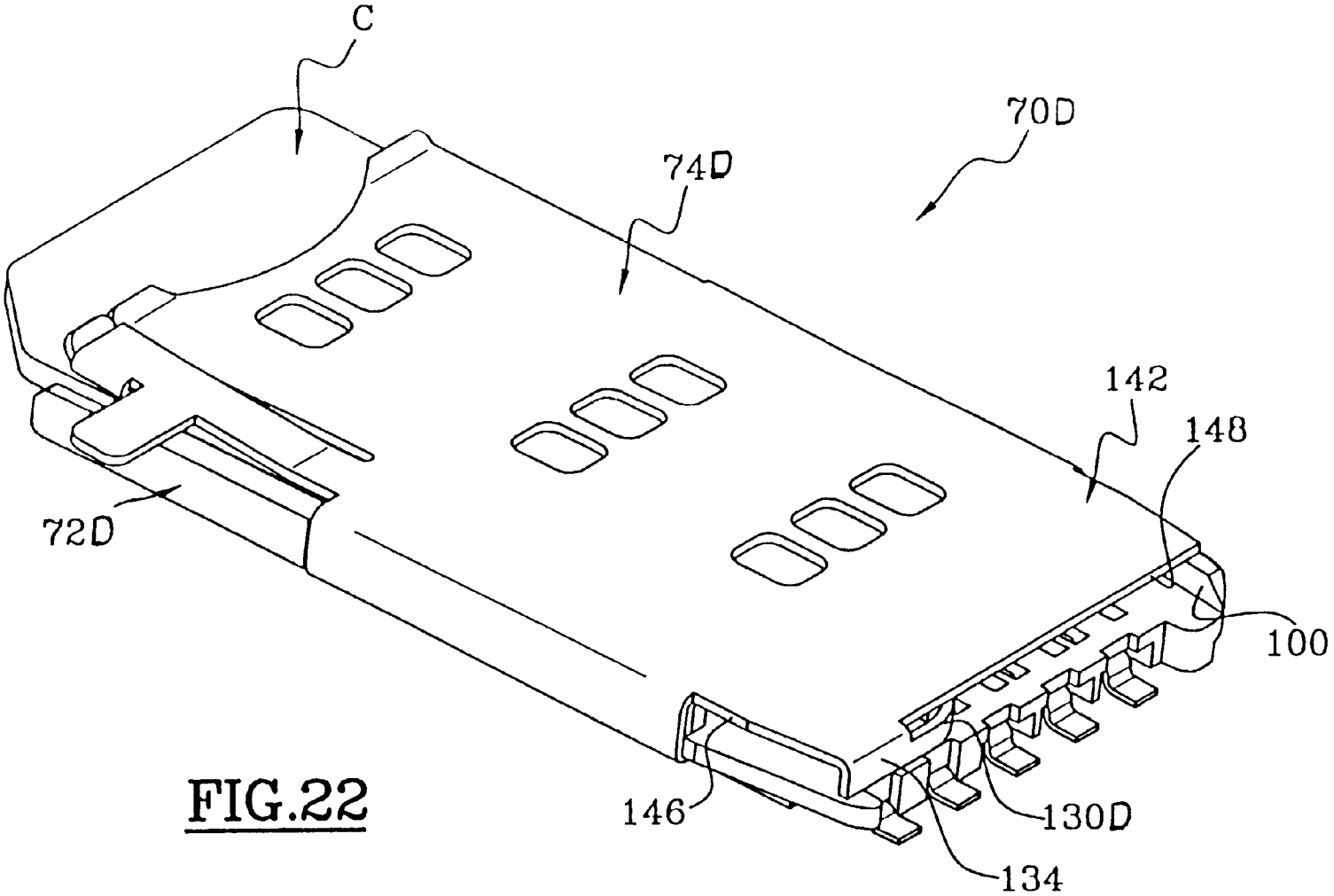
FIGS. 22–26 illustrate a fourth embodiment of the invention, where the ejection spring is integral with a one-piece cover, the views 22–26 being otherwise similar to views 17–21.

It may be noted that the "A" in spring "130A" indicates that this is the first embodiment of the invention. FIG. 11 shows a spring 130B of a second embodiment, FIG. 18 shows a spring 130C of a third embodiment, etc. Similar parts may have the same numbers in figures that illustrate different embodiments of the invention.

The spring 130A of FIG. 8 has a coil part 132 that lies around a stud 102 of the support. The spring also has a rear leg 134 that lies in a slot 110 formed in the support. The spring free end part 138 initially presses forward against a spring stop 114. When the spring is deflected rearwardly, it slides along an upper surface 112, with the stop 109 lying below the upper surface. The combined thickness of the spring leg 136 and stop 109 is approximately equal to the thickness of the card, with the spring leg 136 and stop 109 each having a thickness less than that of the card. It is possible to have the spring abut the stop in the fully inserted card position; so the card does not directly engage the stop.

Figures 9, 10:
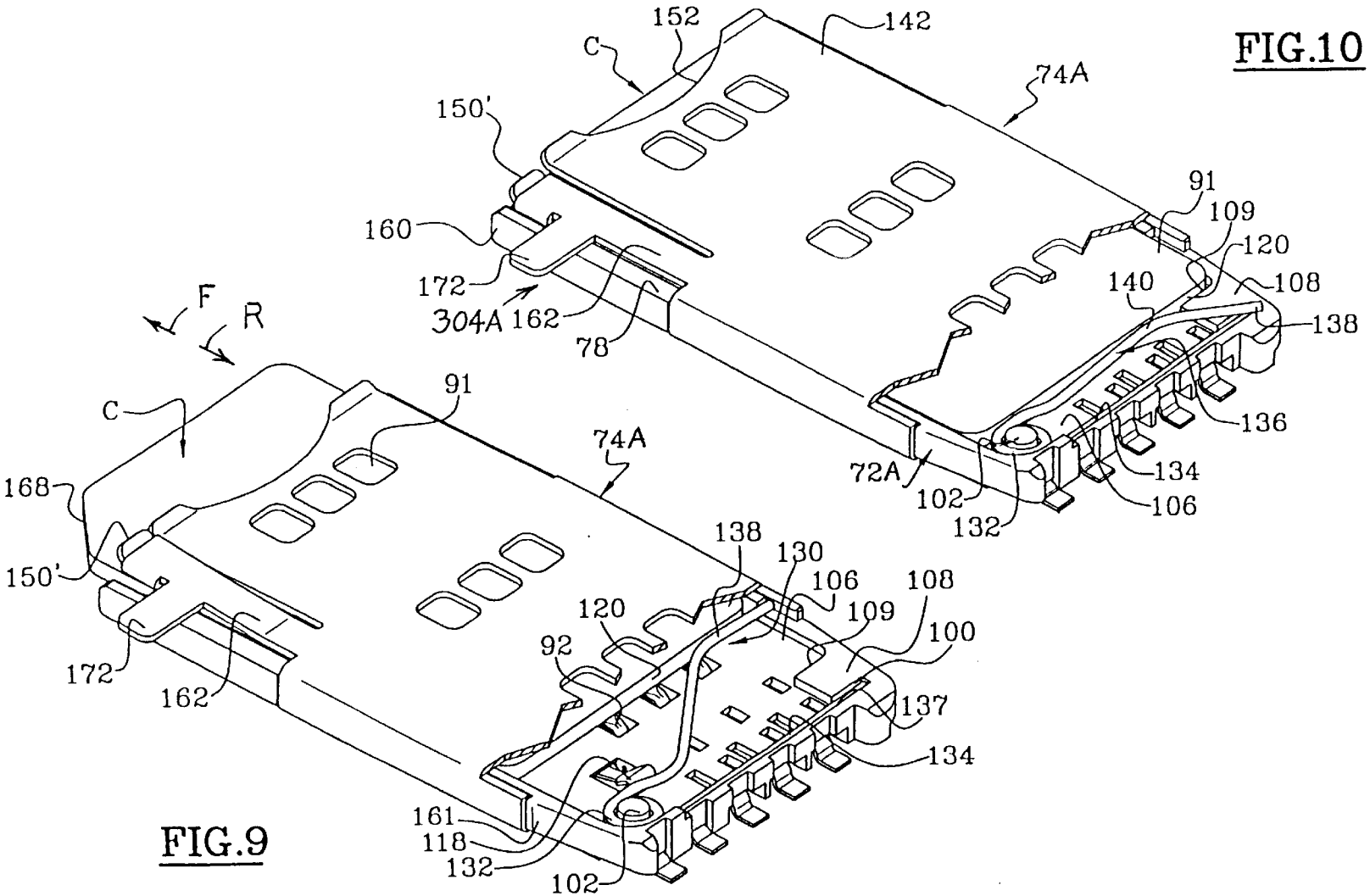
FIG. 9 is a view similar to that of FIG. 1, but with a portion of the rear of the cover being cut away, and with the card being inserted far enough to begin to deflect the spring.
FIG. 10 is a view similar to FIG. 9, but with the card fully inserted and the spring fully deflected.

FIG. 9 shows the card C partially inserted into the connector, with the rear edge 120 of the card abutting the front end part 138 of the spring. FIG. 10 shows the card fully inserted into the connector, with a bend location 140 of the spring leg abutting the rear edge of the card. The fact that the location along the spring leg that engages the card moves towards the coil 132, aids in providing a more even spring force.

Figure 2:
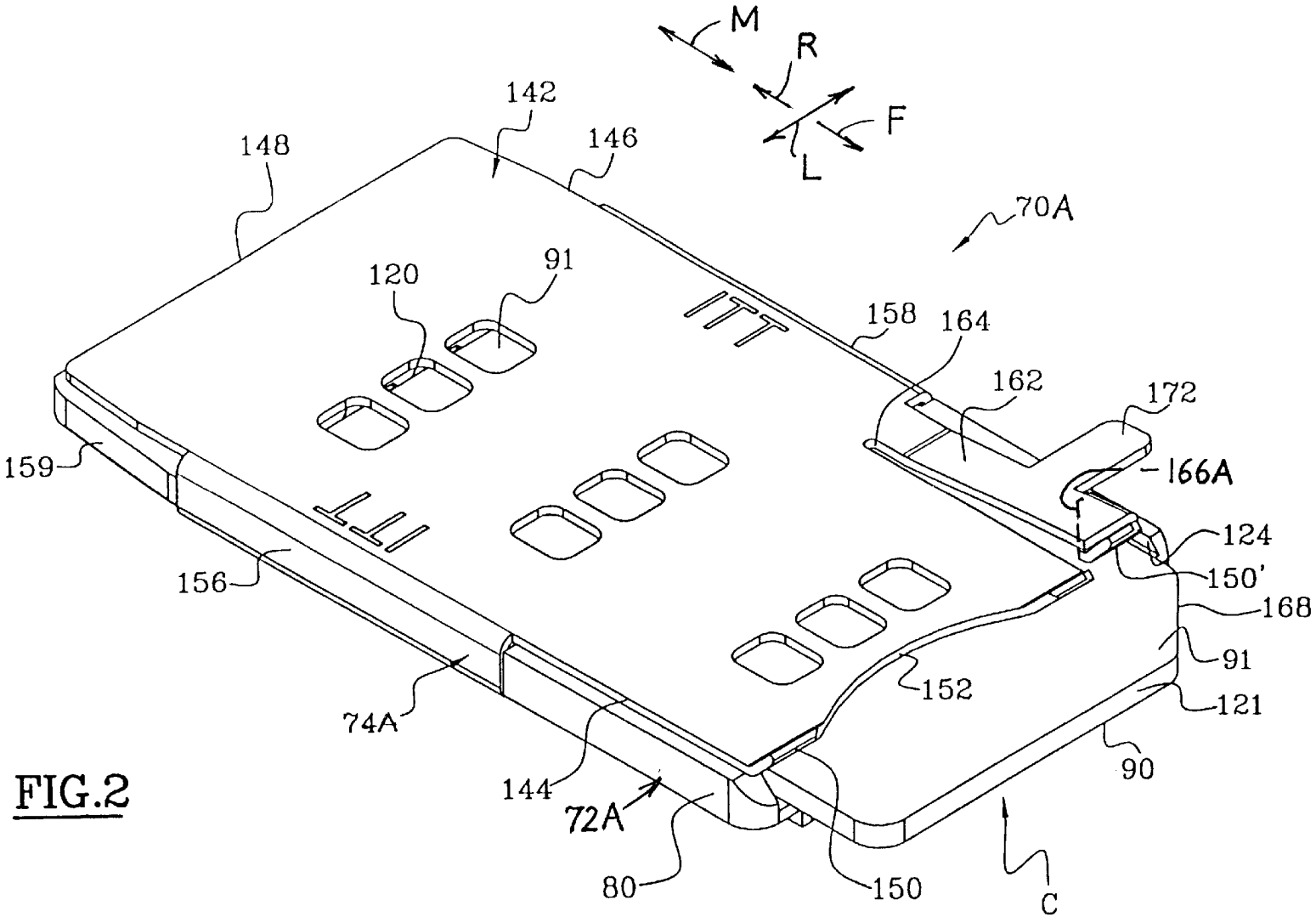
FIG. 2 is a front and top isometric view of the connector and card of FIG. 1.
Figure 4:
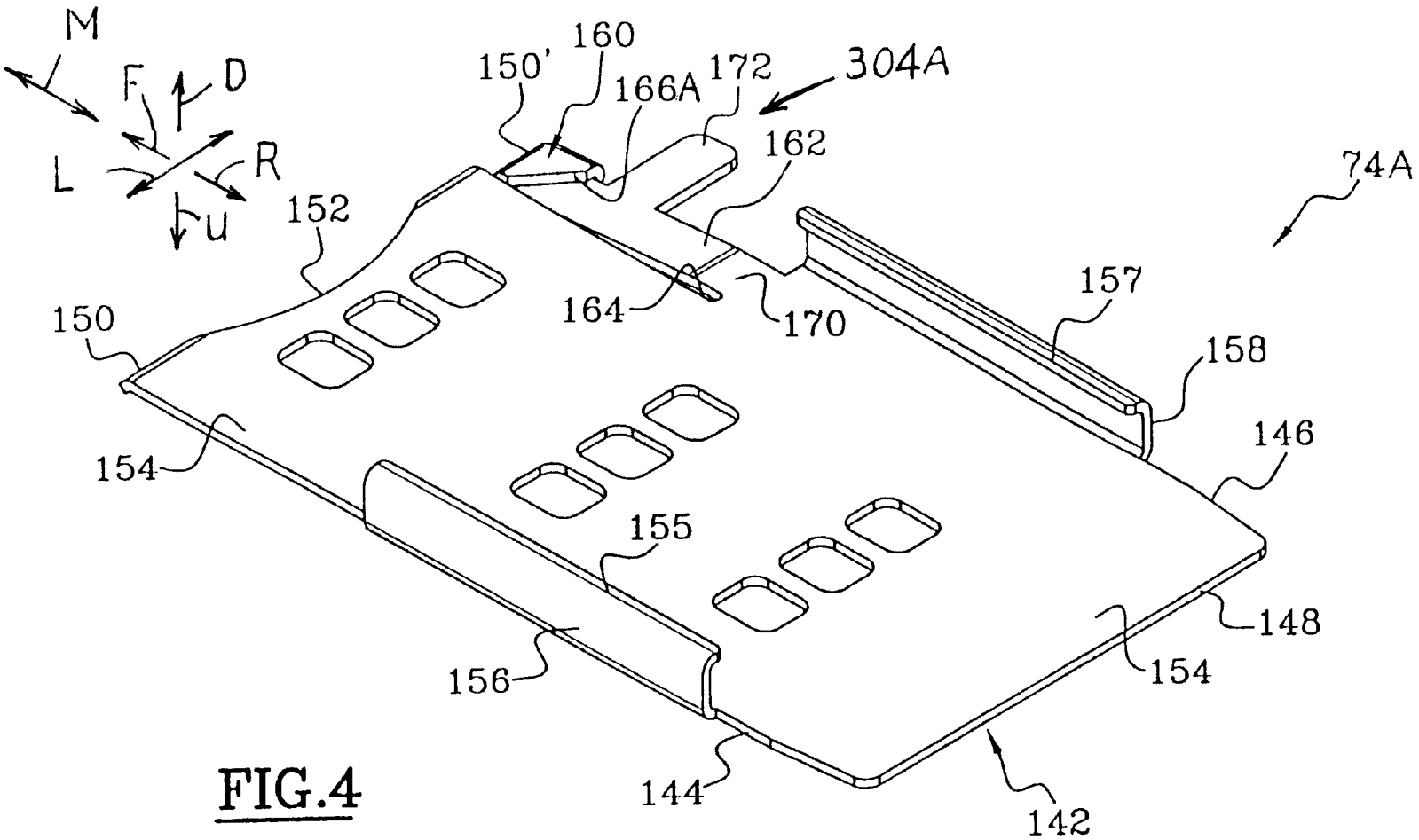
FIG. 4 is an upside-down isometric view of the cover of the connector of FIG. 1.

When the card has been fully inserted, a card retainer 304A locks the card in the connector, against the forward force of the spring. FIG. 4 shows that the card retainer 304A includes a carrier arm 162 that is formed in an upper plate 142 of the sheet metal cover, by a slit 164 that extends longitudinally M to the extreme front edge 150 of the cover. The bendable arm has an arm end 170 that extends from the rest of the cover, with the rest of the cover not bent during use and therefore which is fixed. A front end of the carrier arm is bent 180° to form a retaining lip 160 with a card retainer edge 166A that faces at least partially rearward and preferably about 45° from the rear. The edge 166A is intended to abut the polarizing edge 168 (FIG. 8) of the card. As a result, if the card is inserted upside down or with its front edge rearward, then when the card is fully inserted its polarizing edge will not lie behind the card retainer edge 166A and the card will move partially out of the cavity under the force of the spring. FIG. 2 shows the polarizing edge 168 of a partially inserted card moving towards a position where it will lie rearward of the retainer edge 166A. It is noted that the extreme front end 150' of the carrier arm forms a lead-in that helps to guide the card when its rear edge is initially inserted into the connector.

When the card has been pushed rearwardly to its fully inserted position, resilience of the carrier arm 162 causes it to push down against the card, with the retainer edge 166A pressing against the polarizing edge of the card. To remove the card, a person lifts a release tab 172 on the carrier arm. This lifts the retainer edge 166A to allow the spring to push the card forwardly, as to the position shown in FIG. 2. With the front edge 121 of the card projecting from the connector, a person can grasp the front end of the card and pull it forwardly out of the connector.

FIGS. 11–16 illustrate a connector 70B of a second embodiment of the invention, with a modified spring. As shown in FIG. 12, the spring 130B has a vertically-extending end 139 that extends down from the free end portion 138 of the forward spring leg. FIG. 13 shows that the vertical end 139 projects into a groove 101 formed in the support 72B. The groove helps stabilize the position of the free end of the front spring leg.

FIGS. 17–21 show a connector 70C of a third embodiment of the invention, which uses another spring. As shown in FIG. 18, a coil spring 130C is used, which lies in a groove in the plastic molded support 72C. The multi-turn helical spring has a front end 138 that directly engages the rear edge 120 of the card, and an opposite spring rear end 134 that engages a shoulder at the rear of the spring-holding groove. Stops 109C abut the fully inserted card.

Figure 23:
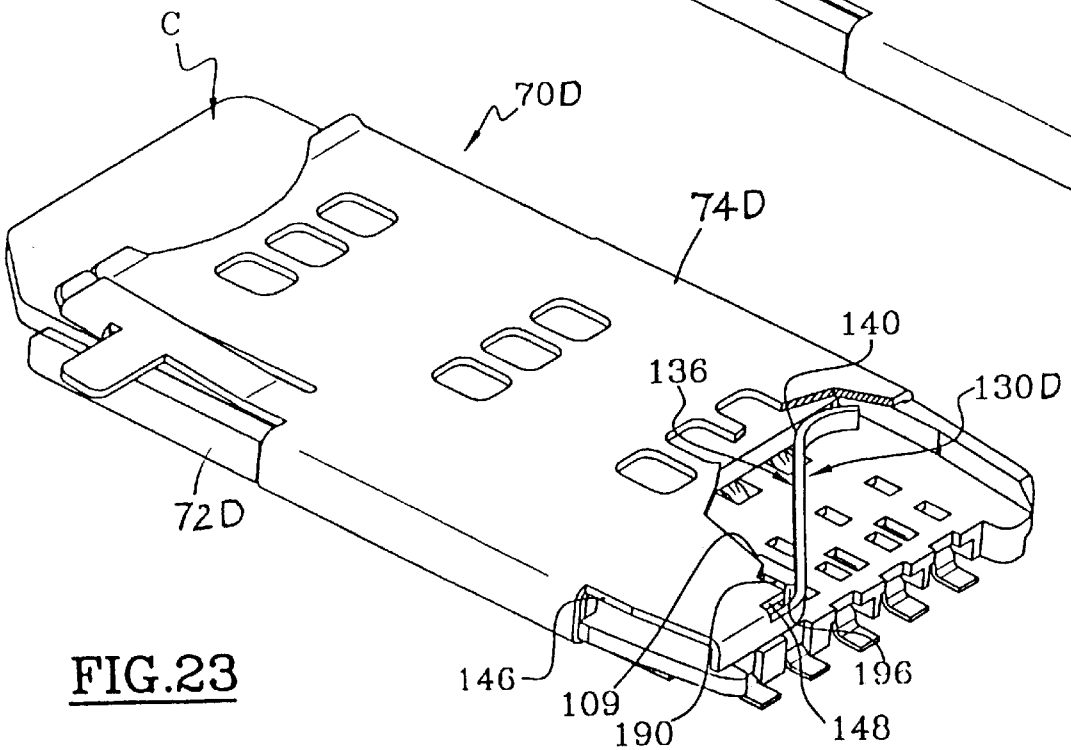
Figure 26:
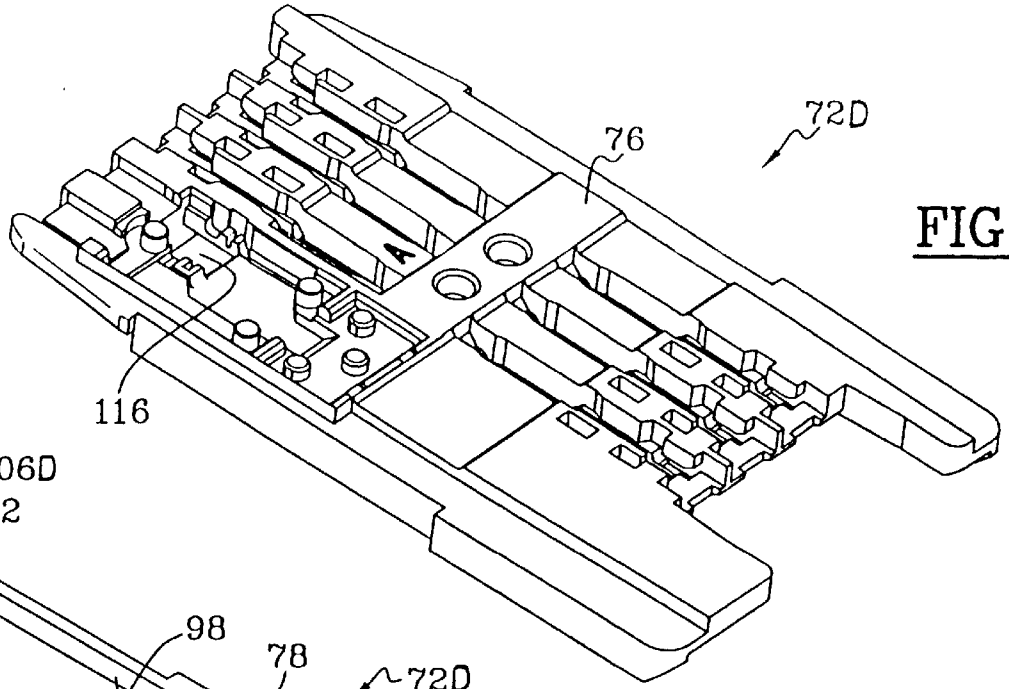
Figure 27:
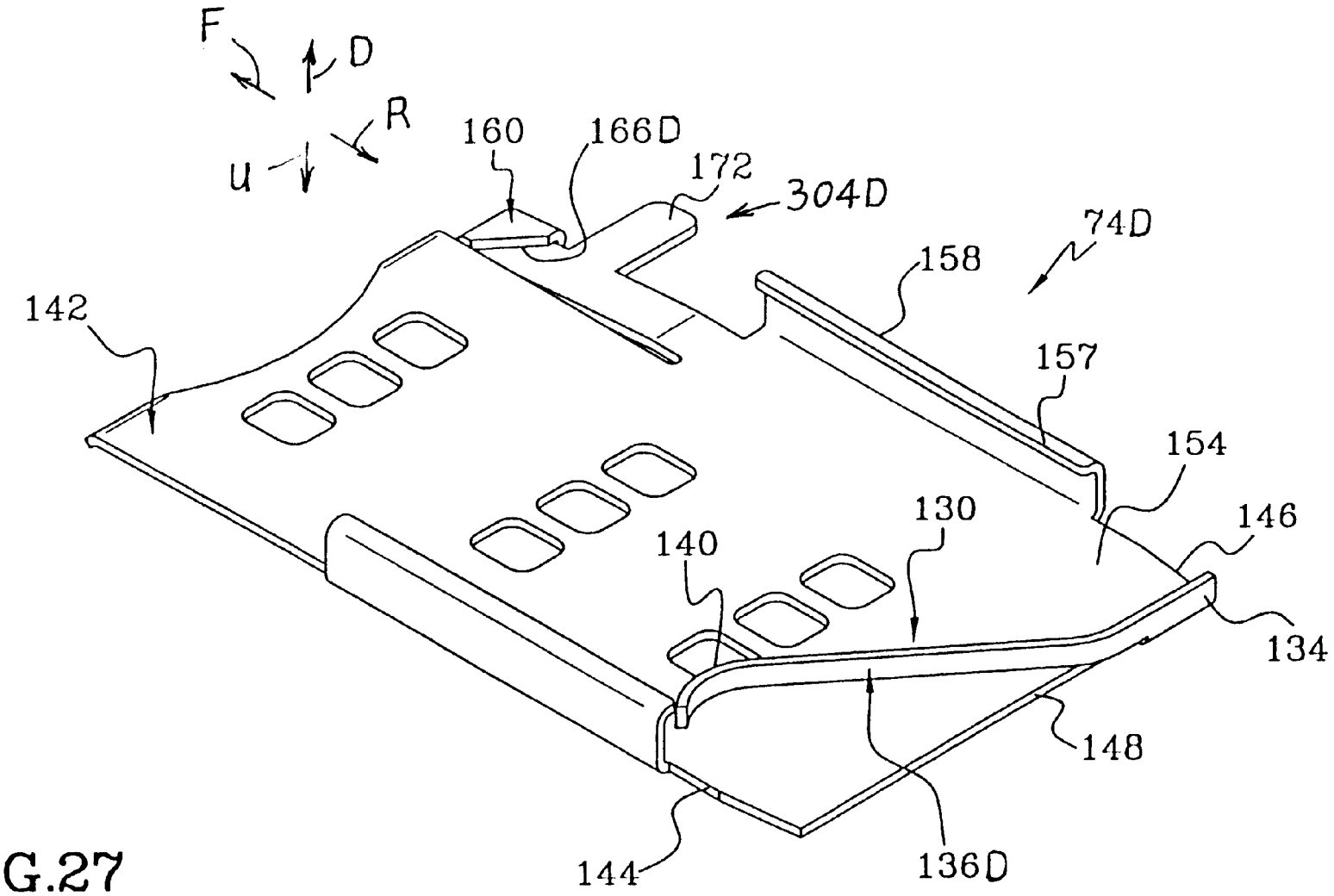
FIG. 27 is a bottom isometric view of the cover of the connector of FIG. 24, in an upside-down position.
Figure 28:
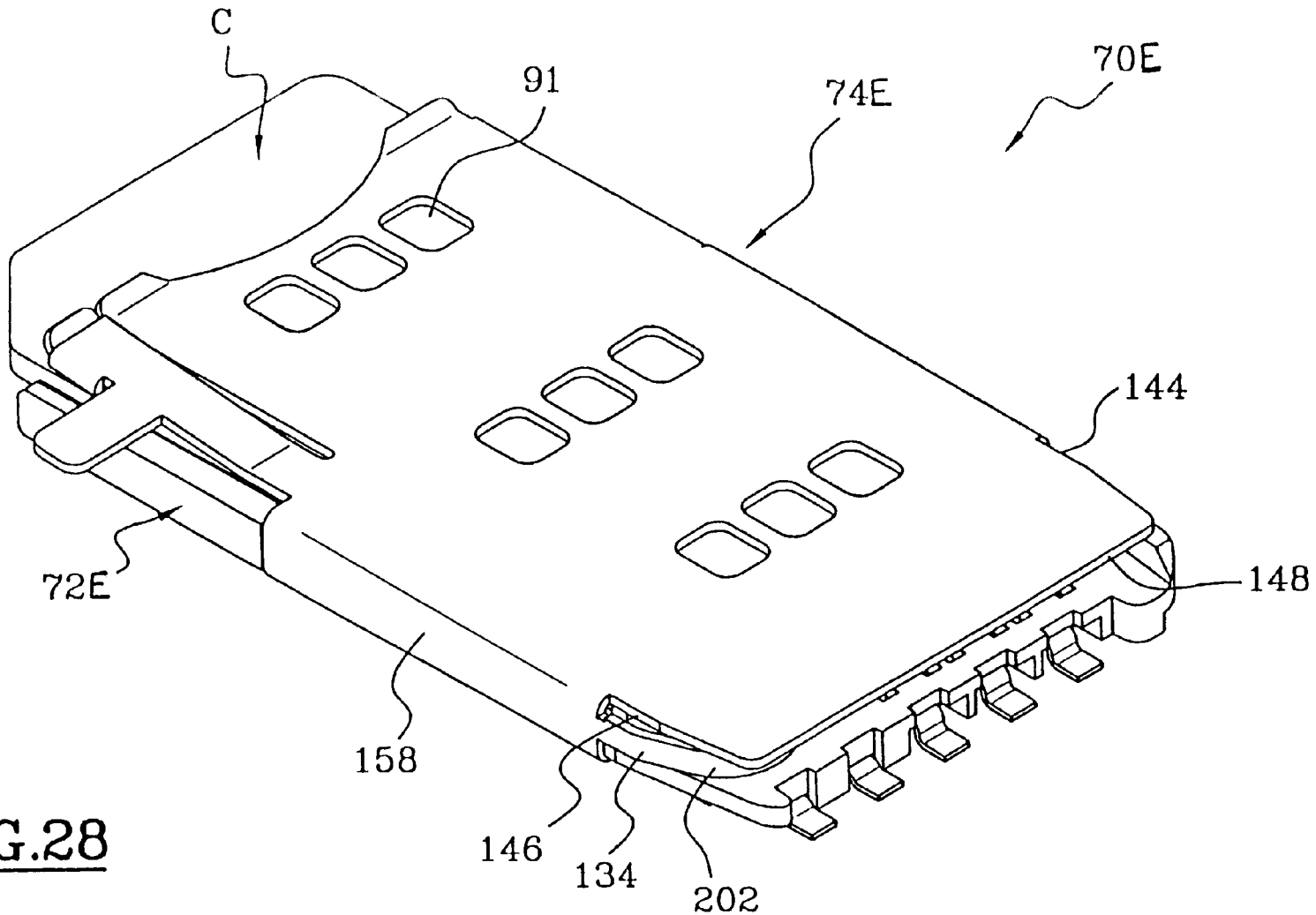
FIGS. 28–33 illustrate a fifth embodiment of the invention, in which the ejection spring is formed integrally with a metal cover of the connector housing, the views 28–33 being otherwise similar to views of FIGS. 22–27.

FIGS. 22–27 illustrate a connector 70D of another embodiment of the invention, with a modified spring. As shown in FIG. 23, the spring 130D is formed from a portion of the sheet metal cover 74D of the connector that lies over a support 72D. FIG. 27 shows that the rear end 148 of the sheet metal cover has a vertical part 134 resulting from a 90° bend. Along a spring ejection branch or leg 136D, the vertical part is separated from the top plate 142 and is free to deflect. The sheet metal cover 74D is made of a spring temper metal such as a spring tempered stainless steel, to provide springiness for the card retainer 304D as well as for the spring leg 136D. The spring leg 136D lies in a vertical plane, in that its dimensions in the vertical directions U, D are a plurality of times as great as its thickness in a horizontal direction that is perpendicular to the vertical direction.

Figure 33:
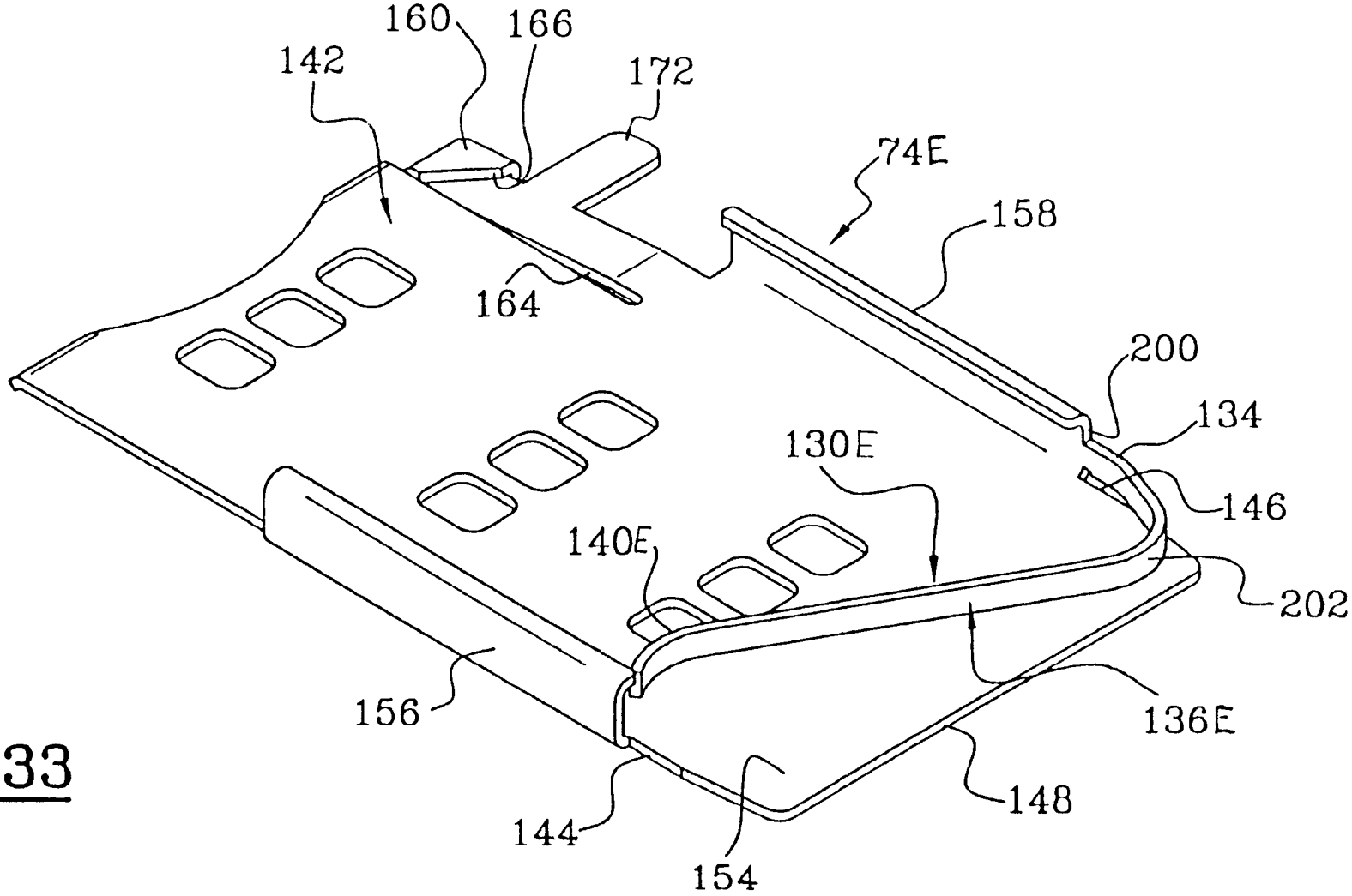
Figure 34:
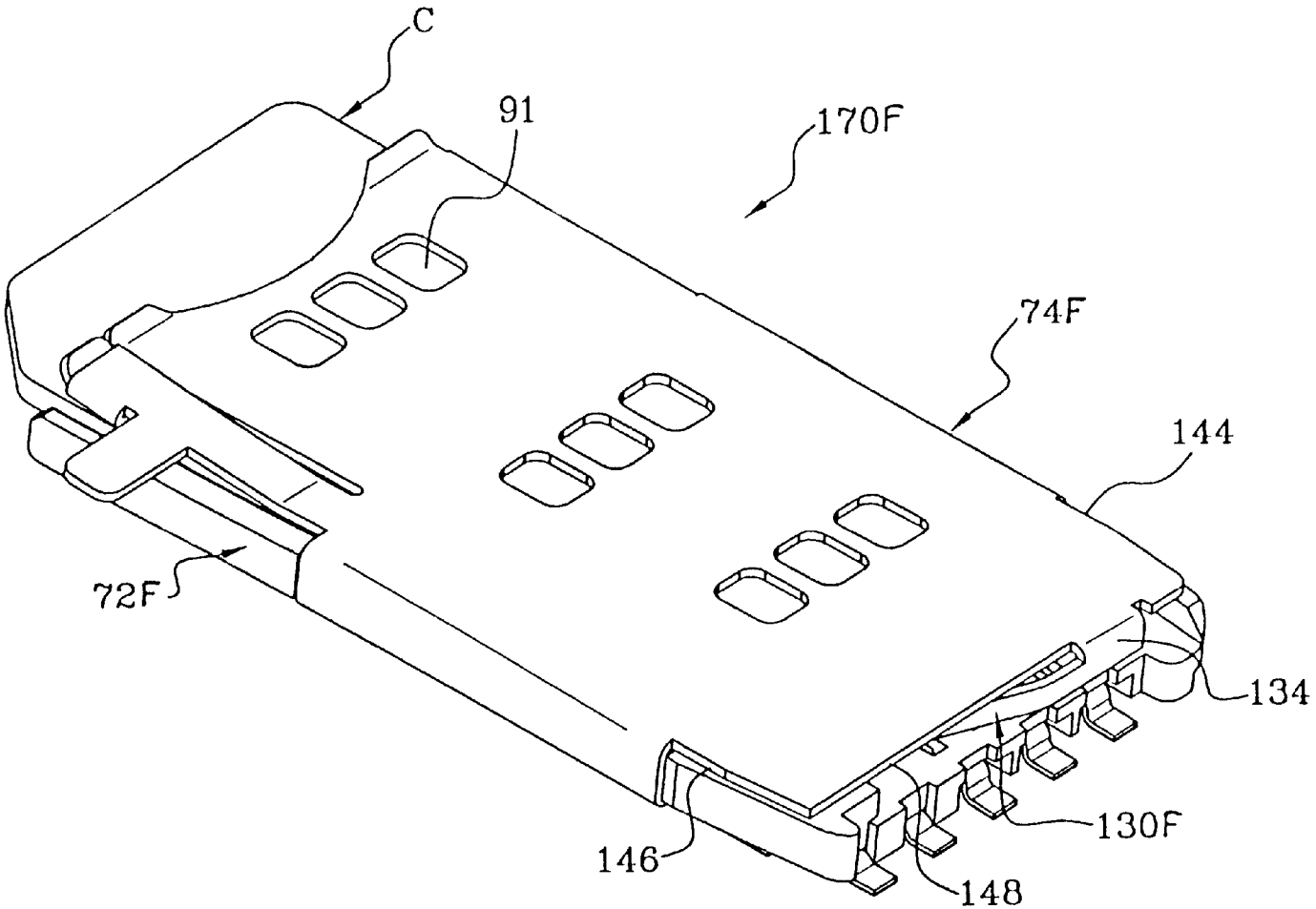
FIGS. 34–39 illustrate a sixth embodiment of the invention in which the ejection spring is an integral part of single piece cover, and is bent into a U configuration, with views of FIGS. 34–39 being otherwise similar to the views of FIGS. 22–27.
Figures 35, 36:
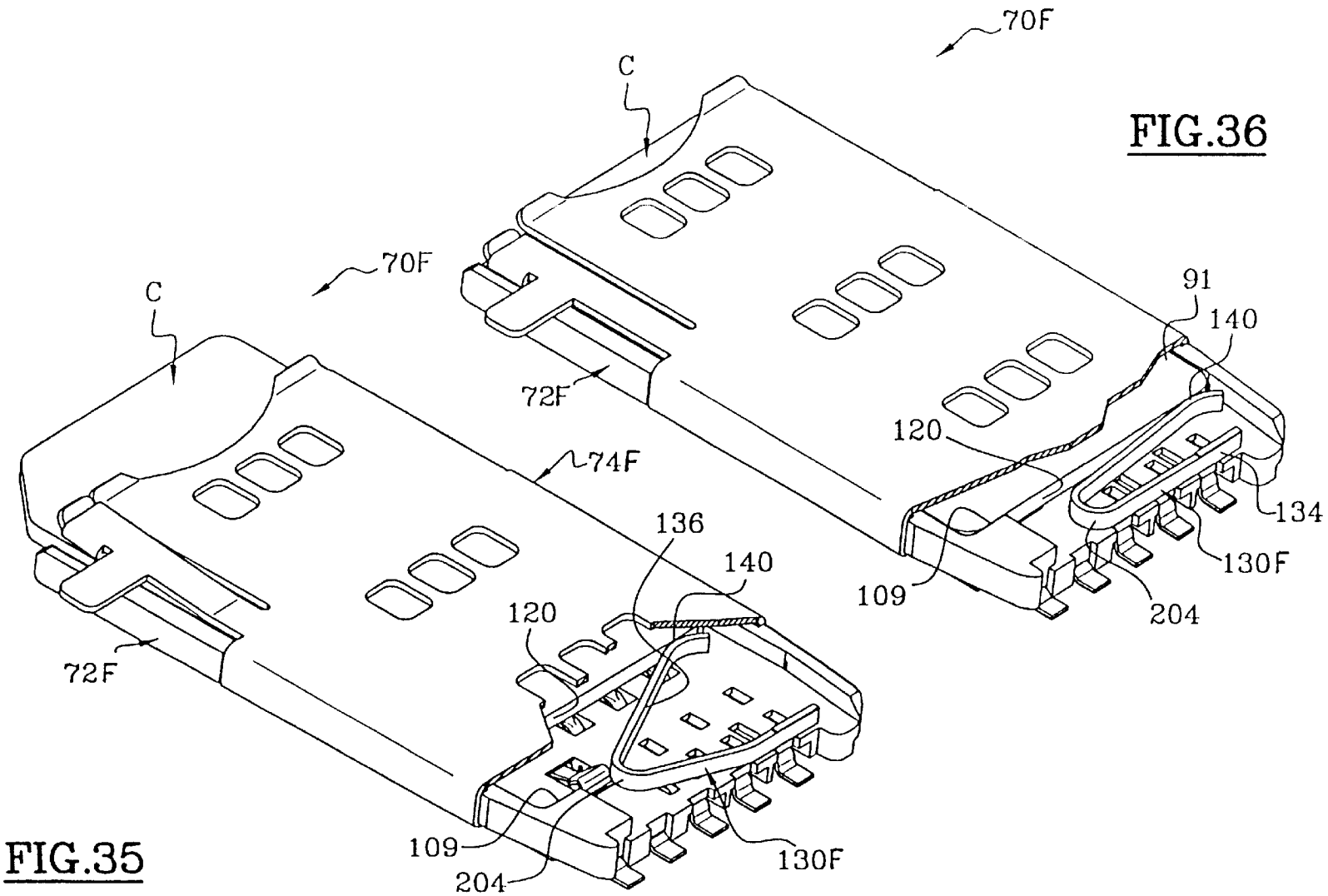
Figure 38:
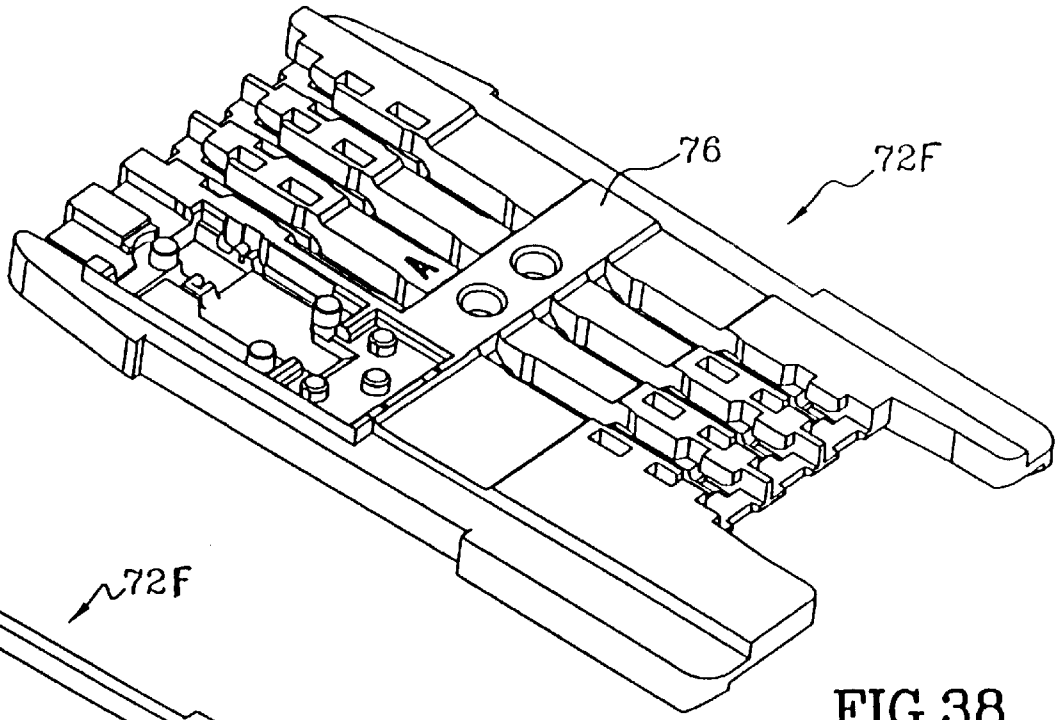
Figure 37:
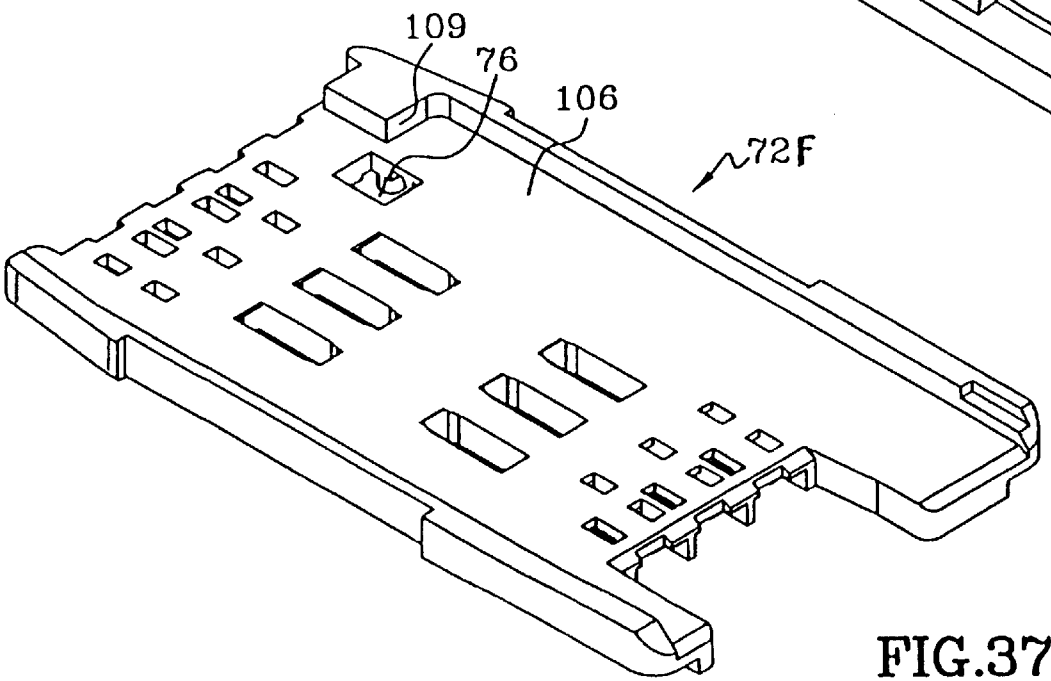

FIGS. 28–33 show a connector 70E of a fifth embodiment of the invention, with a modified spring. As shown in FIG. 33, the spring leg 130E extends from a vertical side wall 158 of the cover 74E, with the side wall lying in a vertical plane that is perpendicular to the horizontal top plate 142 of the cover. The spring leg 130E extends from a rear end of the bent-over side wall 158, with a first section 134 extending rearwardly to an approximately 90° bend 202, to a largely laterally-extending branch 136E. A bend at 140E actually directly engages the rear end of the card. The support 72E is substantially unmodified.

Figure 39:
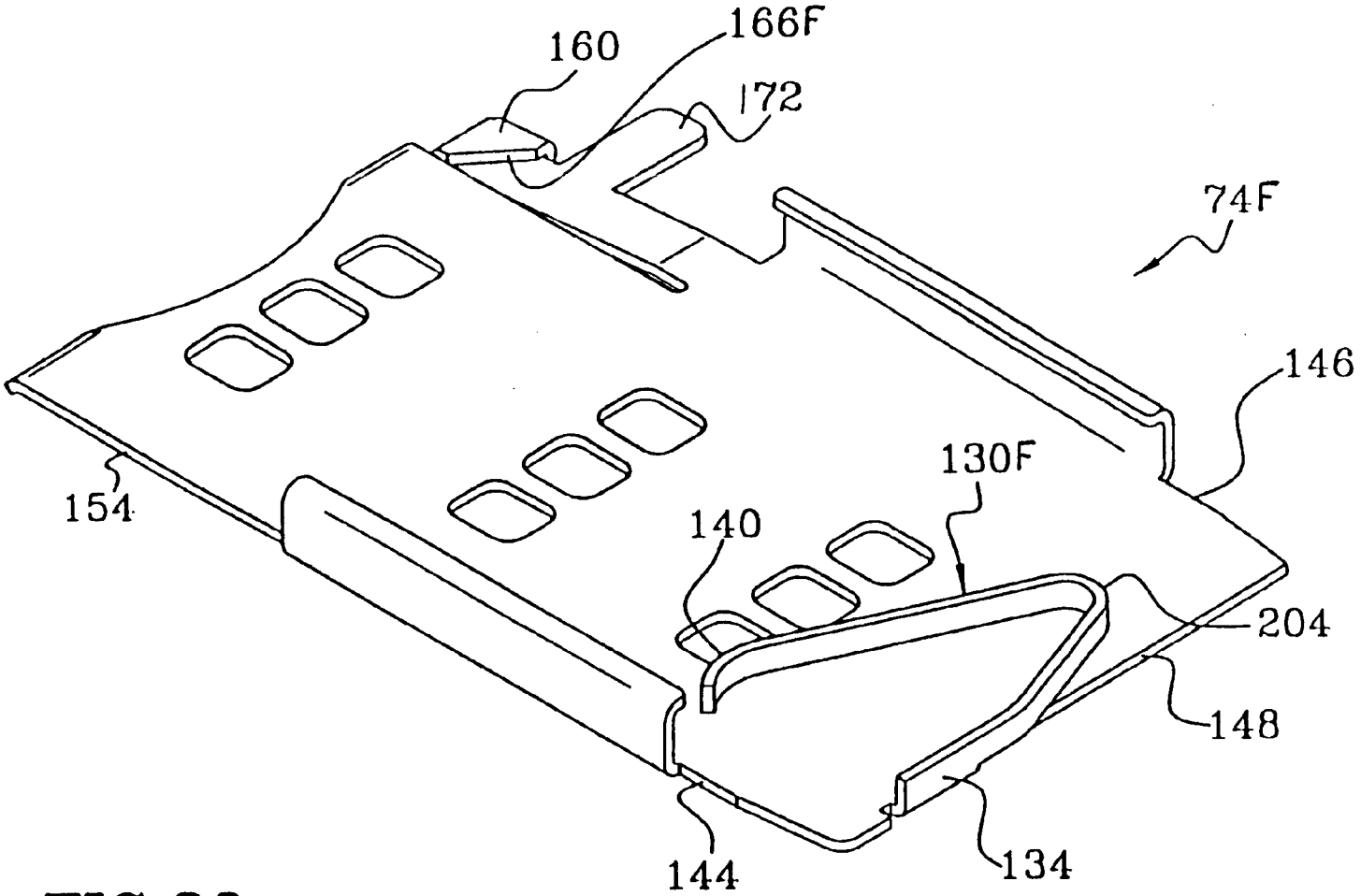

FIGS. 34–39 illustrate another embodiment of the invention, with a modified spring leg. As shown in FIG. 39, the spring leg 130F, which is part of the cover 74F, has a more than 90° bend at 204 that connects a vertical rear wall 134 to the top plate of the cover that lies in a horizontal plane. The over 90° bend at 204 results in a longer spring leg being accommodated in a connector of given lateral width, for greater resilience. The support 72F is substantially unmodified.

Figure 40:
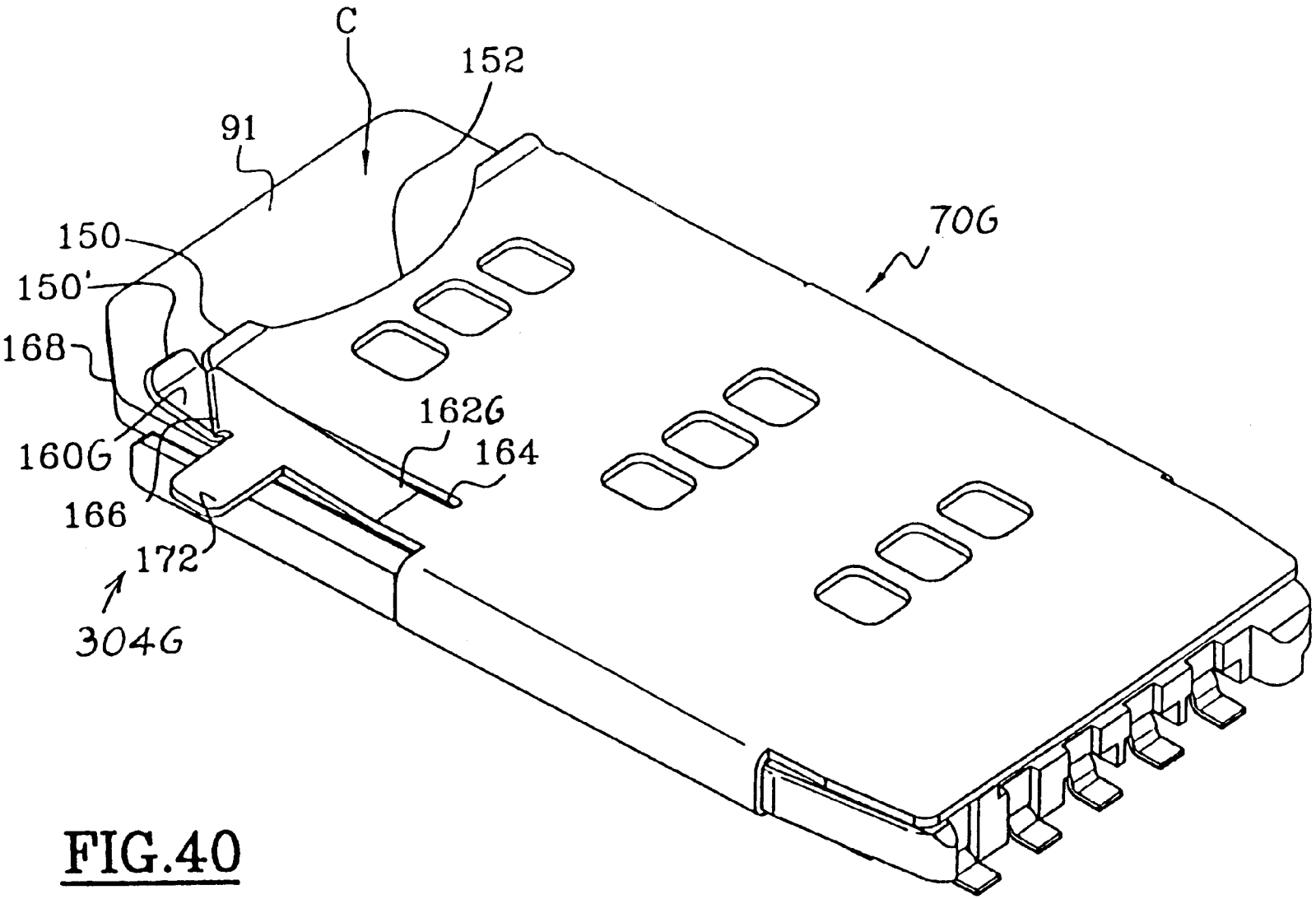
FIG. 40 is a rear and top isometric view of a connector of a seventh embodiment of the invention, where the retaining lip is of a modified construction.
Figures 41, 42:
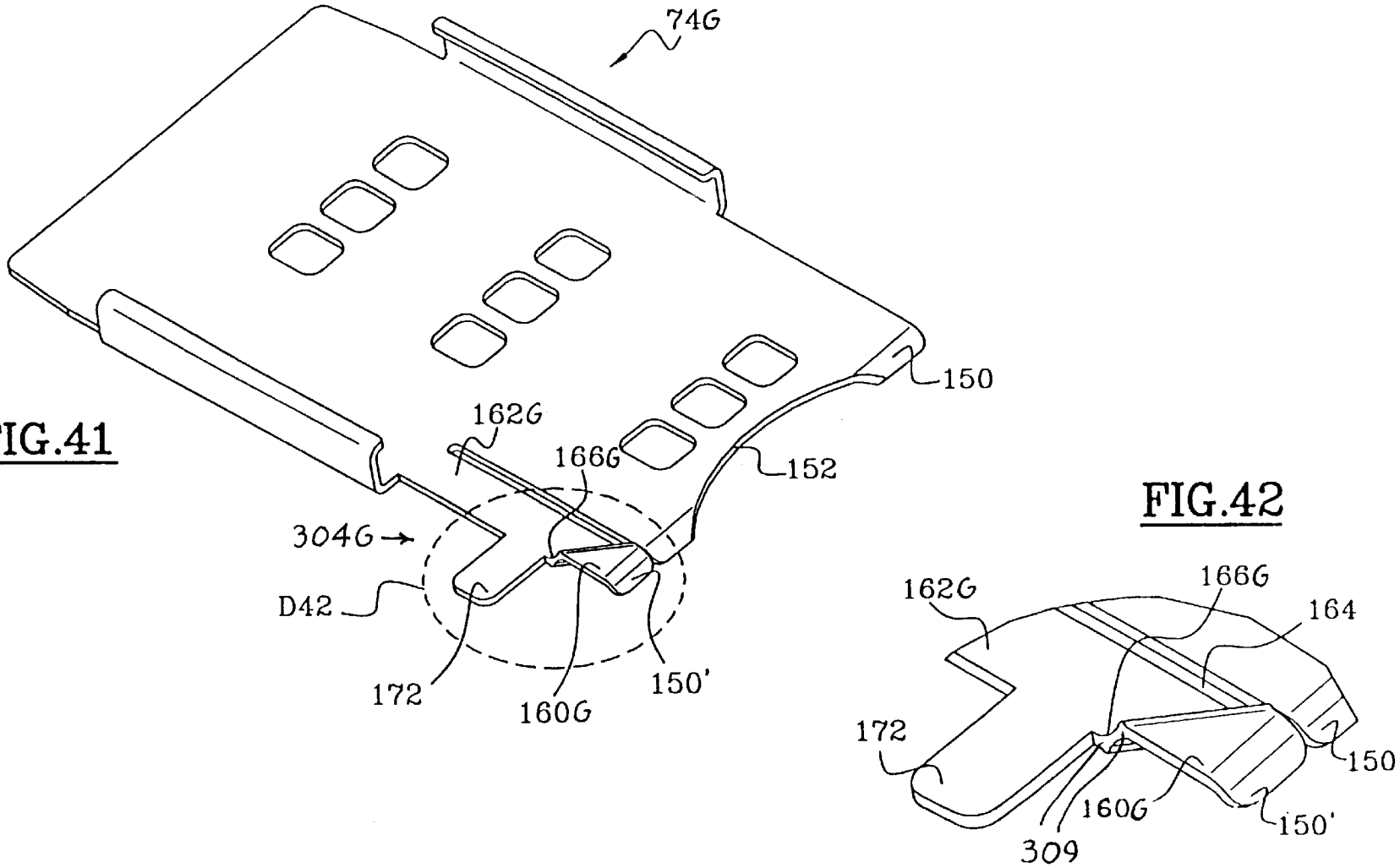
FIG. 41 is a bottom view of the cover of the connector of FIG. 40.
FIG. 42 is an enlarged view of detail D42 of FIG. 41.
Figure 45:
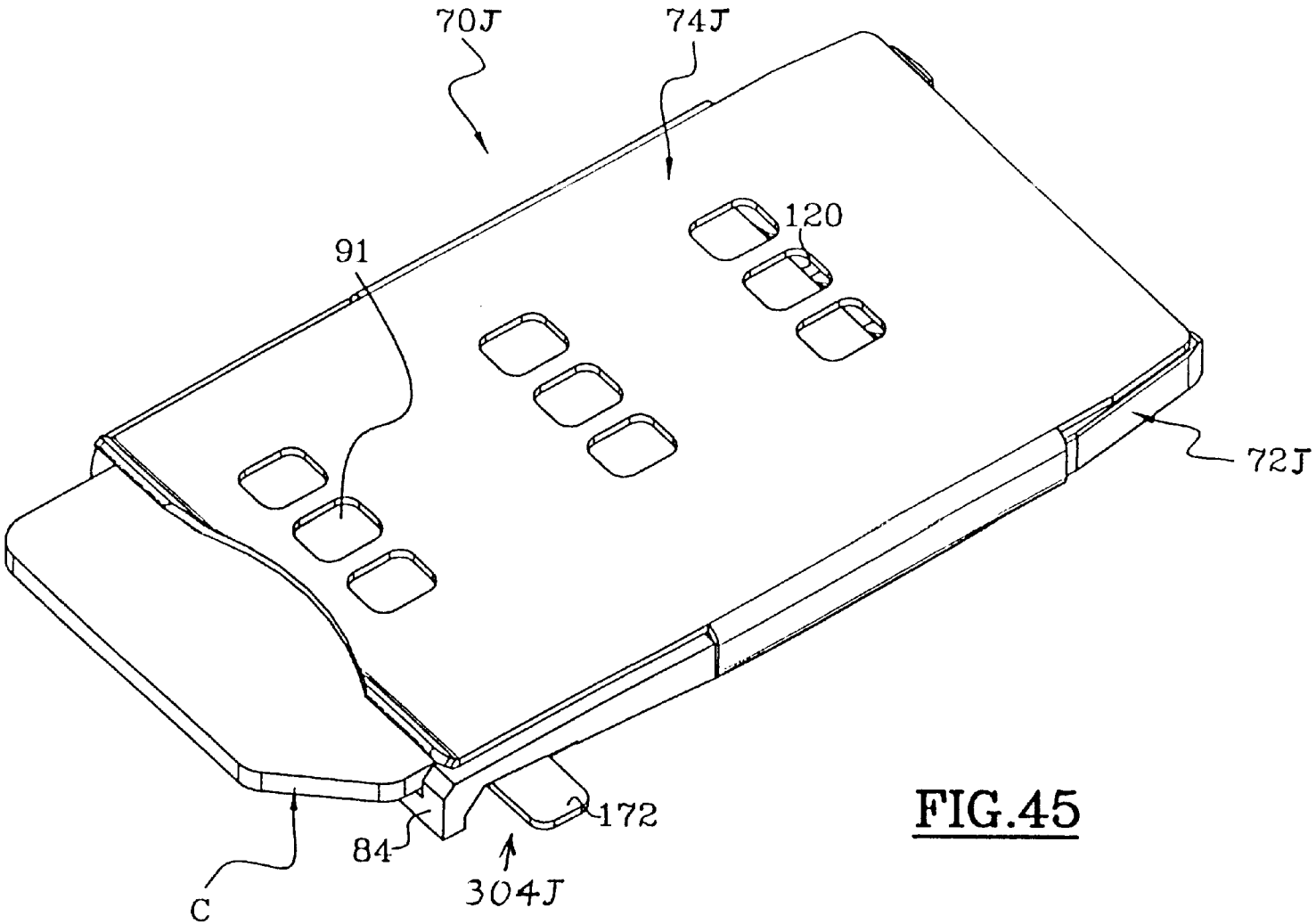
FIG. 45 illustrates a ninth embodiment of the invention in which the carrier arm and retaining lip are located beneath the insulating support.

FIGS. 40–42 show a connector 70G of a seventh embodiment of the invention, wherein the card retainer 304G is modified. As shown in FIGS. 41 and 42, the card retainer includes a carrier arm 162G with a pair of largely right-angle bends at 309 forming a largely vertically-extending sheet metal part 166G. The lip 160G forms a lip edge 166G that abuts the polarized edge of the smart card to retain it in the connector until tab 172 is lifted. A forward end 150' of the lip forms a lead-in that ensures that the carrier arm 162G will be deflected upward when a card is inserted. The lead-in 150' is flush with an adjacent fixed lead-in 150, only when pressed up during insertion of a card. During such card insertion, the carrier arm 162G biases the lead-in 150' and lip edge 166G downward, preferably until the carrier arm 162G lies against the top of the card.

FIGS. 43–44 illustrate a connector cover 74H of an eighth embodiment of the invention, where a card retainer 304H includes a lip in the form of a projection 160H. As shown in FIG. 44A, the projection 160H is formed by deforming a front portion of the carrier arm to form a retainer lip 166H that engages the polarized edge of a card.

Figures 46, 47, 48:
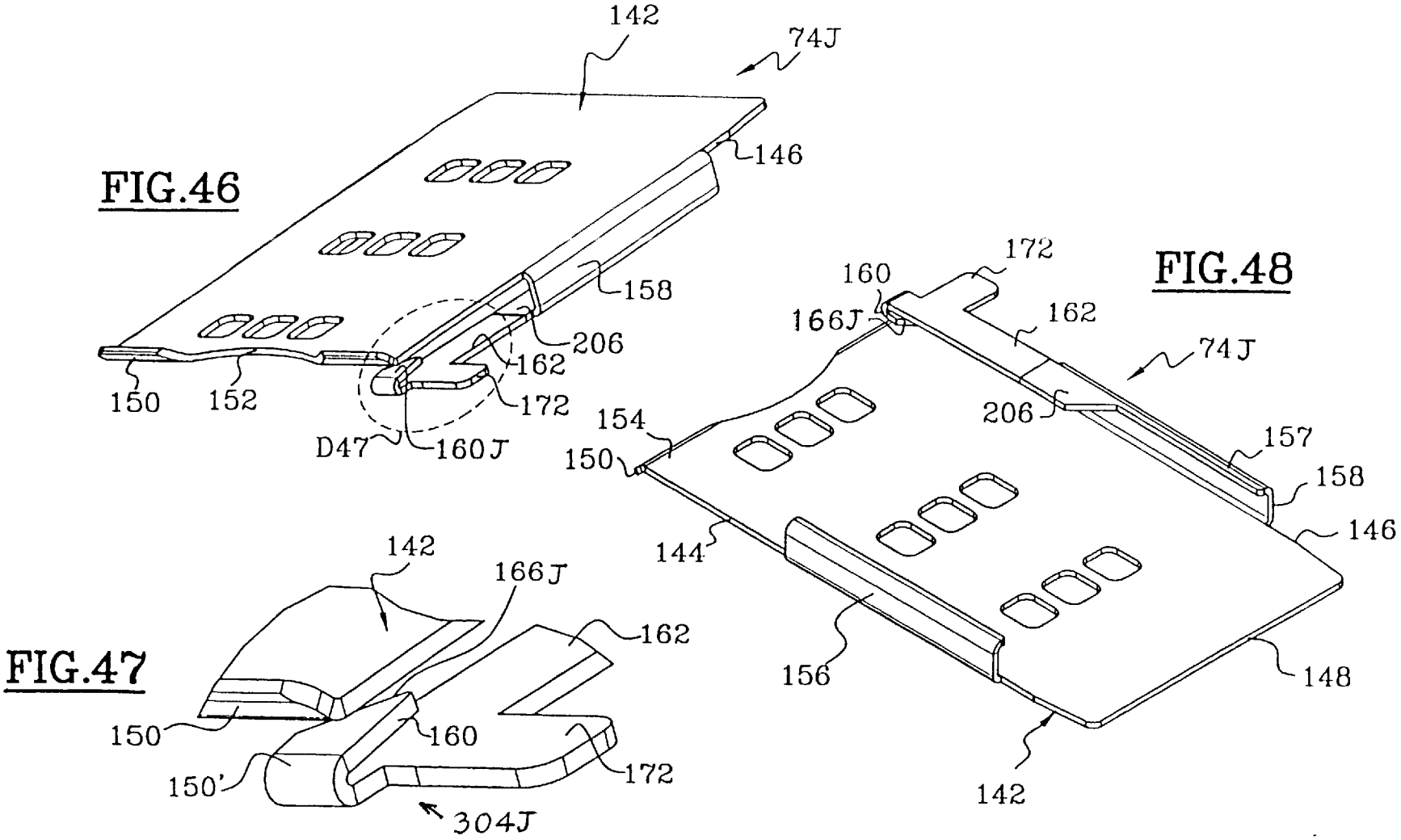
FIG. 46 is a top and front isometric view of the cover of the connector of FIG. 45.
FIG. 47 is an enlarged view of detail D47 in FIG. 46.
FIG. 48 is a bottom and rear isometric view of the cover of FIG. 46.

FIGS. 45–52 illustrate a connector 70J of a ninth embodiment of the invention with a support 72J and cover 74J, where the cover 74J has a card retainer 304J that is modified to allow card release by pushing down against the manually actuated tab 172. As shown in FIG. 46, the carrier arm 162 lies in a horizontal plane that is spaced below the top plate 142 of the cover 74J, by about the thickness of the card. A vertical side wall 158 of the cover connects the top plate 142 to the carrier arm 162 in two 90° bends. A forward extension 206 of the carrier arm merges with the side wall 158, and the carrier arm 162 projects forwardly therefrom. A front end of the carrier arm is folded over in an approximately 180° bend to form a retainer lip 160J with a lip edge 166J that engages the polarized corner of the card. The card retainer 304J has the advantage that it releases the card from the retaining lip 166J by depression of the manually operated tab 172. It is more natural and easier to depress the tab than to lift it, and the construction of FIGS. 45–52 enables such release by depression of the tab.

Figures 49, 50:
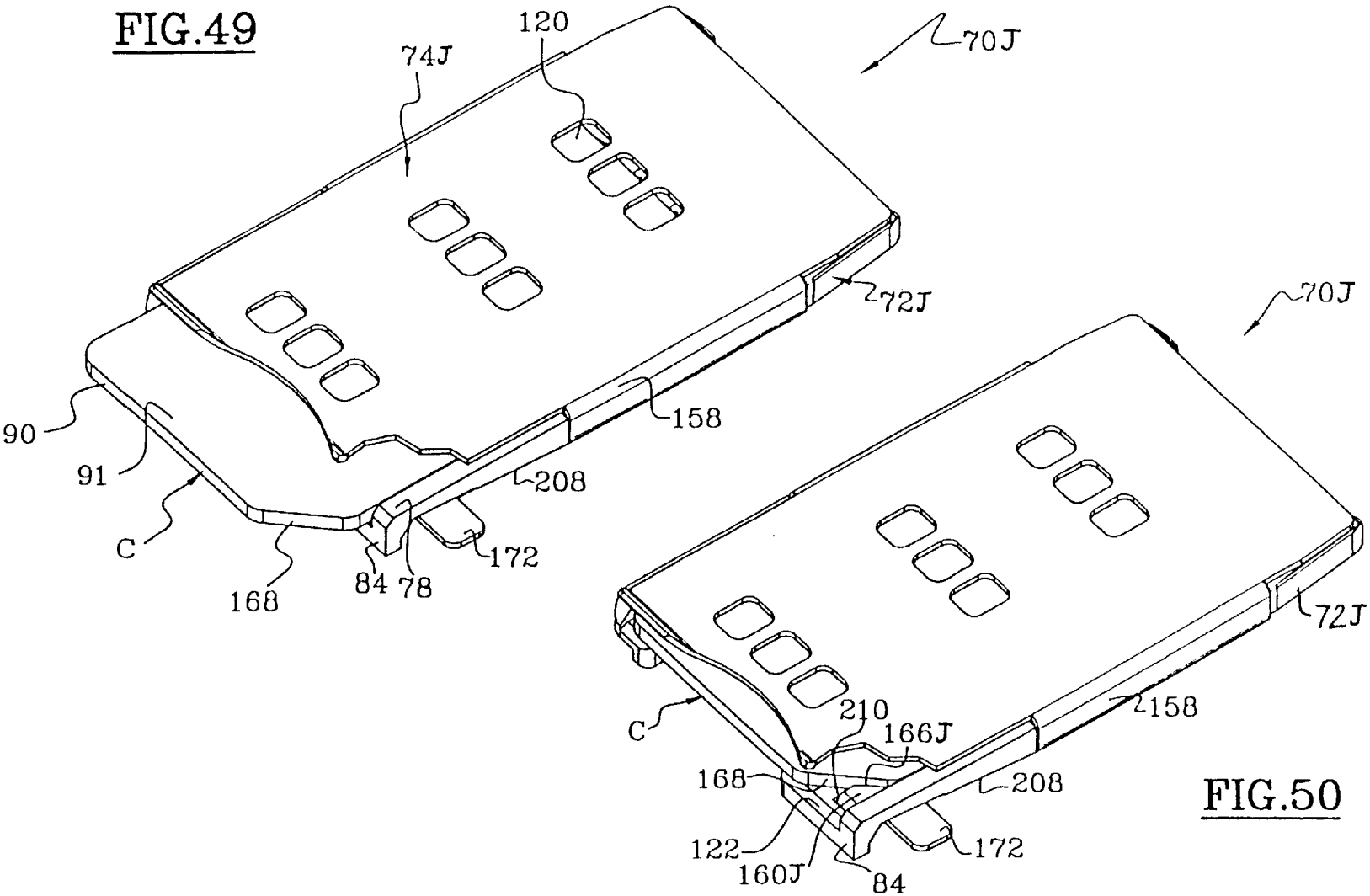
FIGS. 49 and 50 are top and front isometric views of the connector of FIG. 45, in which the card is illustrated in the process of being inserted into the connector.
Figures 51, 52:
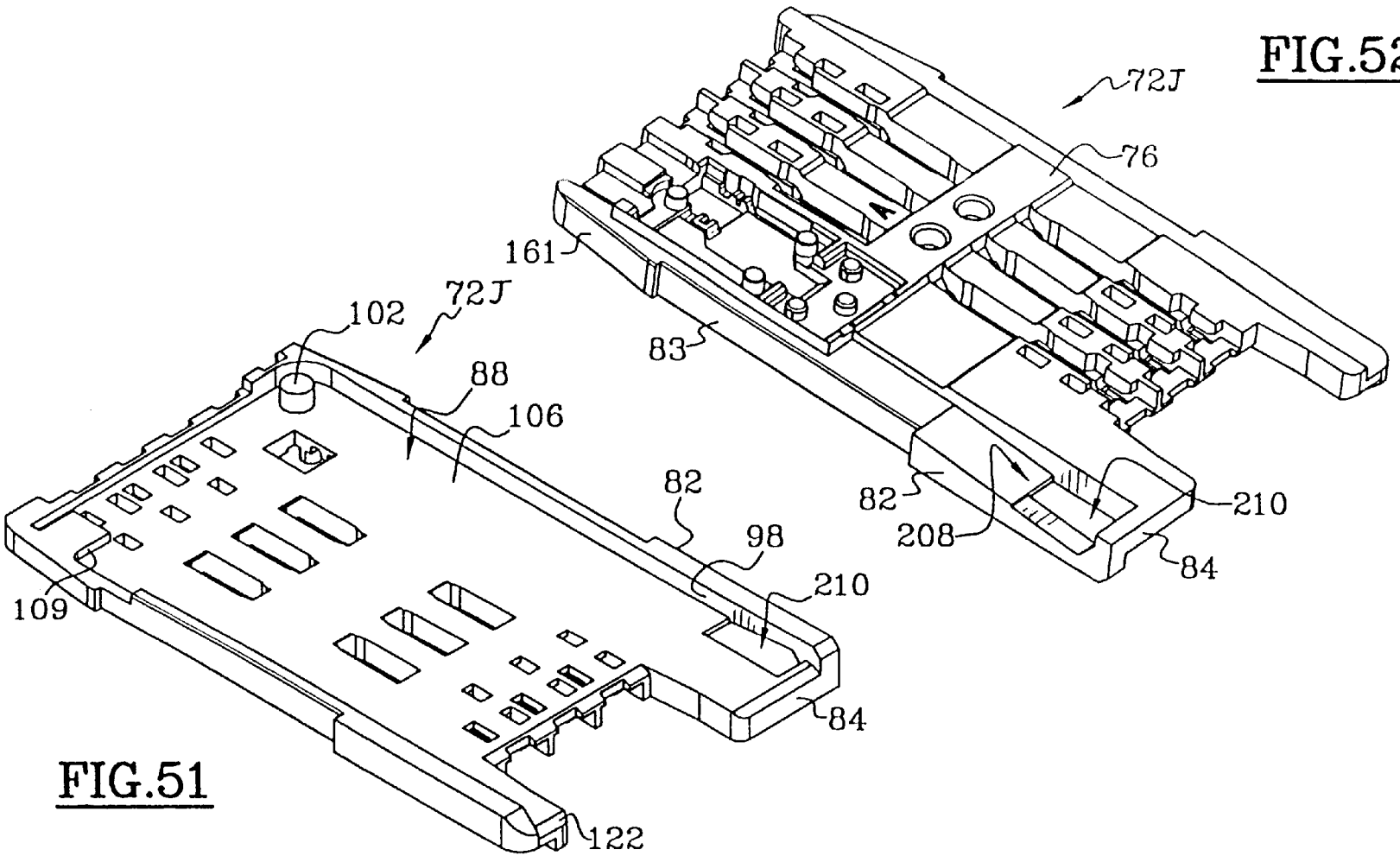
FIGS. 51 and 52 are top and bottom isometric views, respectively, of the insulating support of the connecter of FIG. 45.
Figures 53, 54:
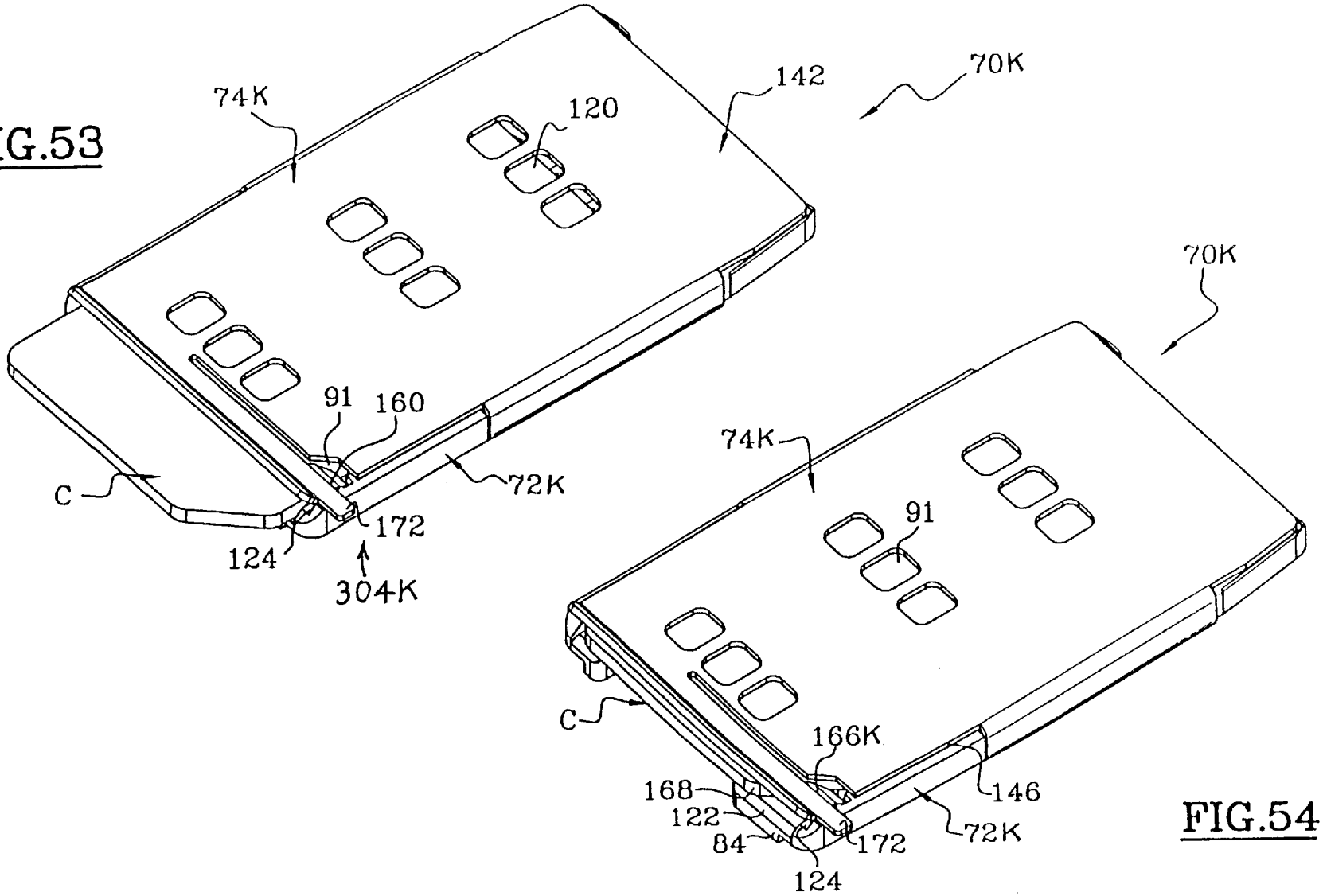
FIGS. 53–56 illustrate a tenth embodiment of the invention, where the carrier arm and the retaining lip extend laterally, the views being otherwise similar to the views of FIGS. 49–52.

FIGS. 51 and 52 show that the support 72J has a hole at 210 for movement of the carrier arm. FIG. 50 shows the retainer lip 160J projecting above the top of the hole 210 to engage the polarized edge 168 of the card, with the tab 172 positioned to be depressed to move the retainer lip 160 and edge 166J below the card.

Figures 55, 56:
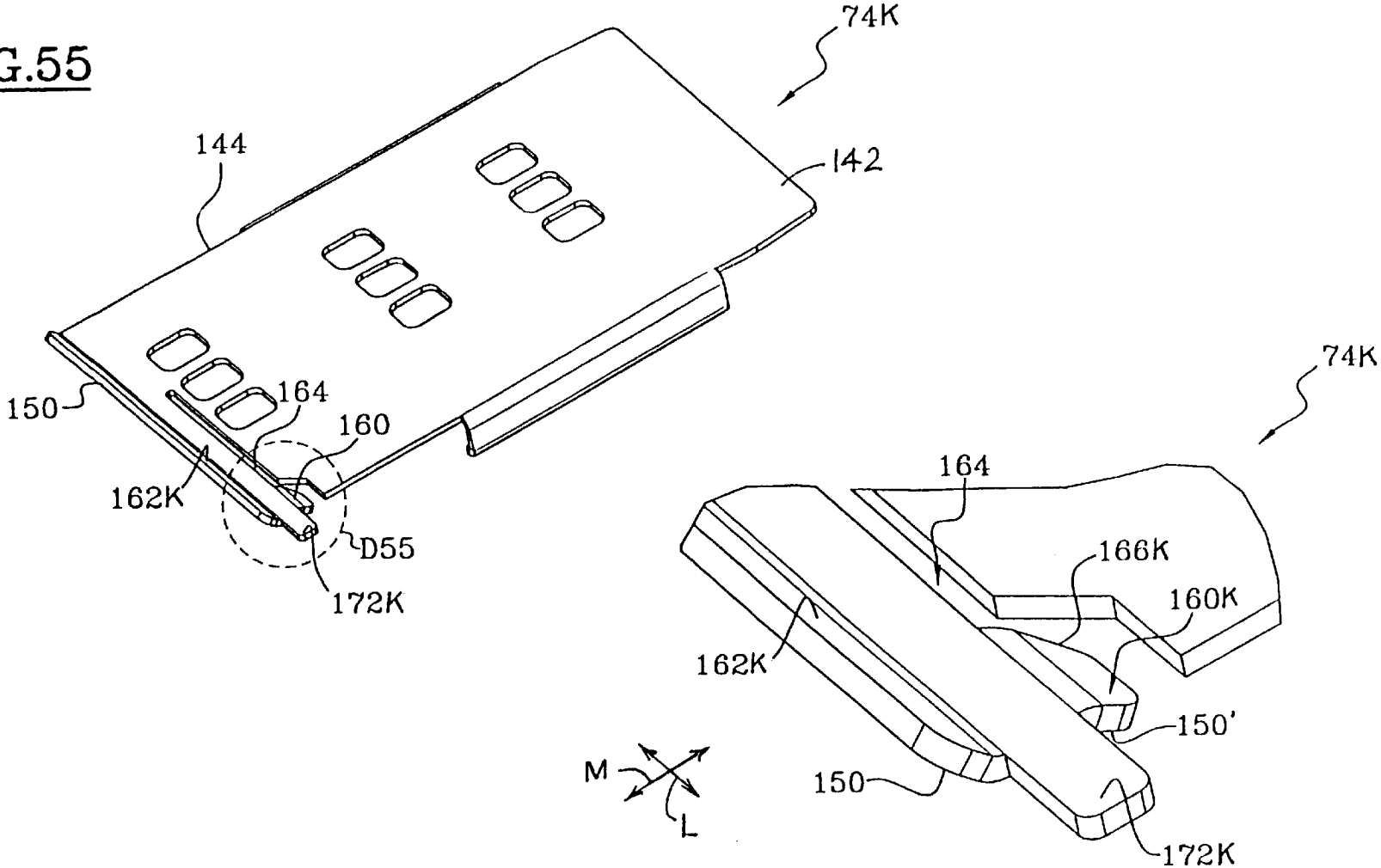

FIGS. 53–56 show a connector 70K of a tenth embodiment of the invention with a support 72K and cover 74K, with a modified card retainer 304K. As shown in FIGS. 55 and 56, the card retainer has a laterally L extending carrier arm 162K, the lateral direction being perpendicular to the longitudinal direction M in which the card slides into and out of the card-receiving cavity. FIG. 56 shows that the carrier arm has a downwardly-inclined part 160K that forms a retaining lip 166K that engages the polarized corner of the card. The free end 172K of the arm forms a tab that is lifted to release the card. A front edge of the arm forms a lead-in at 150.

Figures 57, 58:
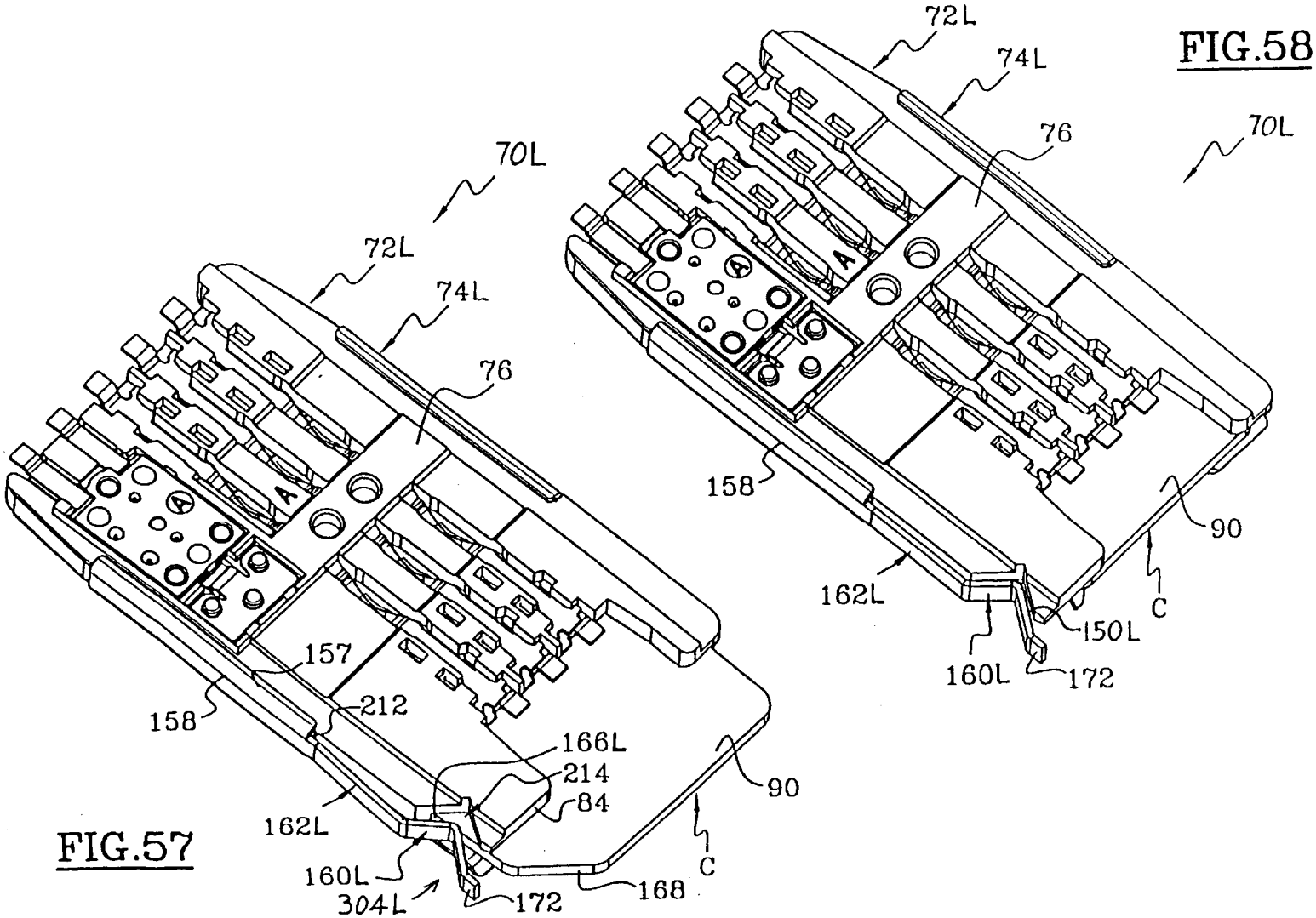
FIG. 57 is a bottom and front isometric view of the connector of an eleventh embodiment of the invention, in which the carrier arm has a lateral bend that forms a stop lip, showing the card partially inserted.
FIG. 58 is a view similar to that of FIG. 57, with the card fully inserted.
Figure 59:
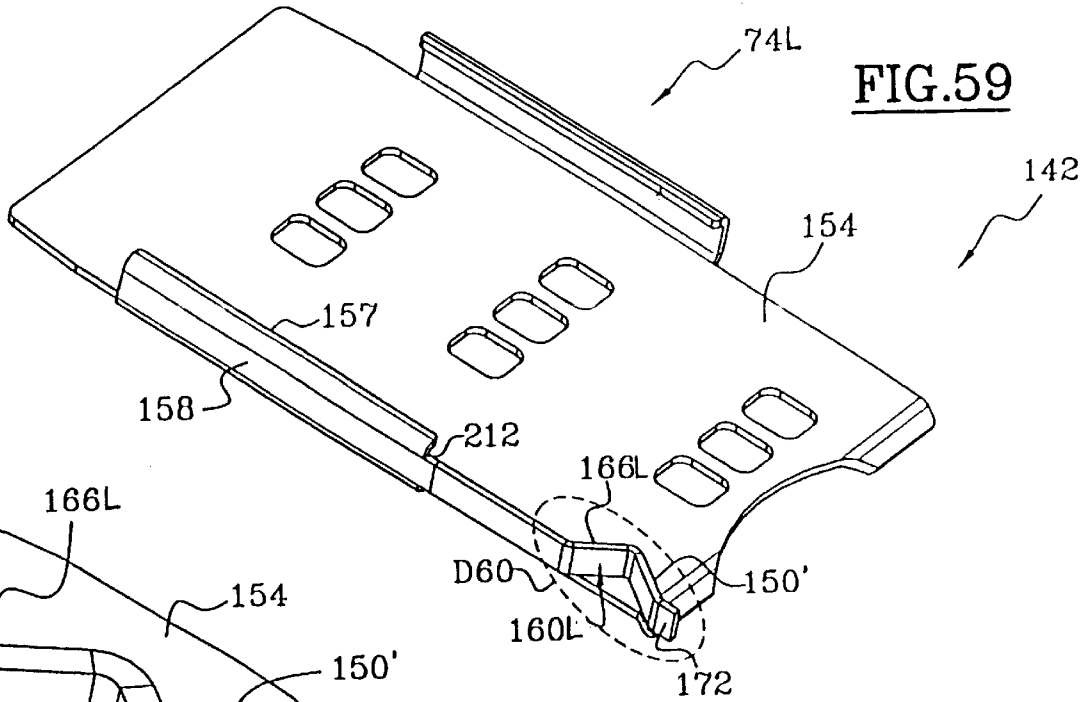
FIG. 59 is a bottom and front isometric view of the cover of the connector of FIG. 57.
Figure 60:
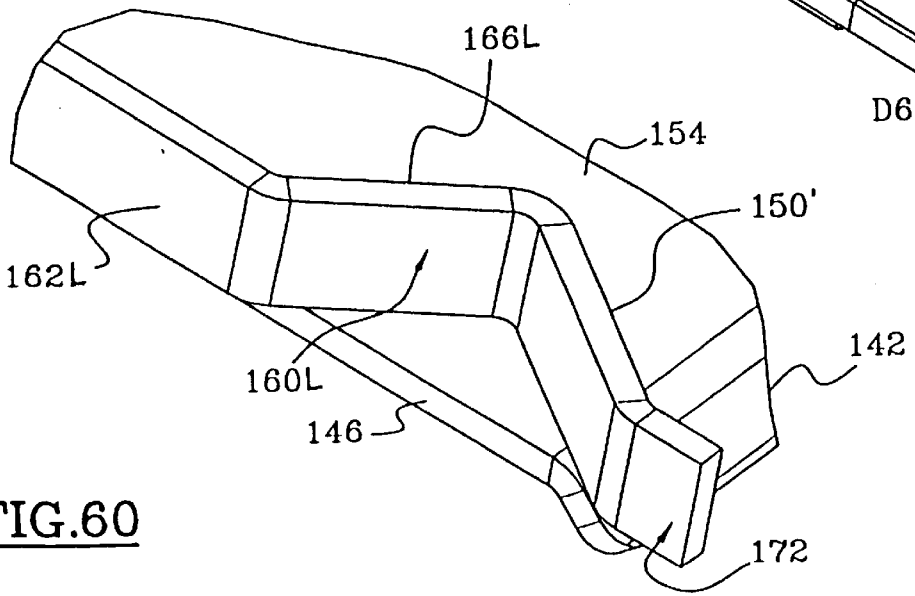
FIG. 60 is an enlarged view of detail D60 of FIG. 59.
Figure 61:
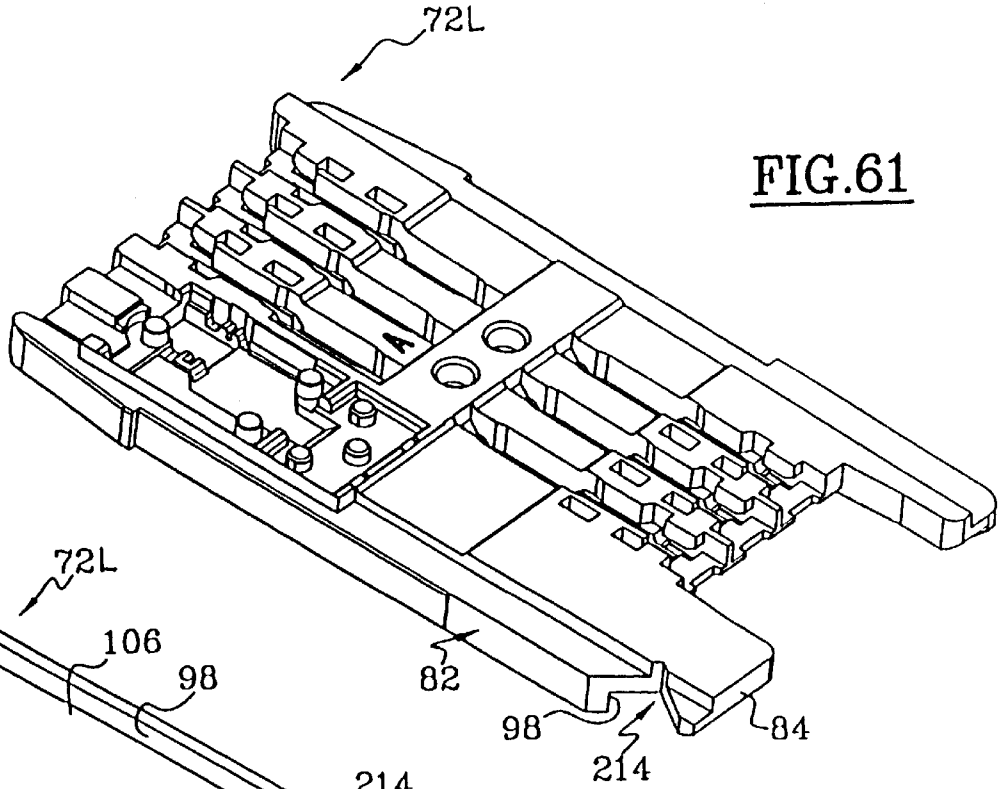
FIG. 61 is a bottom and front isometric view of the support of the connector of FIG. 57.
Figure 62:
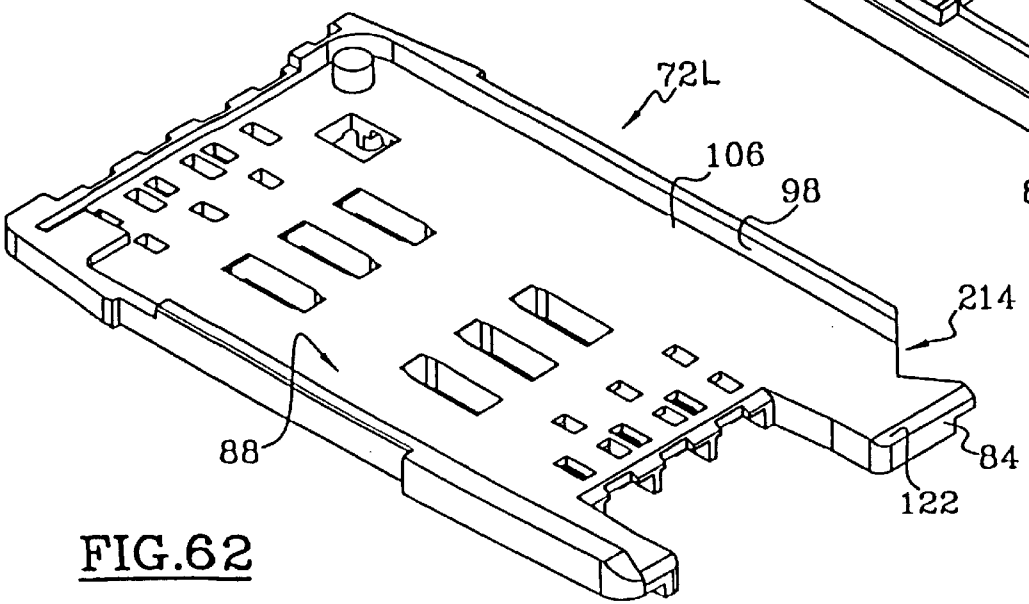
FIG. 62 is a top and front isometric view of the support of the connector of FIG. 57.
Figure 63A:
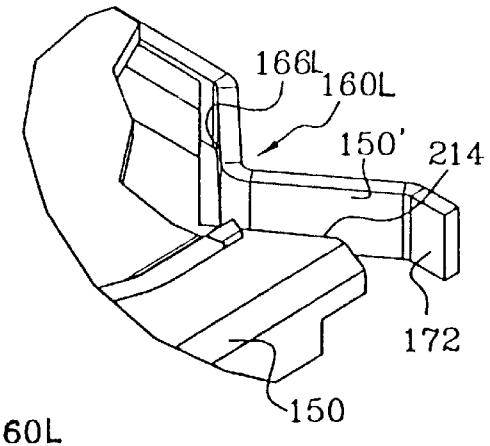
FIG. 63A is an enlarged view of area D63A of FIG. 63.
Figure 63:
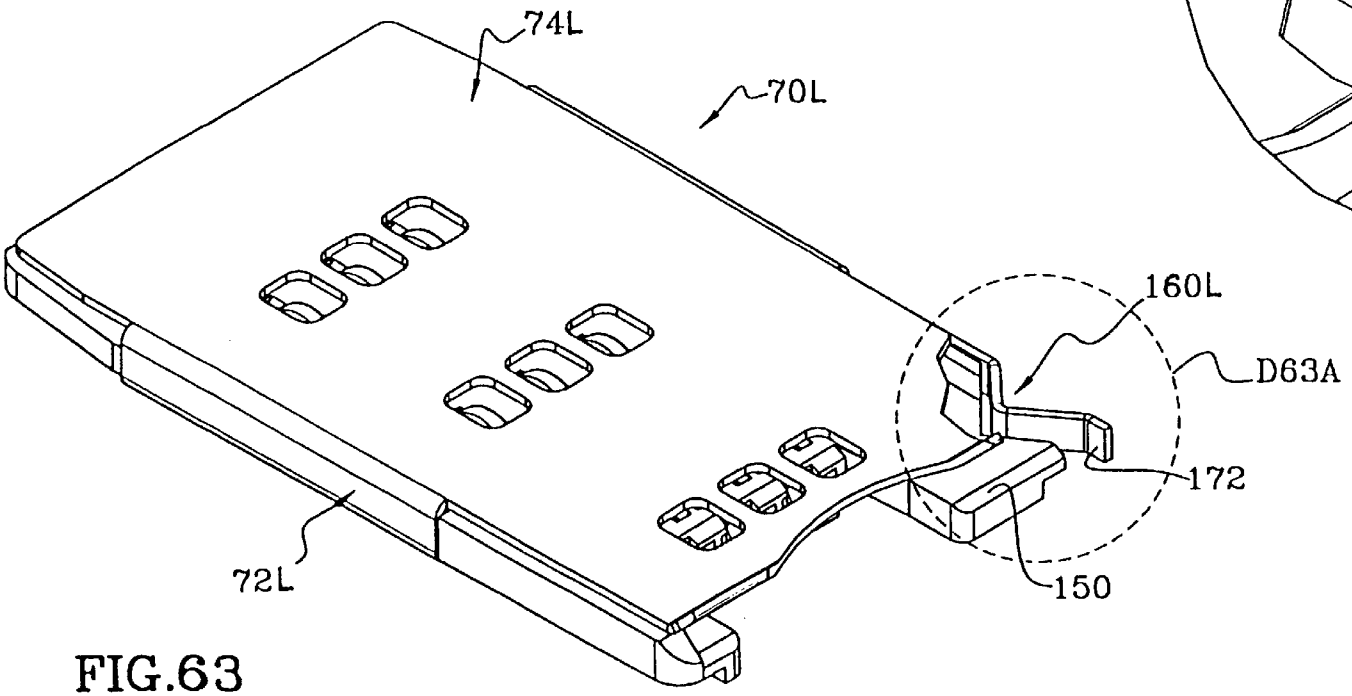
FIG. 63 is a top and front isometric view of the connector of FIG. 57, shown without a card.
Figure 65:
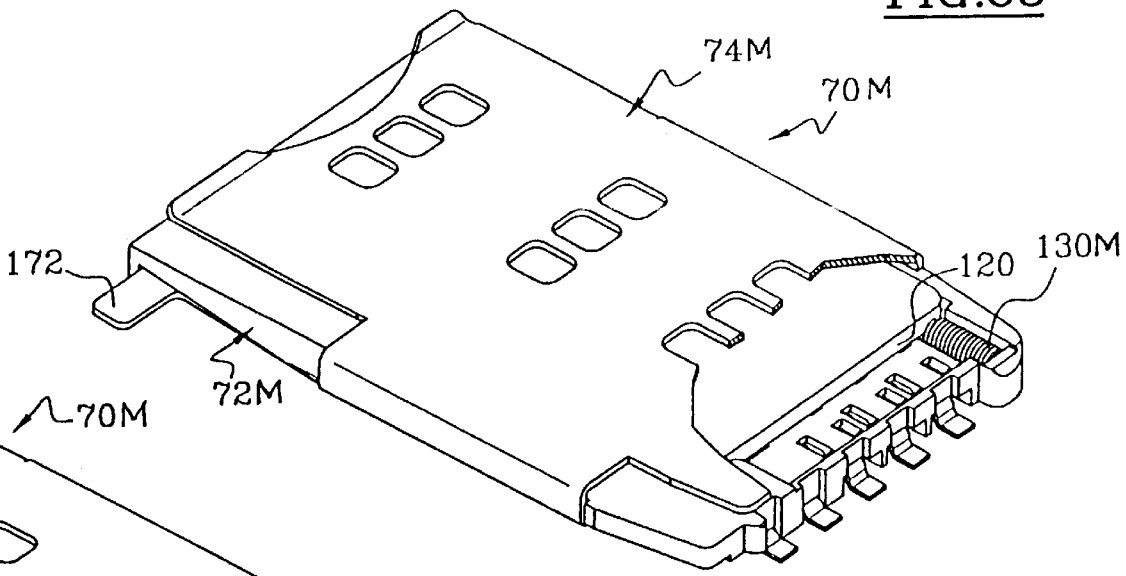
FIG. 65 is a view similar to that of FIG. 64, with a card fully installed.

FIGS. 57–63 illustrate a connector 70L of an eleventh embodiment of the invention with a support 72L and cover 74L, and with a card retainer 304L of different design. As shown in FIG. 57, the card retainer includes a carrier arm 162L with a V-shaped part 214 that projects into the path of the card during its insertion. Insertion of the card causes automatic deflection of the part 214 out of the path of the card. However, when the card is fully inserted, as in FIG. 58, the retainer lip 160L abuts the polarized corner of the card and presses with sufficient force to prevent forward movement of the card out of the cavity as a result of spring force. However, the tab 172 formed at the end of the carrier arm can be defected sidewardly to release the card so a spring pushes it forwardly and partially out of the cavity. The carrier arm 162L extends from a vertical edge 158 of the sheet metal cover, which is connected through a 90° bend to the top plate of the cover. FIG. 61 shows that the molded plastic support 72L is provided with a cutout at 214 to receive the V-shaped part of the carrier arm.

Figure 64:
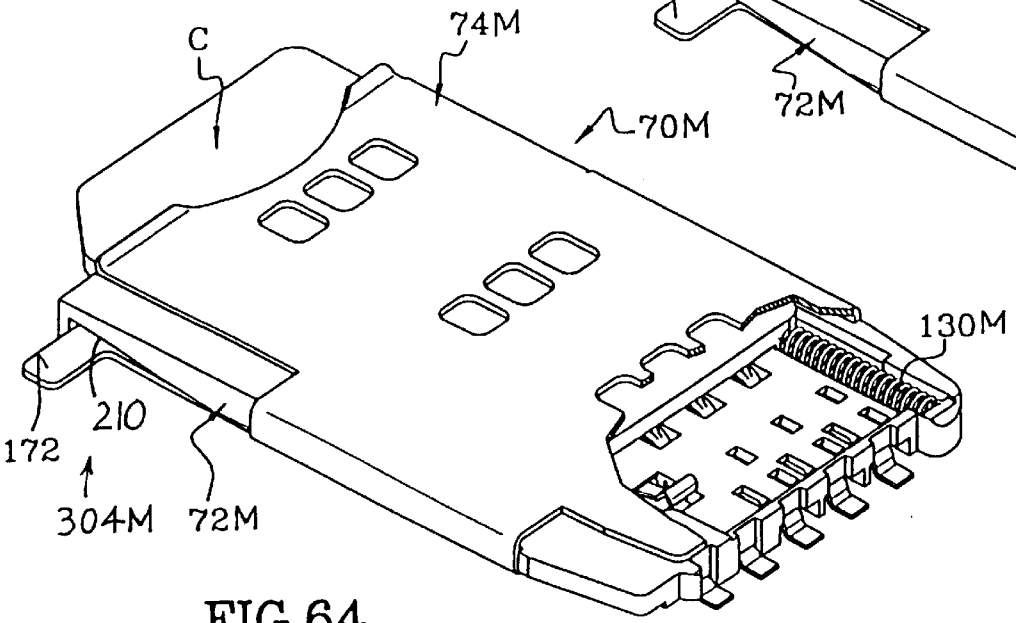
FIG. 64 is a top and rear isometric view of a connector of a twelfth embodiment of the invention, with a rear portion of the cover being cut away to show the spring, with a card shown partially installed.
Figures 66, 67:
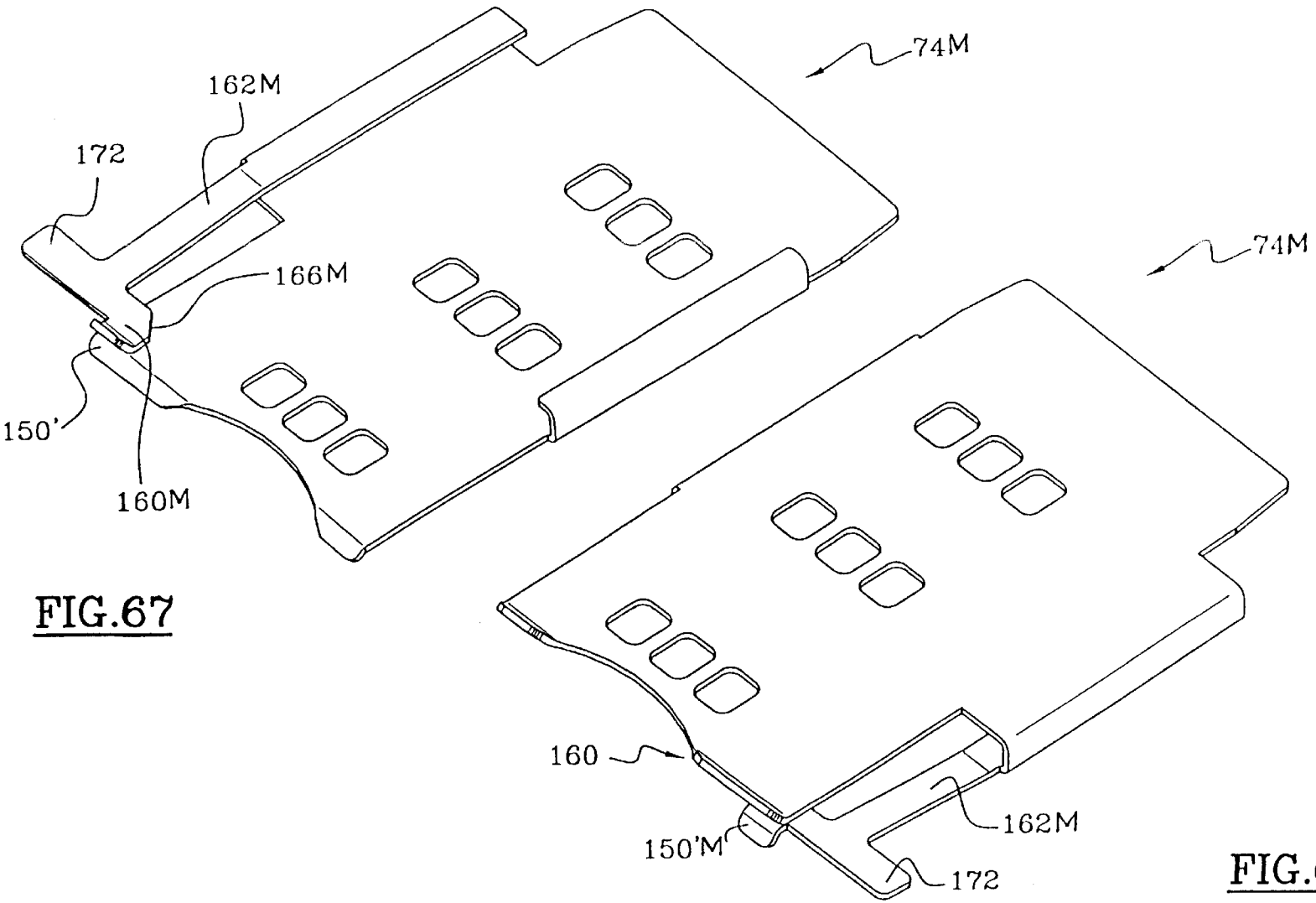
FIG. 66 is a front and top isometric view of the cover of the connector of FIG. 64.
FIG. 67 is a bottom and front isometric view of the cover of the connector of FIG. 64.
Figure 68:
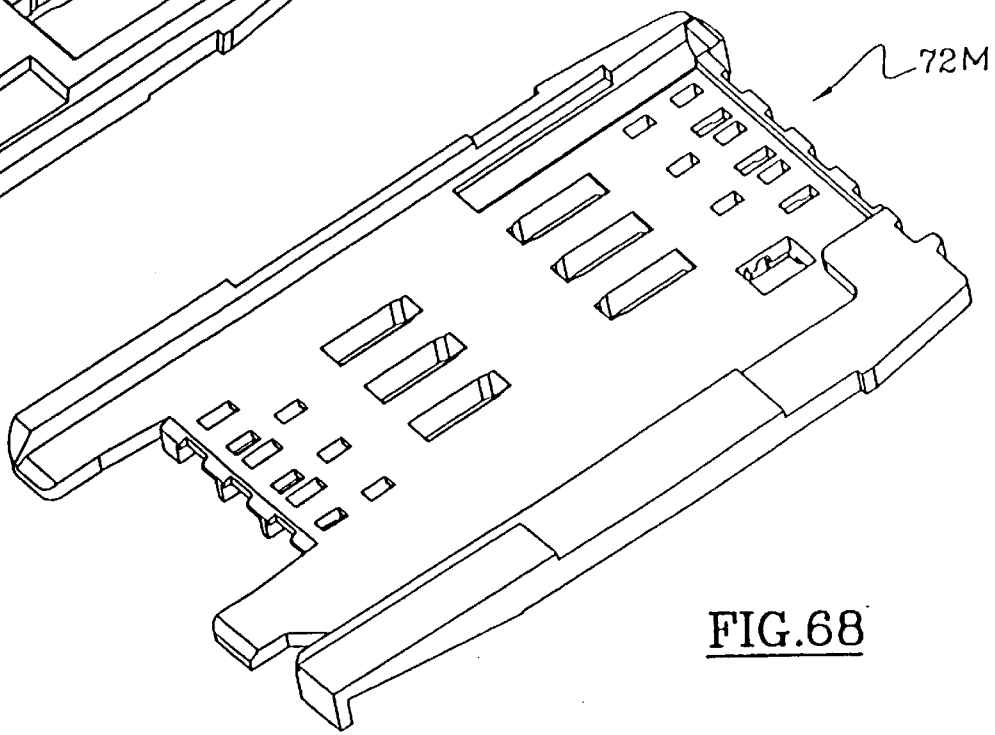
FIGS. 68 and 69 are front isometric views of only the support of the connector of FIG. 64.
Figure 69:
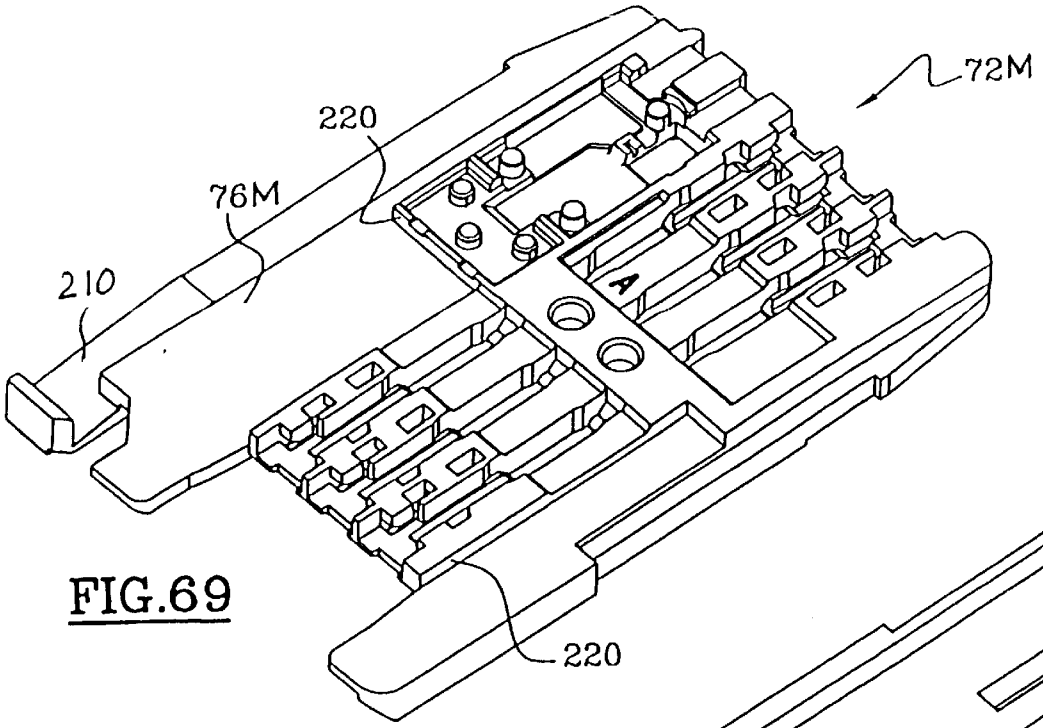
Figure 70:
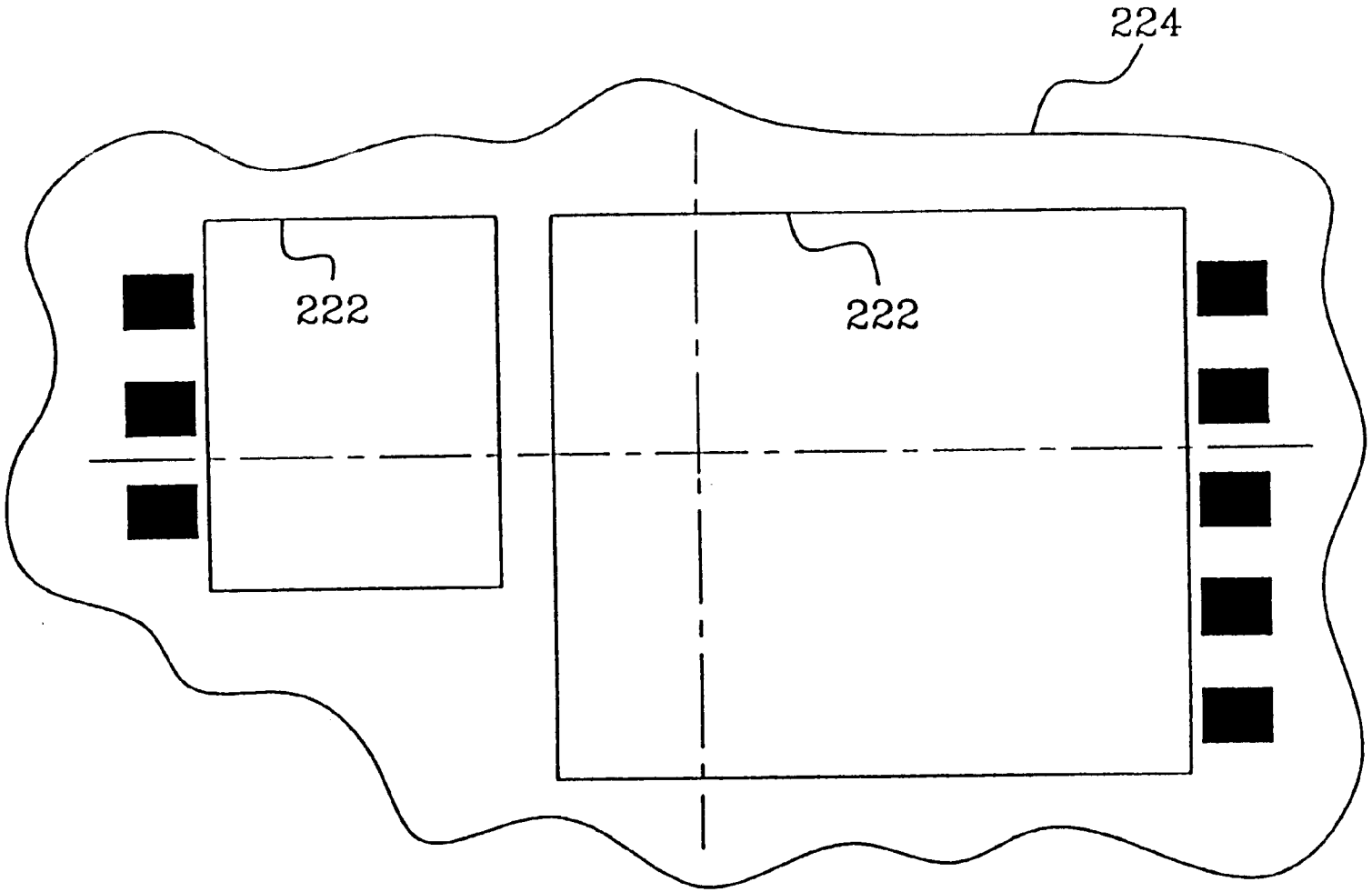
FIG. 70 is a diagram showing cutouts provided in a printed circuit board for mounting the connector illustrated in FIGS. 68 and 69.
Figures 71, 72:
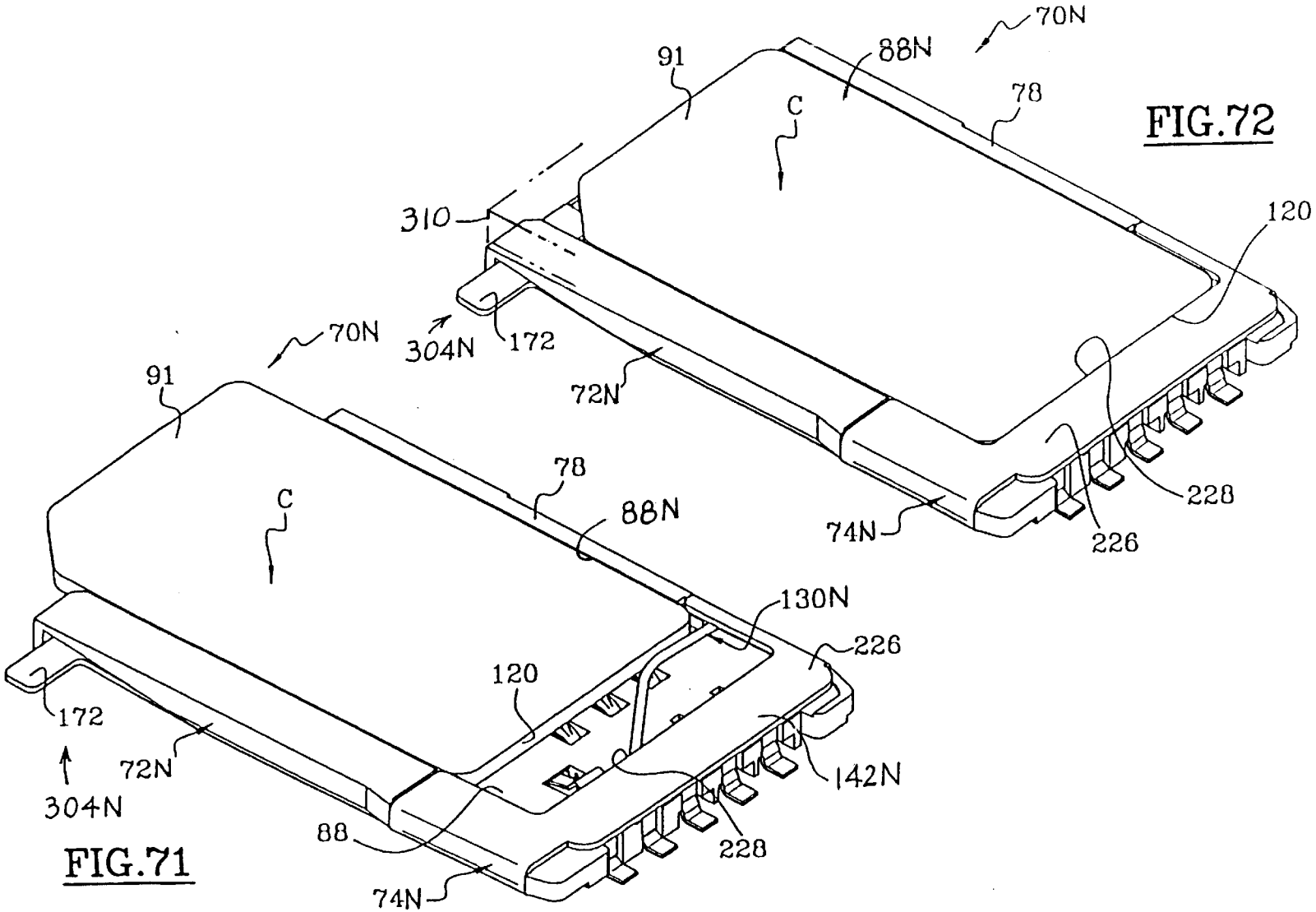
FIGS. 71–76 are views of a connecter of a thirteenth embodiment of the invention, wherein the height of the connector is reduced and the cover does not provide vertical retention of the card in the connector, with the views of FIGS. 71–76 being otherwise similar to the views of FIGS. 64–69.

FIGS. 64–70 illustrate a connector 70M of a twelfth embodiment of the invention with a support 72M and cover 74M, wherein the card retainer 304M is constructed so downward depression of a release tab 172 releases the card so it is pushed forward out of the card-receiving cavity by a spring 130M. As shown in FIGS. 66 and 67, the carrier arm 162M lies largely in a plane that is parallel to the top plate of the cover 74M but is spaced downwardly from it and connected by a vertical side wall of the cover. However, a lip edge 166M is not formed by a bent over part, but lies in the same plane as the carrier arm 162M. To do this, the support shown at 72M in FIG. 64 is provided with a cutout at 210 to allow the carrier arm to be upwardly biased to a position where the lip edge lies in the same plane as the fully installed card. FIG. 66 shows that the carrier arm has a lead-in 150'M that causes the carrier arm to be deflected downwardly as the card is installed. FIG. 69 shows that the support 72M has a downwardly-projecting block 220 that projects below the support lower surface 76M that lies on the circuit board. FIG. 70 shows that the circuit board 224 has recesses or holes at 222 to receive the projecting block.

Figures 73, 74:
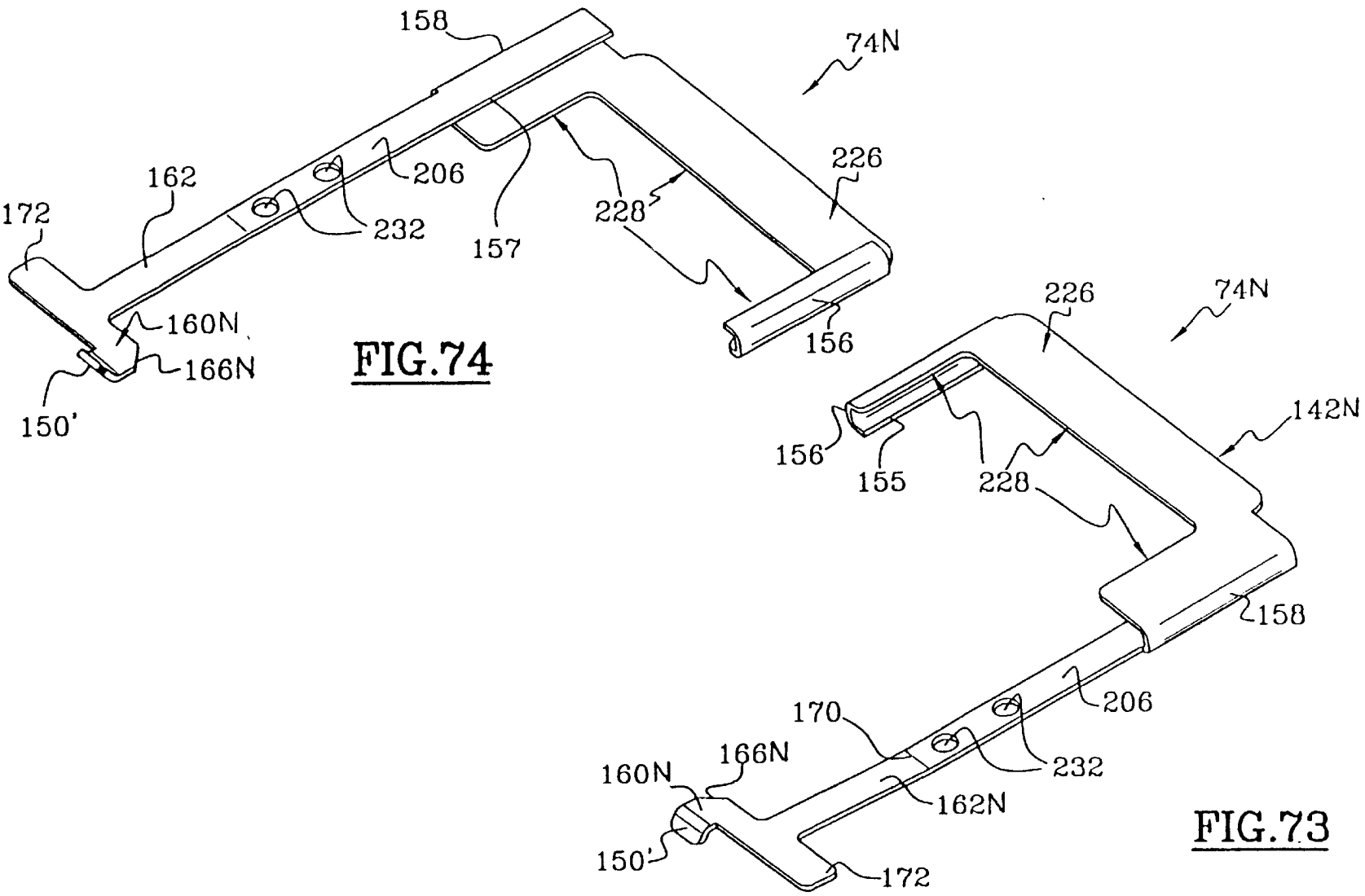
Figures 75, 76:
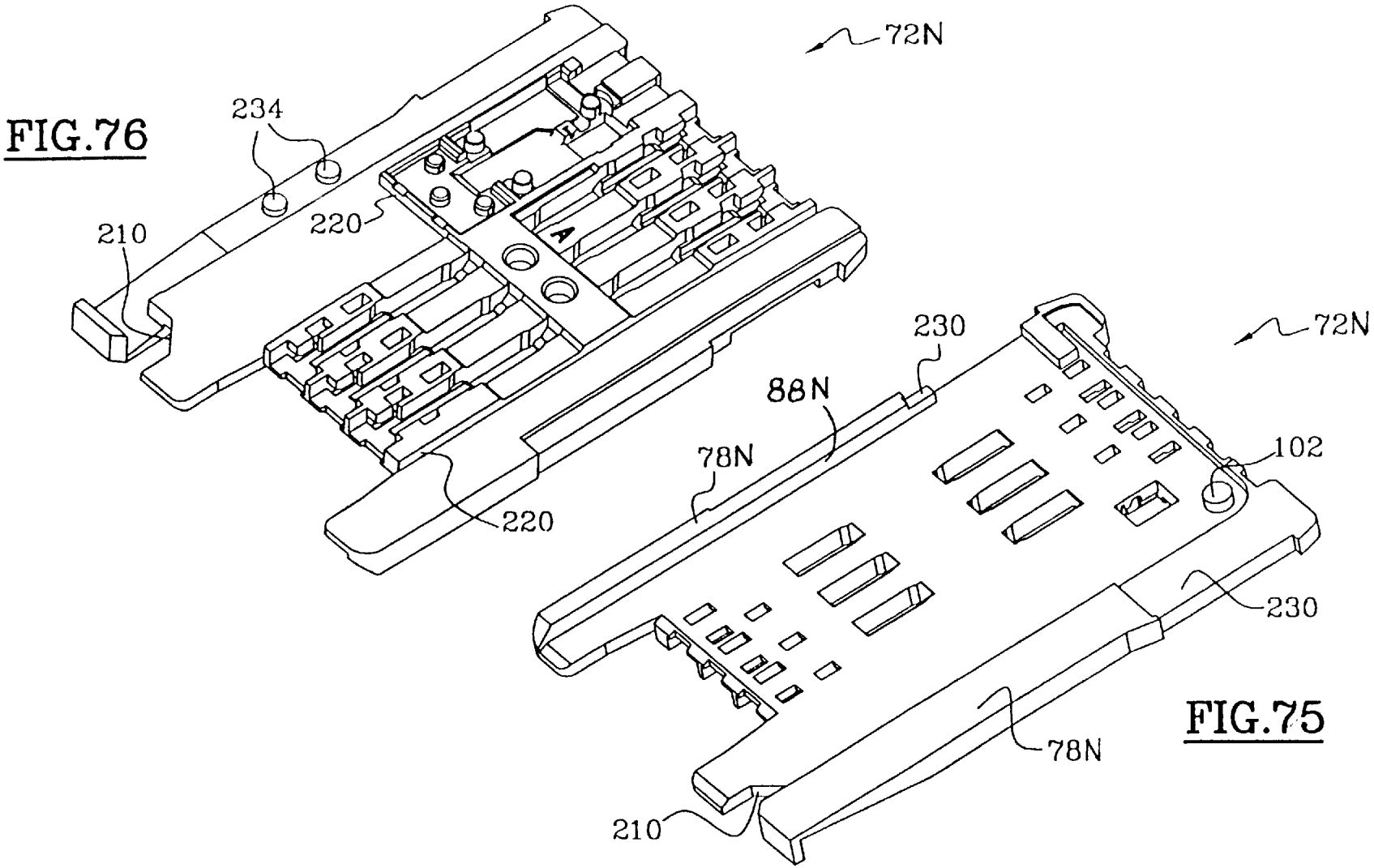
Figure 77:
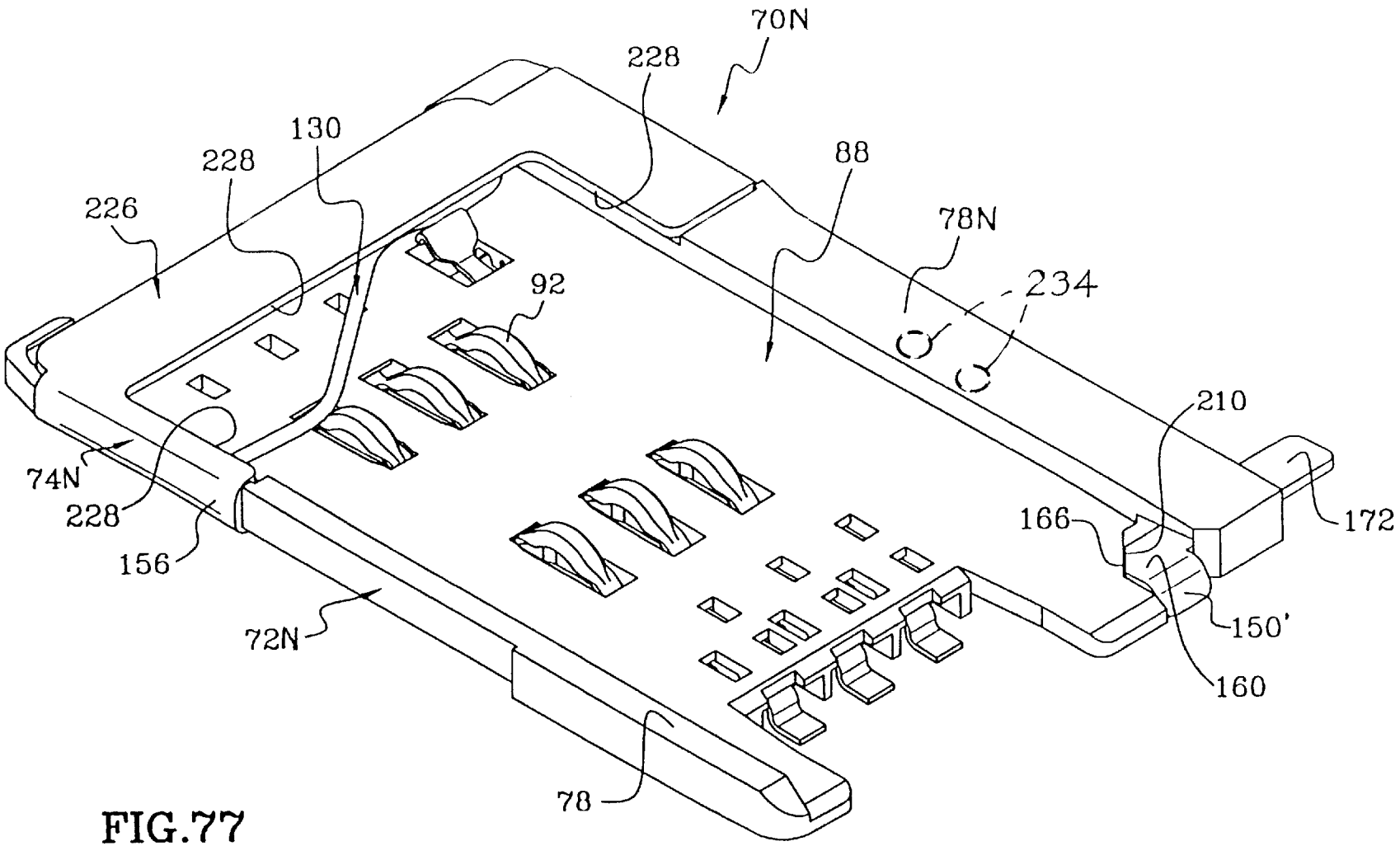
FIG. 77 is a front isometric view of the connector of FIG. 71, without a card.

FIGS. 71–77 illustrate a thirteenth embodiment of the invention, wherein the cover 74N which lies on top of the support 72N, does not cover the card-receiving cavity 88N. Instead, the connector 70N is installed on a case, indicated at 310 (FIG. 72), that forms a top for the card-holding cavity 88N to hold down the card. Otherwise, the sheet metal cover 74N forms the card retainer 304N which is similar to that of FIG. 67, and provides a stud 102 (FIG. 75) to hold down a spring. The cover can also form a sheet metal spring portion. FIG. 73 shows the shape of the cover 74N alone, showing that it has holes 232 that can receive posts 234 (FIG. 76) on the support 72N, to fix the cover to the support. The posts may be hot crimped after insertion downward through the holes 232.

Figures 78, 79:
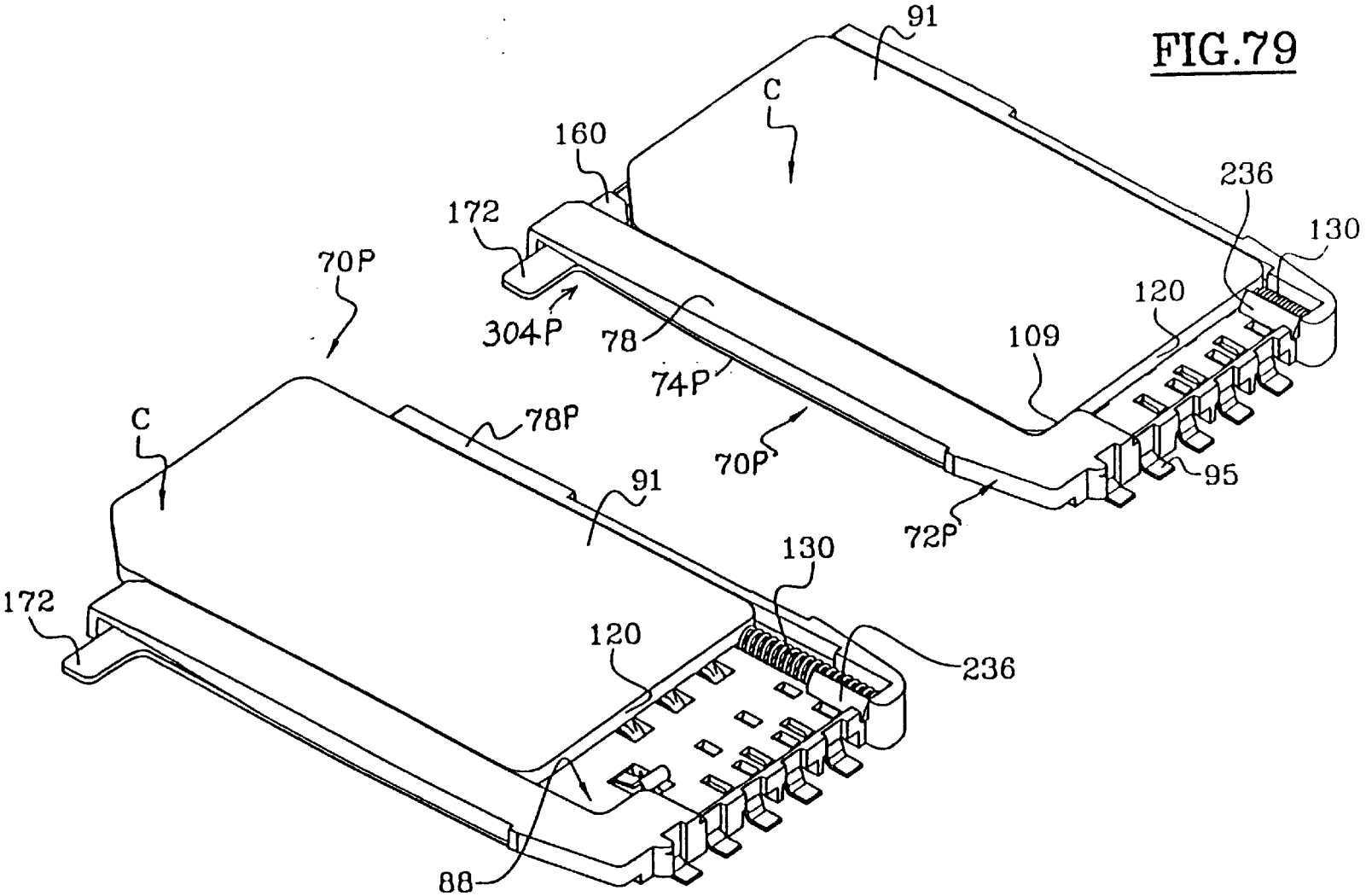
FIGS. 78–83 illustrate a fourteenth embodiment of the invention which is similar to the thirteenth embodiment of FIGS. 71–77 in that the cover does not provide vertical retention of the card.
Figures 80, 81:
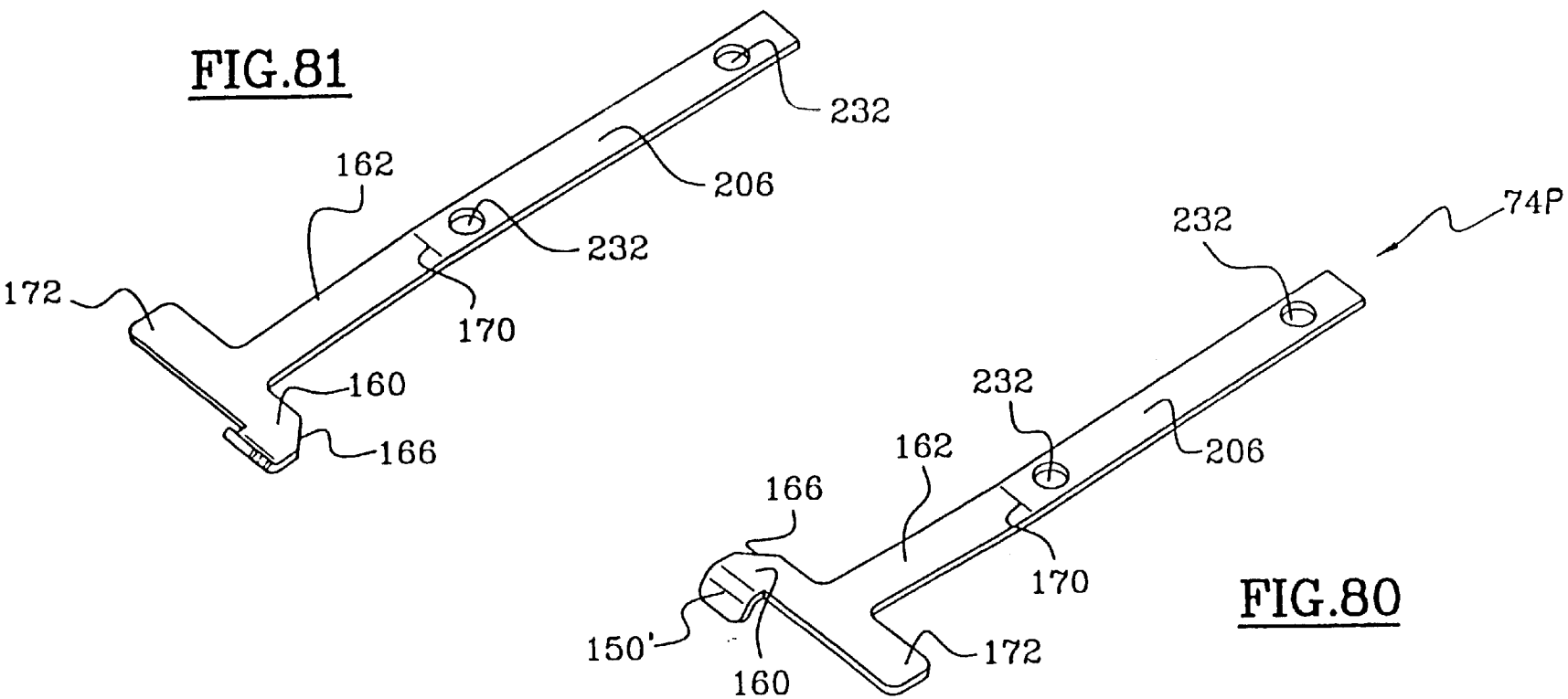
Figures 82, 83:
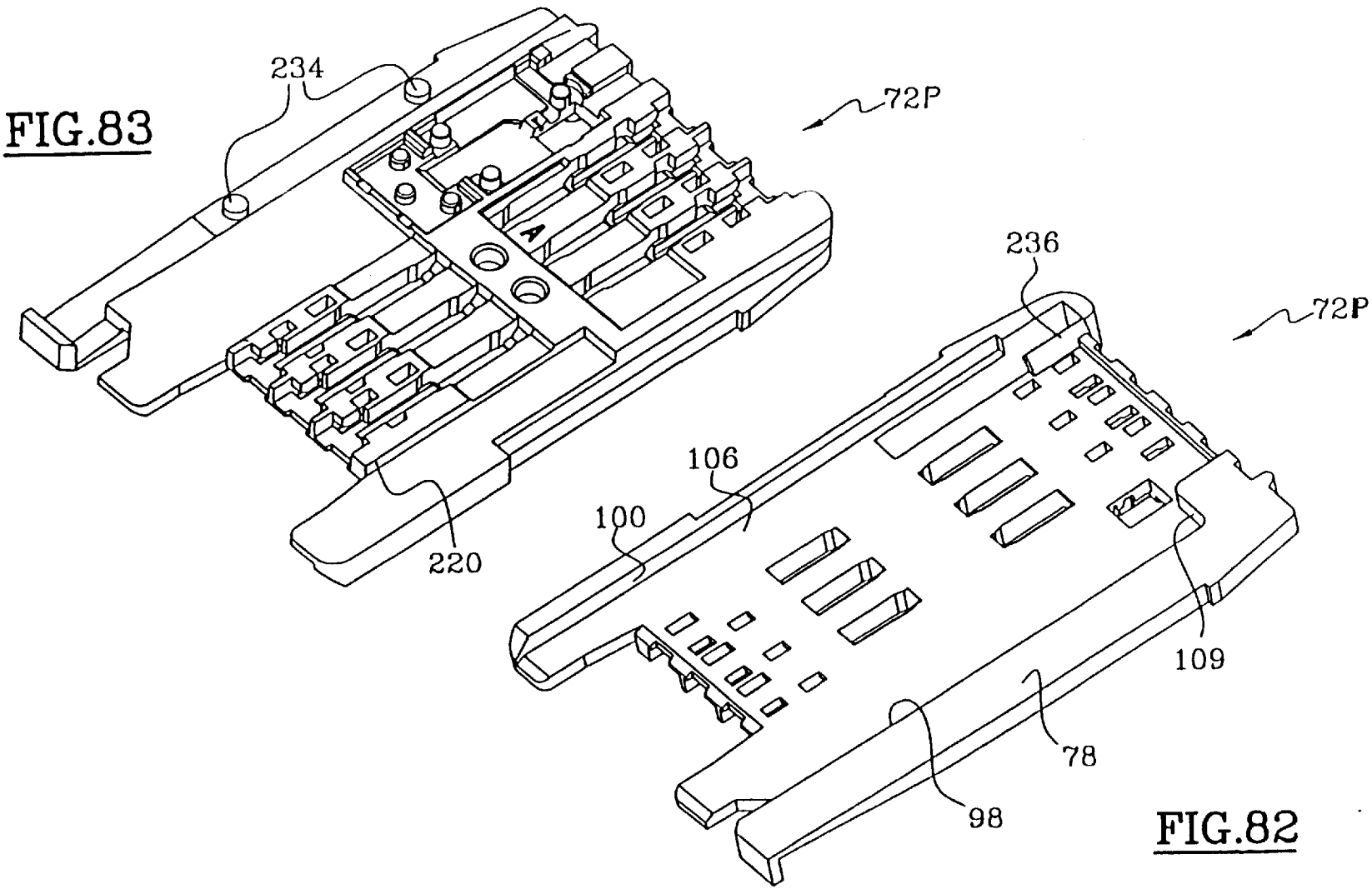

FIGS. 78–83 show a connector 70P of a fourteenth embodiment of the invention with a support 72P, where a cover-like part 74P serves only to form the card retainer 304P. FIG. 80 shows the shape of the cover part 74P.

Figure 87:
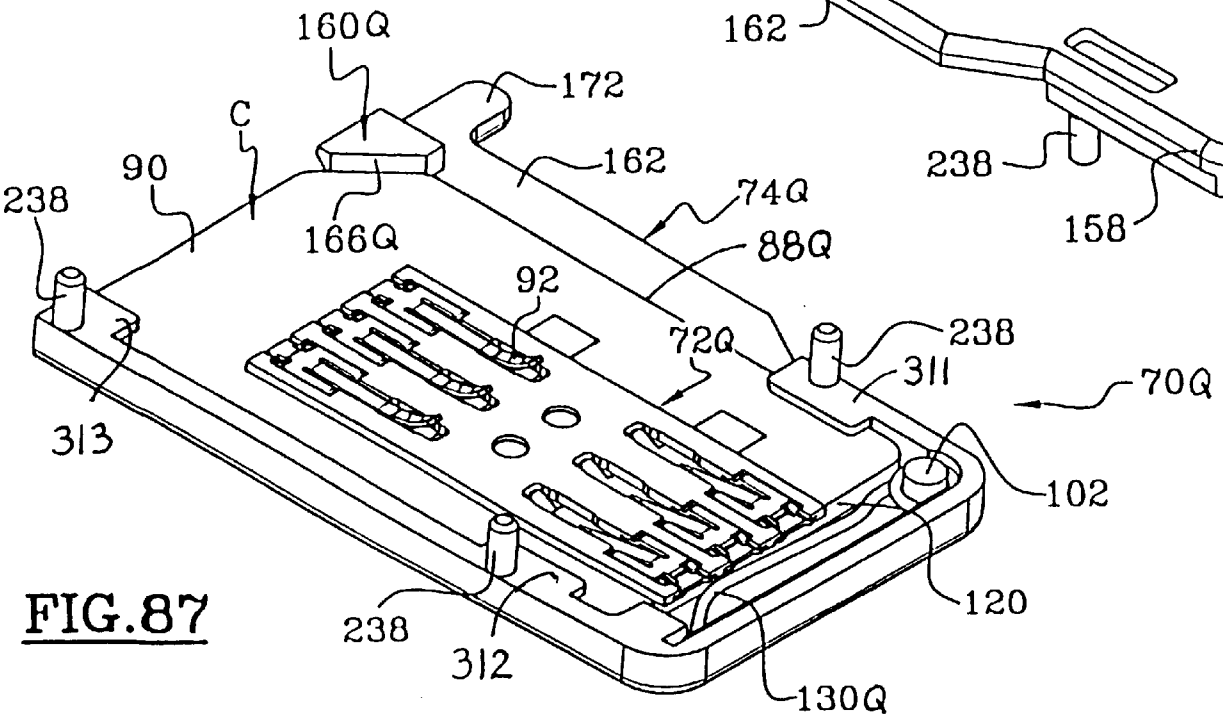
FIG. 87 is an upside-down view showing the bottom of the connecter of FIG. 86.
Figure 88:
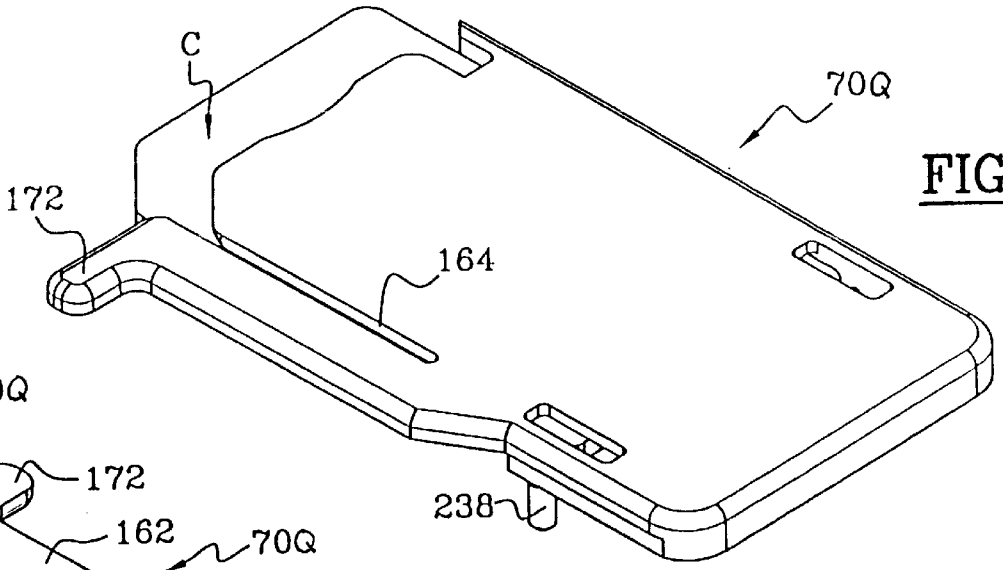
FIGS. 88 and 89 are views similar to FIGS. 86 and 87, respectively, but with the card in the process of being ejected.
Figure 91:
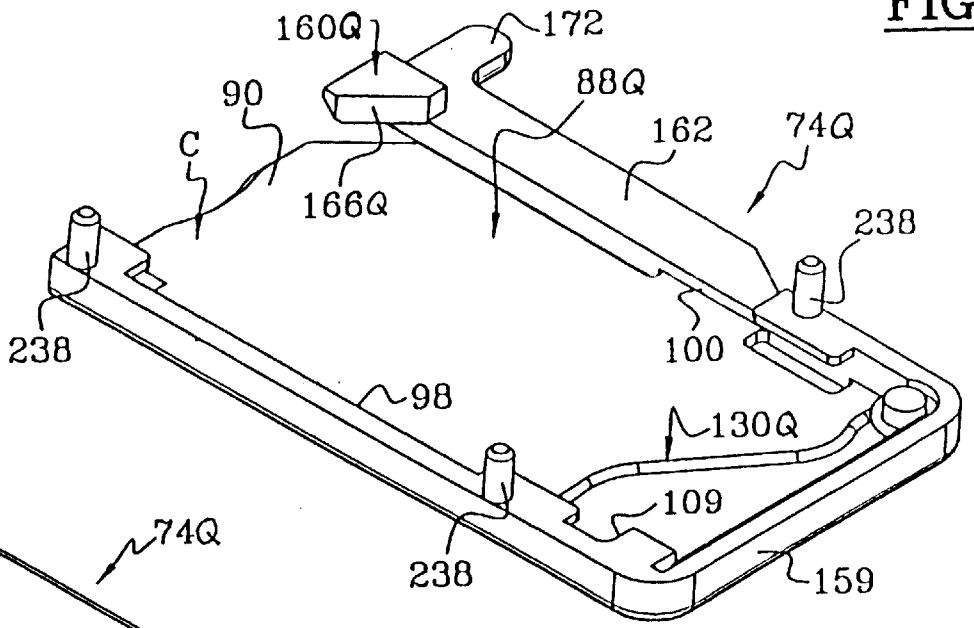
FIGS. 90 and 91 are similar to FIGS. 88 and 89, but without the contact-carrying insulating support.
Figure 92:
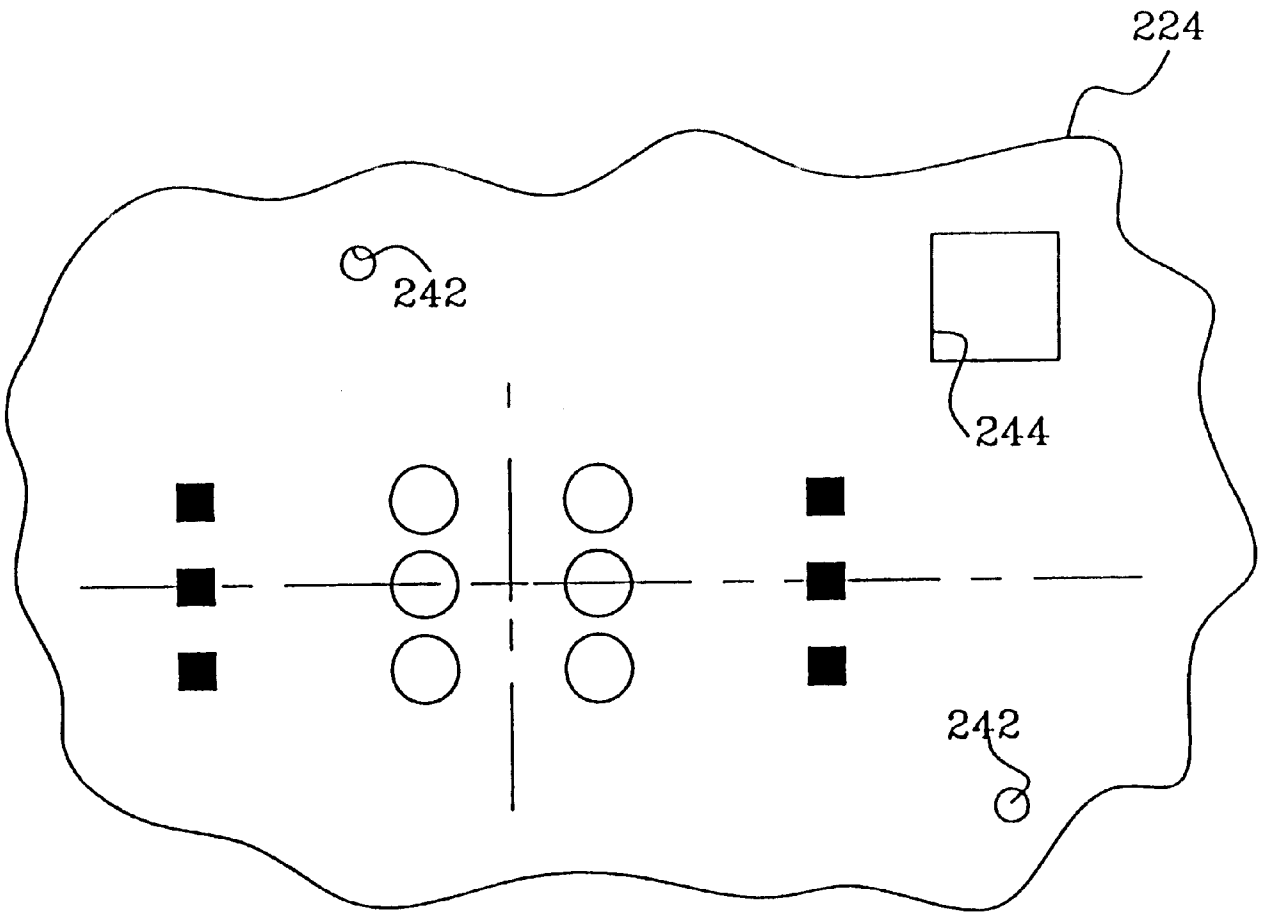
FIG. 92 is a diagram showing how the connector of FIGS. 84–91 is placed on a circuit board.
Figures 93, 94:
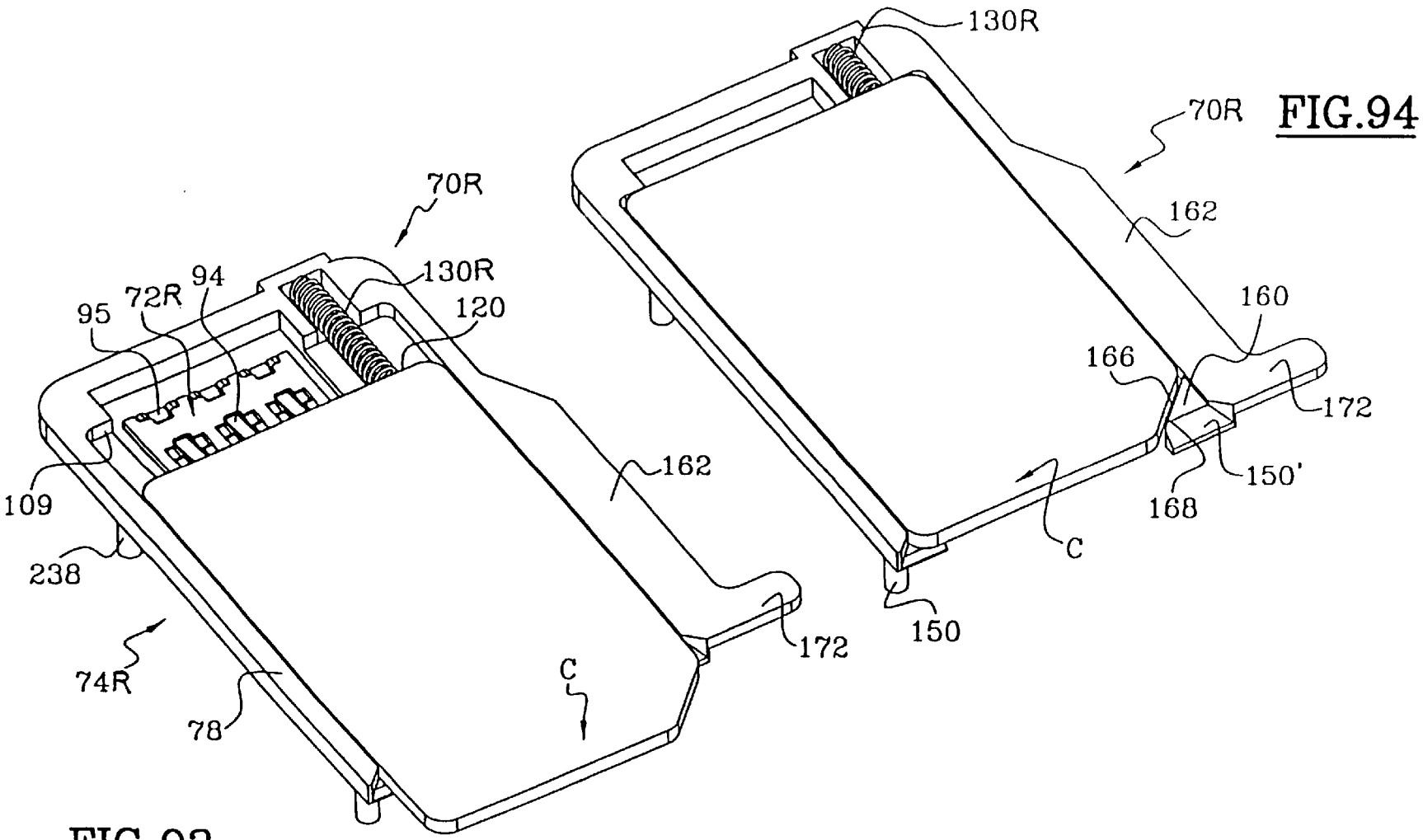
FIGS. 93–100 illustrate a sixteenth embodiment of the invention, where the cover does not vertically retain the card in the connector, the views of FIGS. 93–100 being otherwise similar to the views of FIGS. 84–91.
Figures 95, 96:
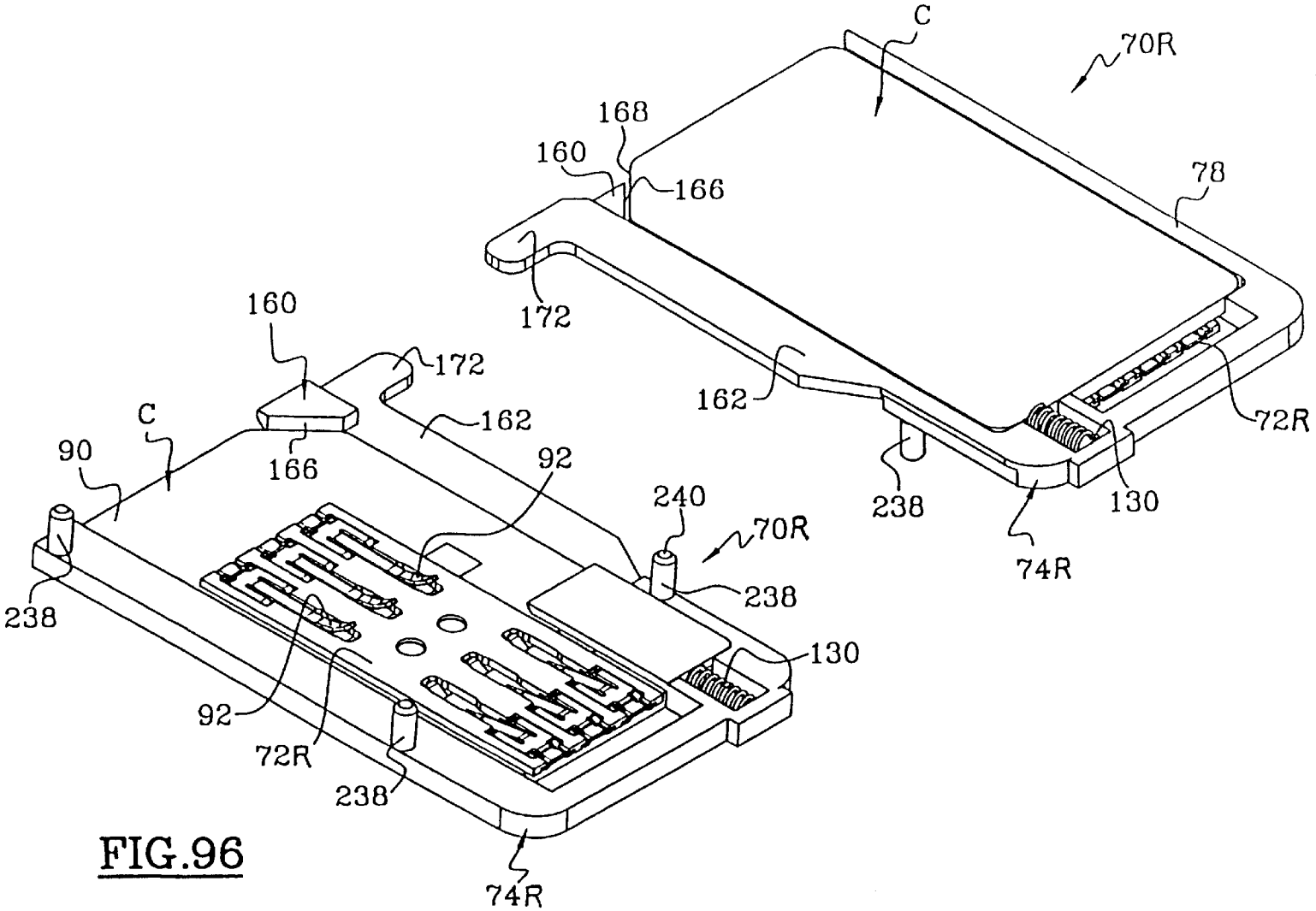
Figure 97:
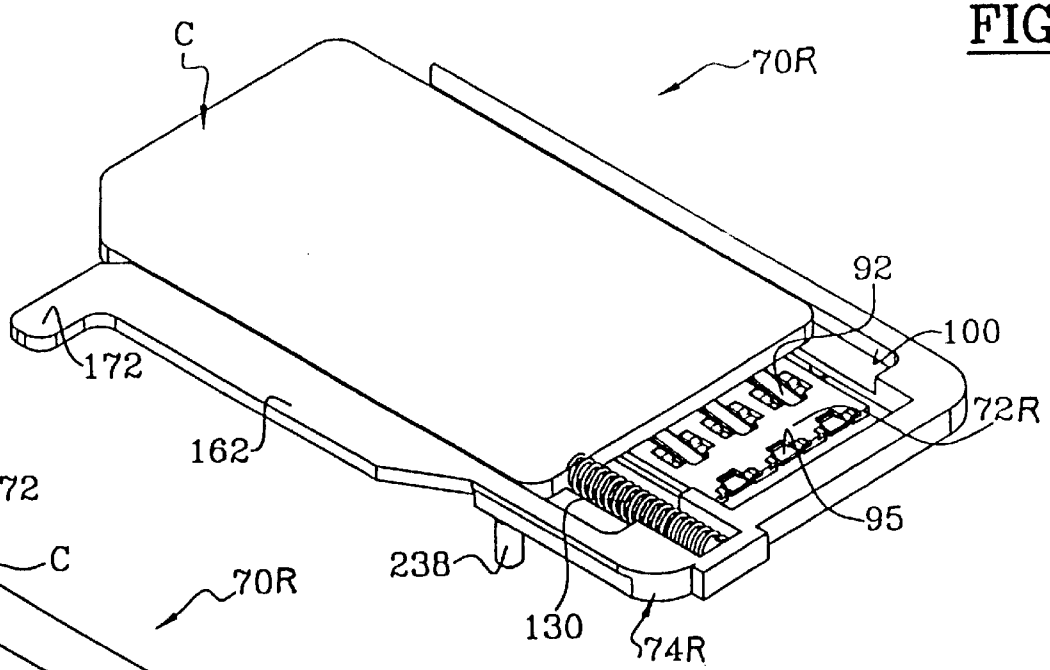
Figure 98:
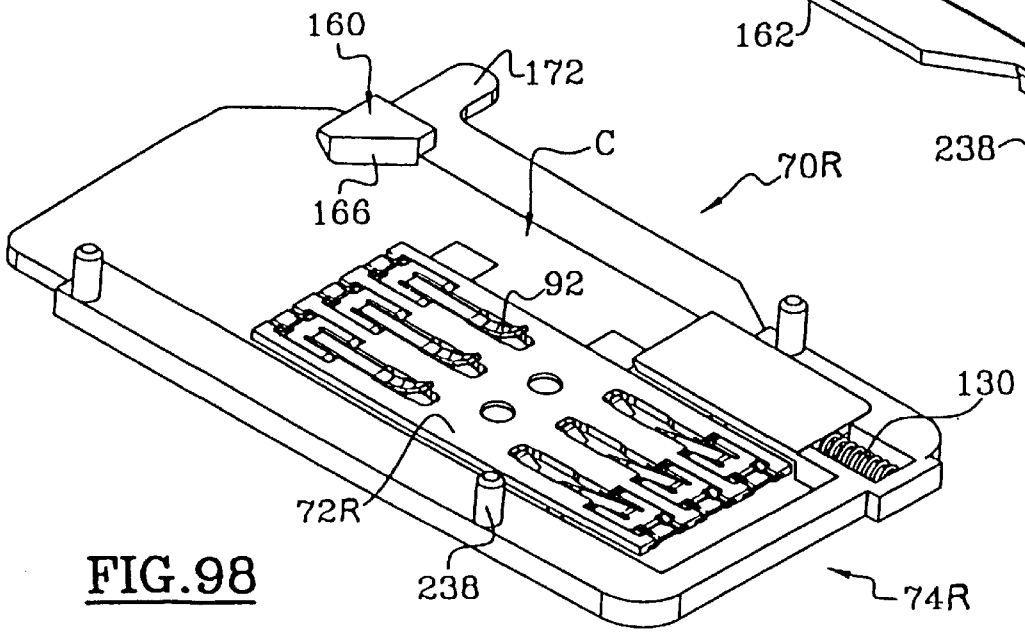

FIGS. 84–92 show a connector 70Q of a fifteenth embodiment of the invention, wherein a single molded plastic part 74Q forms all of the walls of the card-holding cavity 88Q, as well as the card retainer 304Q. As shown in FIG. 87, the molded plastic part 74Q has lower cavity walls at 311–313 whose upper surfaces hold the card C in place. A separate plate-shaped molded plastic part 72Q holds the contacts 92. Due to the limited resilience and strength of molded plastic material, a separate spring 130Q is used to press the card out of the cavity. FIG. 91 shows the molded part 74Q in an upside down position and without the card in the cavity 88Q. FIG. 92 shows the pattern of holes 242, 244 in a circuit board 224 on which the connector is mounted.

Figure 100:
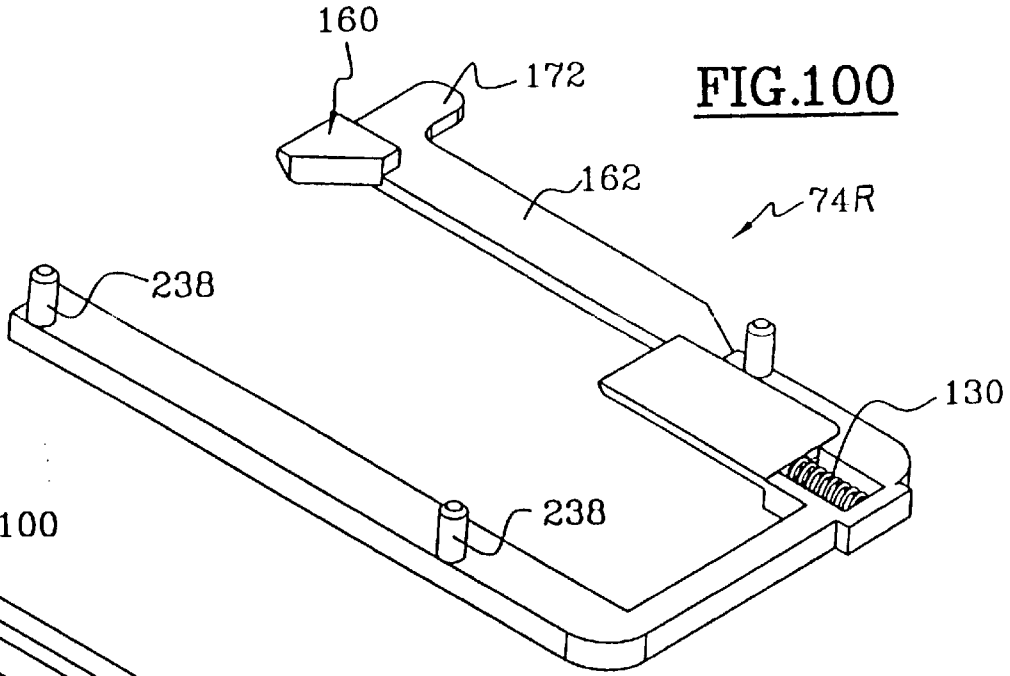
Figure 99:
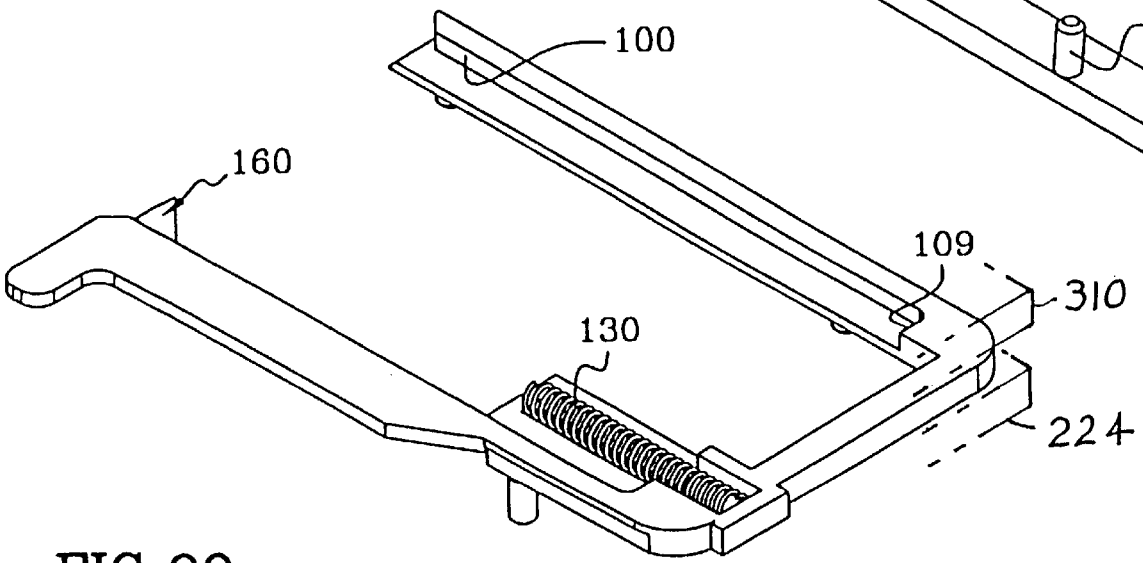

FIGS. 93–101 show a connector 70R of a sixteenth embodiment of the invention which is somewhat similar to the plastic molded part of FIGS. 84–92, except that it includes a molded plastic cover 74P that does not form a hold down plate at the top of the cavity. FIG. 100 shows the construction of the molded cover 74R. The connector is useful for mounting in a frame indicated at 310 and spaced above a circuit board 224, where the frame supplies a top hold down for the cavity.

Thus, the invention provides a compact connector for smart cards, which has a minimum number of parts and which provides a card retainer means for holding an inserted card in place and a spring means that urges the card out of the card-receiving cavity when the card retainer is released. In some connectors, the connector housing includes a molded plastic part and a bent sheet metal part. These parts can be produced at low cost in large quantities. The sheet metal part is useful to form a resiliently bendable carrier arm that forms a retention lip to hold the card in place, although such resiliently bendable carrier arm can be formed by a molded plastic portion of a plastic part. This spring can be formed by a separate spring such as a wire with a pair of legs or a helical coil, or can be formed by a portion of a sheet metal cover. The carrier arm can be formed to lie under the card-holding cavity, so release of the card is by downward deflection of a tab on the carrier arm. The connector housing can be formed without a top over the card-receiving cavity to hold down the card, but instead this function can be served by a frame on which the connector is installed.

II Detailed Description of the Invention

FIG. 1 shows a connector 70A that includes a molded plastic insulative support 72A and a metal cover 74A that is made of cut, folded and/or stamped sheet metal. The connector is designed to receive a smart card C with a MICROSIM type being illustrated.

Figure 6:
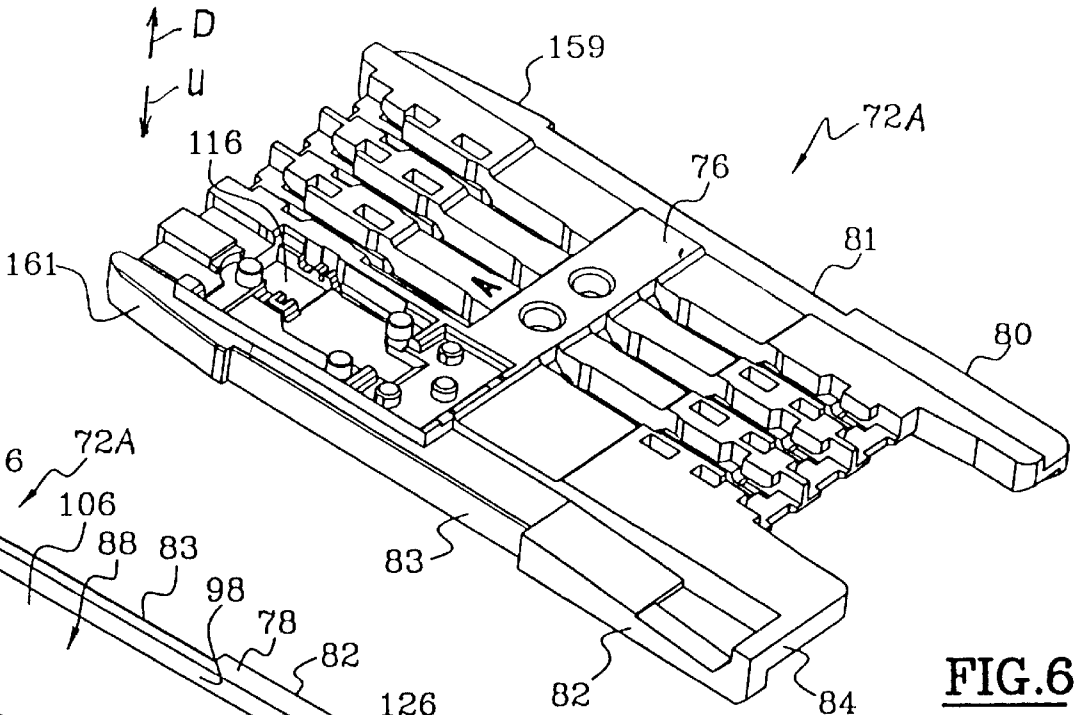
FIG. 6 is an upside-down isometric view of the support of FIG. 5.
Figure 5:
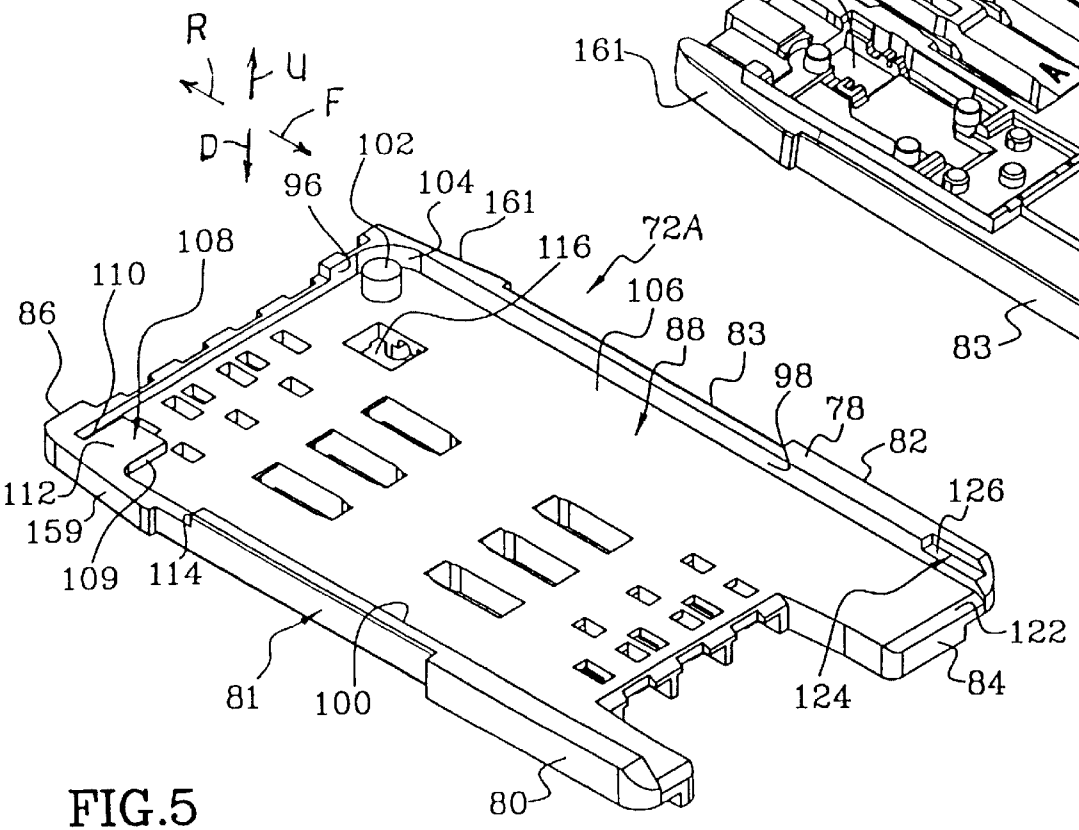
FIG. 5 is an isometric front and top view of the support of the connector of FIG. 1.
Figure 7:
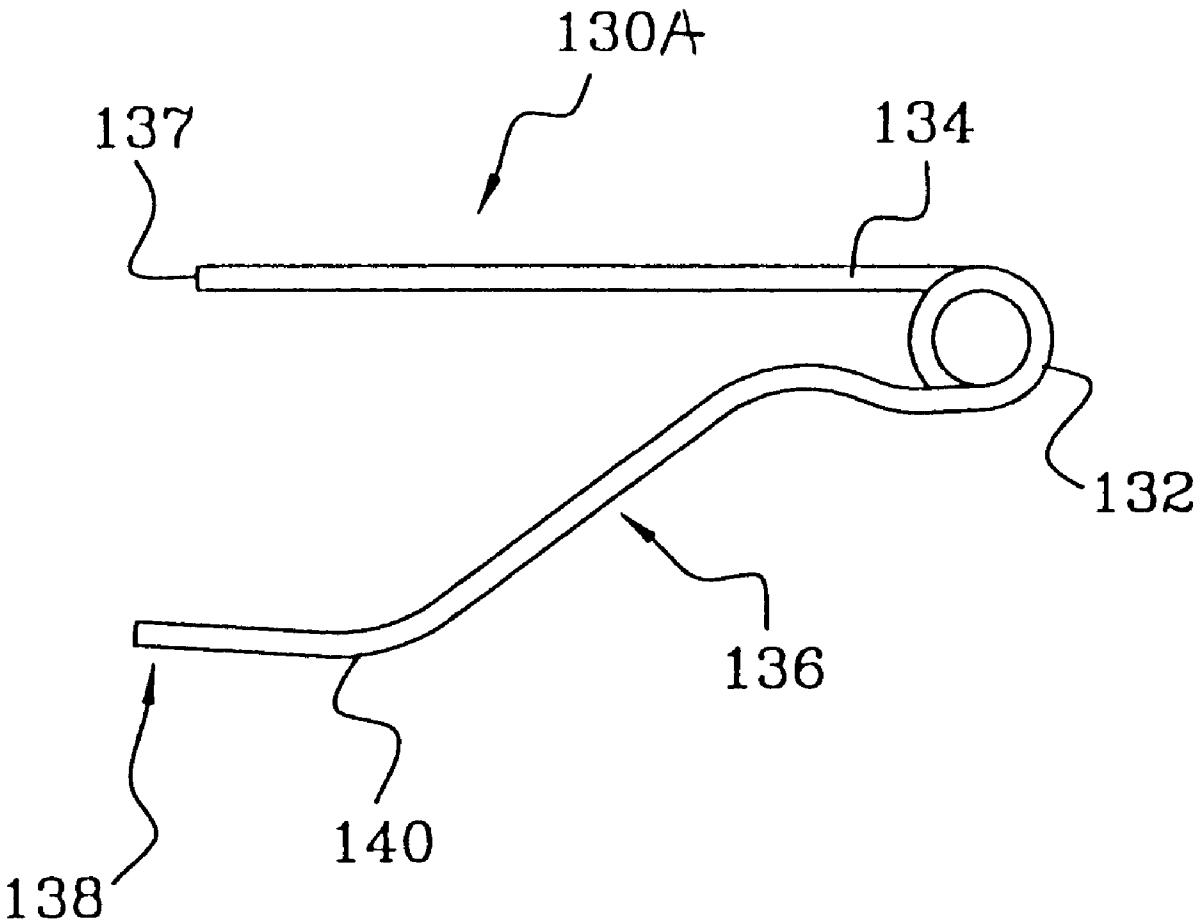
FIG. 7 is a plan view of the ejection spring of the connector of FIG. 1, in that the free state of the spring.

FIGS. 5 and 6 show that the molded plastic support 72A is of generally parallelepiped shape, with a largely planar lower face 76 and a largely planar upper face 78. The support has a pair of longitudinally-spaced edges 80, 82, a front transverse or laterally-extending edge 84, and a rear transverse edge 86. The upper face of the support forms the card-receiving cavity 88 which has a shape complementary to that of the card and which is intended to partially accommodate the card. The lower face 90 (FIG. 8) of the card has contact pads 304 that engage the pad-engaging ends 92 of the contacts when the card is fully inserted.

The base has a rear transverse edge 96, and the base is open at its front end. The card-receiving cavity 88 lies between opposite side edges 98, 100 which are laterally spaced by about the same distance as the width of the card so as to guide the card in sliding during its insertion and during pullout. A cylindrical stud 102 lies at a corner 104. The stud projects upward from an upper face 316 of a plate-like portion 320 of the support, on which the card lies. The pad-engaging ends 92 of the contacts project above the upper face 316 of the plate portion.

The molded plastic support forms a stop at 109 that limits rearward insertion of the card. The stop is formed at the front end of a projecting part 108 which, together with the transverse edge 96, forms the slot 110 that holds a rear leg 134 of the spring. As shown in FIG. 5, the upper surface 112 of the part 108 lies below the level of the upper face 78 of the support. FIG. 8 shows a switch actuator 118 for sensing full insertion of the card. The switch actuator lies in an opening 116 (FIG. 5) of the support.

As shown in FIG. 8, the connector has a spring means 130A in the form of a bent round metal wire with front and rear legs 136, 134 connected by a coil part 132. The coil part 132 extends around the stud 102, the coil preferably having about 1½ turns, although it could have more or even less than one turn. The rear leg 134 lies in a slot 110 formed in the support. The front leg 136 is bent so that a free end portion 138 extends primarily in a transverse or lateral L direction when not deflected rearwardly by a card. The free end portion 138 is joined to the rest of the front leg by a bend 140.

The front leg 136 lies in a plane which is somewhat above the middle of the thickness of the card. The stop 109 engages the bottom of the card rear edge in the fully inserted position of the card, with the stop 109 lying below the middle of the spring end portion 138. The spring free end part initially lies against a stop shoulder 114. The spring is initially bent or prestressed to overcome frictional forces, especially those resulting from friction of the contact pad-engaging ends 92 against the lower face of the card. This ensures that the card is ejected so it reaches a position where the spring end portion 138 lies against the stop shoulder 114. The thickness of the card and the depth of the cavity 88 are such that when the card is fully inserted into the cavity 88 and pressed up by the contacts, the upper face of the card is substantially flush with the upper face 78 of the insulating support 72.

Figure 3:
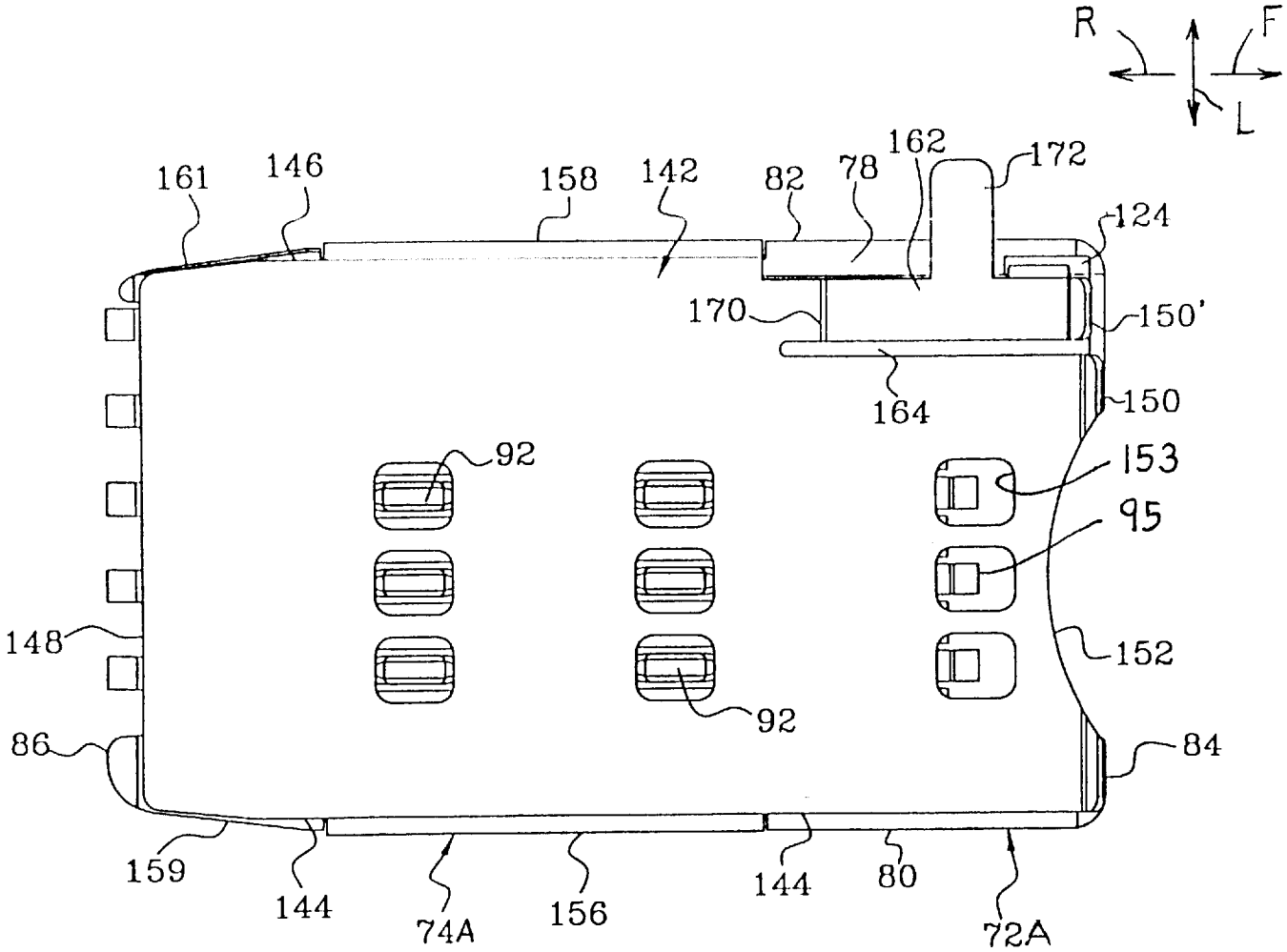
FIG. 3 is a plan view of the connector of FIG. 1, without a card.

As shown in FIG. 4, the sheet metal cover 74A includes an upper plate 142 of generally rectangular shape with parallel longitudinally-extending side edges 144, 146 and with rear and front edges 148, 150. As shown in FIG. 3, the upper plate 142 covers substantially the entire upper face of the insulating support 72A. The front edge 150 has a central cut-out 152 forming a circular arc, with portions on opposite sides of the cut-out forming being bent at an upward incline to form a lead-in that corresponds to the chamfer 122 (FIG. 5) on the support. Near the front edge of the cut-out, the cover has a row of holes 153 (FIG. 3) which, in the absence of a card, makes it possible to observe soldering of the contact tails 95 to traces on the circuit board. These and additional holes in the top plate of the cover permit probes to touch the contacts 92 to test them.

The sheet metal cover 74A (FIG. 2) is mounted on the insulative support 72A by placing two vertical walls 156, 157 of the cover into recesses 81, 83 (FIG. 5) of the support. Then, bottom edges 155, 157 (FIG. 4) of the cover are bent over to lock the cover to the support. It is possible to preform the edges 155, 157 and bend apart the walls 156, 158 until the cover snaps into place.

The cover 74A (FIG. 4) forms the card retainer 304A that retains the card in the cavity after the card has been fully inserted into it. The card retainer includes a carrier arm 162 that is formed by a longitudinal slot 164 in the upper plate of the cover. The carrier arm has a 180° bent retaining lip 160 which forms a lip edge 166A. One side of the retaining lip is received in a recess 124 (FIG. 5) at the front end of the insulating support, prior to receipt of a card. The lip edge 166A extends about 450 to the longitudinal direction M along which the card is inserted into the housing to engage the polarizing edge 91 of the card, which is also inclined 90° to the front and side edges of the MICROSIM card.

The inclined lip edge 166A polarizes the card by not locking the card in against the spring force unless the card has been inserted in a proper orientation so that its polarized edge lies against the lip edge 166A. The carrier arm 162 is an elastically deformable beam which tends to lie substantially flush with the upper surface of the upper plate 142 of the cover, but which can be pivoted up. FIG. 4 shows a pivot region 170 where most of the pivoting of the carrier arm occurs. The pivot region 170 may be deformed to provide a predetermined initial inclination of the carrier arm, although this is not necessary.

When the card is fully inserted, as in FIG. 10, the card can be removed by lifting an actuator tab 172. The tab 172 extends transversely or laterally upward in the plane of the carrier arm 162 and beyond an adjacent edge of the support. The front free edge 150' (FIG. 2) forms a lead-in that causes the retaining lip edge 166A to move upward automatically when the card is inserted.

When a card is inserted rearwardly into the connector it lifts the lip edge 166A until the card reaches its full insertion position. The carrier arm then pivots down under its biased towards its undefiled position wherein the lip edge 166A lies against the polarized edge of the card. Towards the end of card insertion, the spring is deflected until the rear edge of the card abuts the stop. Full card insertion is facilitated by the cutout 152 (FIG. 2) in the front edge 150 of the cover. When the card reaches its fully inserted position, the person inserting the card feels a click as the lip edge 166A snaps down. The person stops pushing rearwardly on the front edge of the card, and the card is pushed very slightly forward by the spring until its polarized edge presses against the lip edge. If the user has not pushed the card sufficiently far into the housing it will not be locked, and the spring will push it partially out of the cavity.

When the user lifts the actuating tab 172, the spring ejects the card instantly before the user releases the upward force on the tab. For this reason, it is preferred that the tab not lie forward of the cavity, but instead lie to the side of the cavity so it lies outside the ejection path of the card.

Frictional forces applied against the card and preloading of the ejection spring are preferably such that the card is slowed down but not fully ejected out of the connector. Preferably, the card moves out to the position shown in FIG. 2, where it can be grasped to be fully pulled out. It should be noted that the insulating support 72A can be used to produce connectors with or without ejection means. Also, the card retainer 304A can be independent of the cover and/or the support.

In a second embodiment of the invention shown in FIGS. 11–16, the ejection spring 130B is slightly modified so as to increase its travel. FIG. 11 shows that a vertically-extending end 139 of the spring lies in a groove 101 that extends in a circular arc centered on the stud 102. FIG. 13 shows the spring end 139 engaging the front 103 of the groove, which determines the rest position of the spring. The stop 109 (FIG. 13) lies laterally beside the spring end rather than below it.

A third embodiment of the invention illustrated in FIGS. 17–21, uses a helical spring. The helical spring 130C (FIG. 18) is straight and lies in a groove 180. The groove has front and rear faces 182, 184. The spring is slightly compressed when lying in the groove and bears against the front and rear faces 182, 184. When the card is inserted into the connector, the rear edge of the card directly engages the front end coil 138 (FIG. 18) of the spring to compress the spring until the rear edge of the card abuts the stops 109C. The coil spring does not require a vertical stud, which allows provision of the second stop 109.

Figure 24:
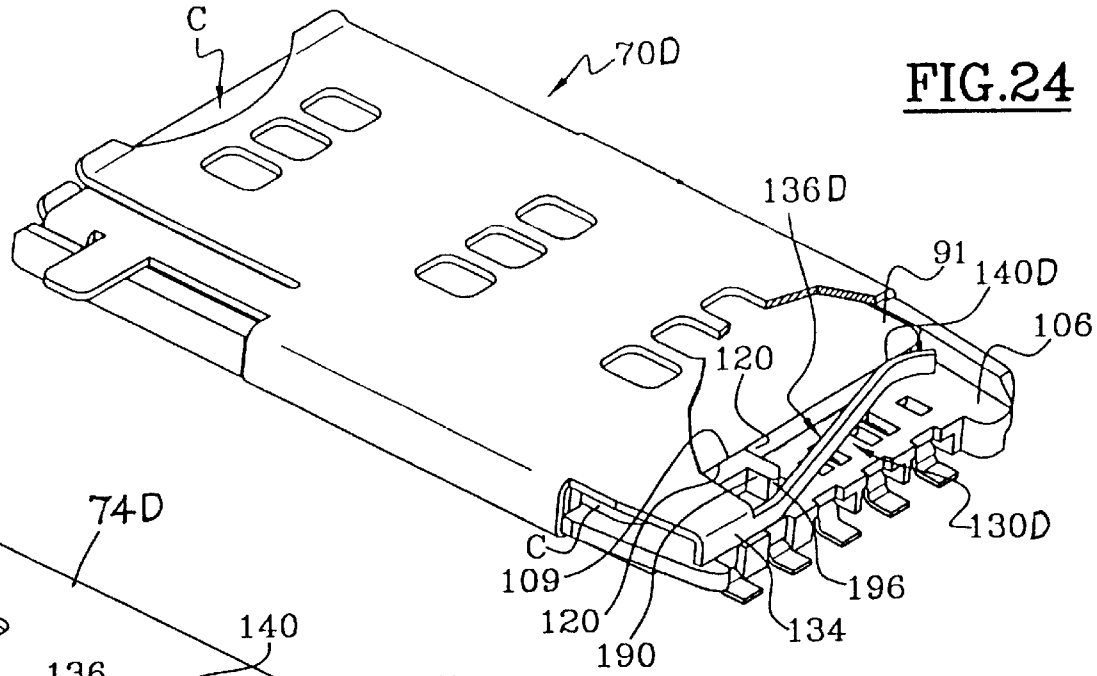
Figure 25:
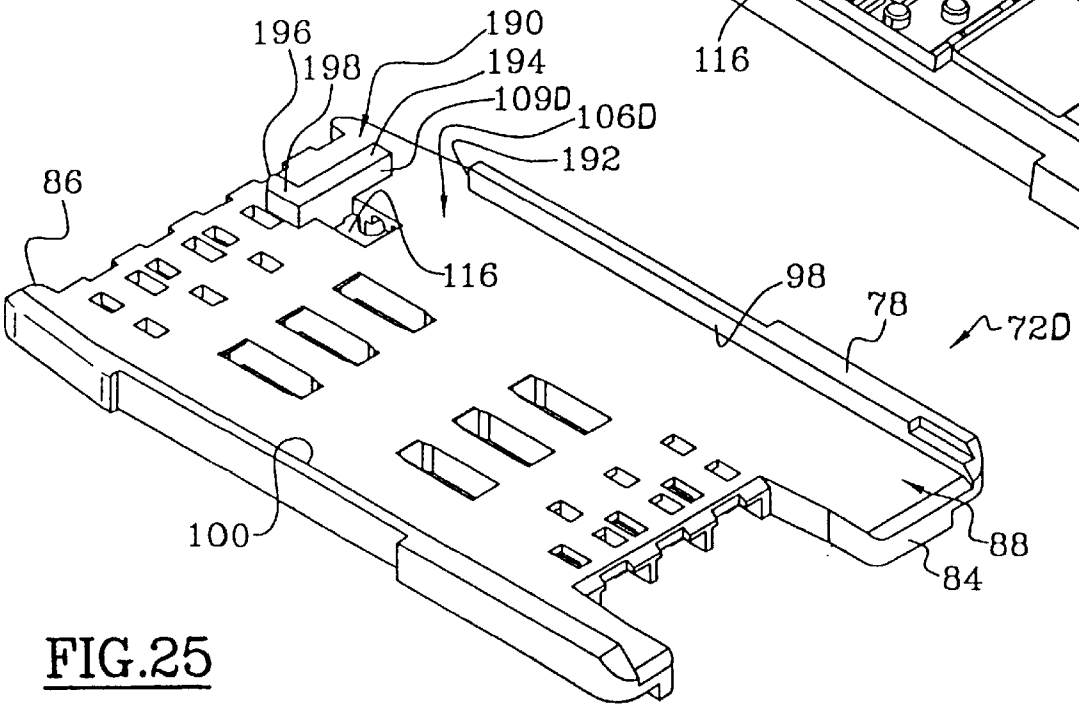

FIGS. 22–27 illustrate a fourth embodiment of the invention wherein the ejection spring is formed integrally with the sheet metal cover 74D. As shown in FIG. 27, the resilient cover includes a vertical part 134 bent 90° with respect to the top plate 142, with a slot along the rear end 148 forming a resilient ejection strip or spring 130D. The strip 130D extends largely laterally within the card-holding cavity. It has a bend 140D with a forwardly-facing convex face that is slightly spaced from the lower face 154 of the plate. FIG. 25 shows that the insulating support 72D has an L-shaped projecting part 190 that is located near a corner formed between the rear edge 86 and side edge 98 of the support. The projecting part has a transverse branch 194 with a front vertical face 190D that forms a stop that engages the rear end of the fully inserted card. The projecting part has a rearwardly-extending branch 198 with a rear free end 196. As shown in FIG. 24, the rear free end 196 of the projection engages a mount part 134 of the resilient ejection strip to better fix its position.

The engagement of the resilient ejection strip branch 140D with the rear edge 120 of the card, allows operation without damaging the card rear edge and without risk of the branch 136D escaping above or below the rear card edge. Such escape is prevented because the height of the branch is about equal to the thickness of the card and the branch is spaced from the bottom or upper face 106 of the support and the bottom face of the cover top plate.

Figures 29, 30:
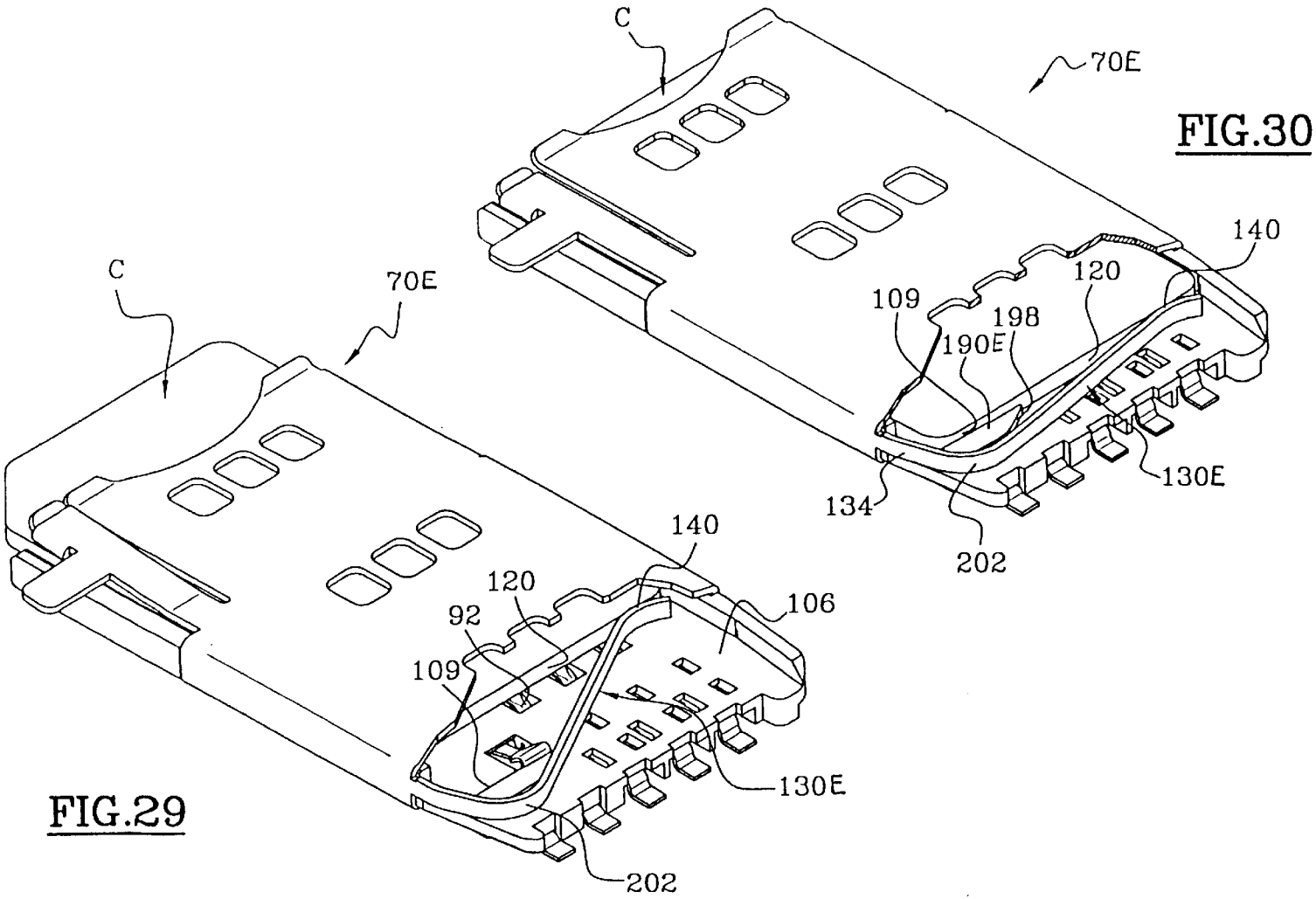
Figure 32:
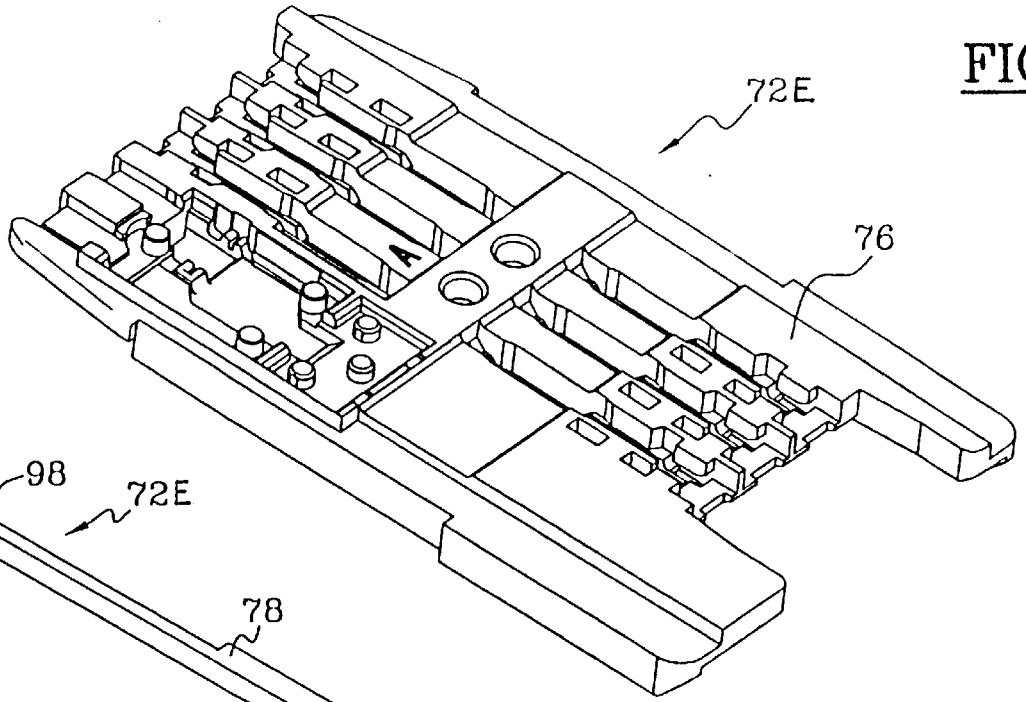
Figure 31:
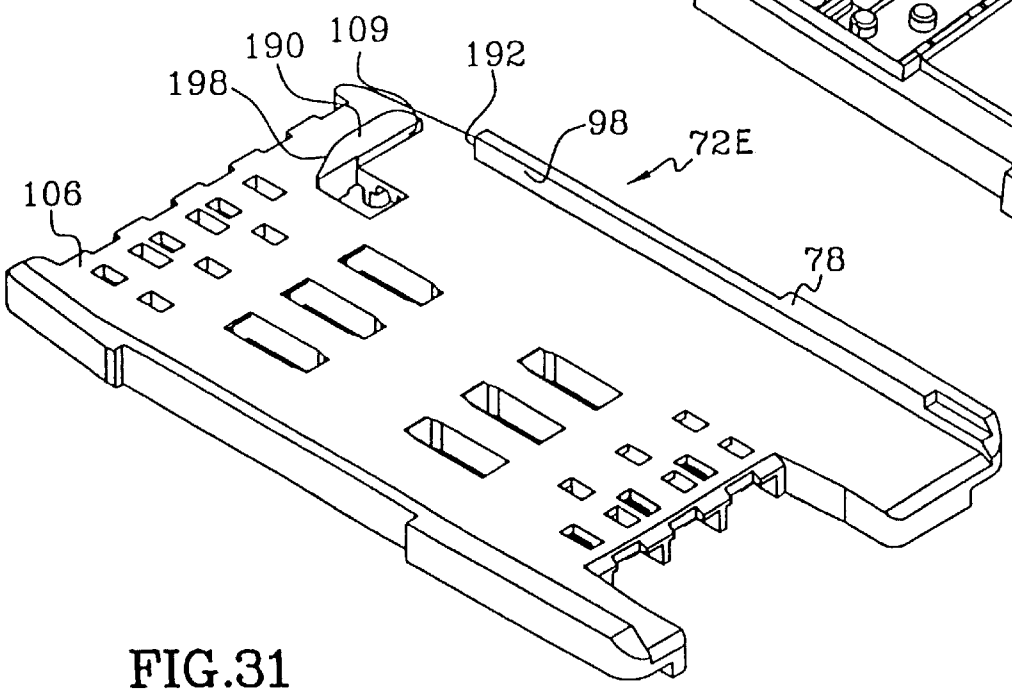

FIGS. 28–33 show a fifth embodiment of the invention which is similar to the fourth embodiment, except that, as shown in FIG. 33, the spring or resilient ejection strip 130E extends from the rear end 200 of a vertically bent-over side edge 158. The connecting end 134 of the ejection strip is joined by a bend 202 to the branch 136E. As shown in FIGS. 29 and 30, the bend 202 has a concave side that engages the rear face 198 of a projecting part 190E.

FIGS. 34–39 show a sixth embodiment of the invention, where, as shown in FIG. 39, the ejection strip or spring 130F is integral with the sheet metal cover through a vertical rear part 134. However, the spring strip has a U-shaped bend 204 which is more than 90°. It may be noted that the retaining lip 166F is formed by a 180° bend at a front end of a carrier arm.

FIGS. 40–42 show a seventh embodiment of the invention with a different card retainer 304G. As shown in FIGS. 41 and 42, a pleat or stop lip 166G is formed by two bends 311 of about 90° each.

FIGS. 43–44A show an eighth embodiment of the invention where the card retainer 304H includes a projection 160H formed at the front end of the carrier arm. The projection is in the form of an approximately hemispherical dish or plunged recess with a sharp stop edge 166H that is inclined at 45° to the forward and rearward directions.

FIGS. 45–52 show a ninth embodiment of the invention, wherein the card is released by downwardly deflecting the tab 172. As shown in FIGS. 46–48, the vertical side wall 158 of the sheet metal cover has a lower edge 157 which extends below the lower face of the insulating support. A forward extension 206 of the lower edge is of increased width and merges with the carrier arm 162. In its free rest state, the carrier arm 162 extends at an upward and forward incline. A retention tab 160 that is bent by close to 180° about the rest of the carrier arm, forms a lip edge 166J that extends at a 45° angle to the forward and rearward direction, and directly engages the polarized edge of a card. As shown in FIGS. 51 and 52, the support 72J has a recess 208 that permits the carrier arm to extend at an upward and forward incline to place the lip edge against the polarized edge of the card. In the rest position of the carrier arm 162 (FIG. 47) the arm presses lightly against the inclined face 208 (FIG. 52) in order to accurately position the lip edge that prevents withdrawal of the card. The support 72J has a hole 210 forward of the recess 208, with the hole extending into the cavity along the side 98 (FIG. 51) of the card-receiving cavity. This construction allows the lip 166J (FIG. 47) to extend through the hole 210 (FIG. 51) so the lip edge lies at the rear of the cavity 88 at the polarized edge of the card, as shown in FIG. 50.

As the card is being inserted, its rear edge engages the 180° bend that forms the retention lip 166J to depress the lip down into the hole 210. The insertion continues until the card is fully inserted, when the lip 166J automatically returns to its locking position shown in FIG. 50. To automatically eject the card, the user merely has to depress the tab 172.

FIGS. 53–56 illustrate a tenth embodiment of the invention with a different card-retainer 304K. As shown in FIGS. 55 and 56, the carrier arm 162K extends transversely, or laterally L and much of it lies in the plane of the upper plate 142 of the cover 74K near its front transverse edge 150. A laterally-extending slot 164 forms the carrier arm at the front of the upper plate. The arm has a retaining lip 160K that extends at a downward and rearward incline and that has a lip edge 166K. The lower face 150' of the lip is inclined and forms a ramp that is lifted during initial insertion of the card. A recess 124 (FIG. 54) in the side of the support 72K enables the lip to move down to the same plane as the card-receiving cavity. When the tab 172 is lifted, the lip edge moves out of the way of the card so it is ejected.

FIGS. 57–63A illustrate an eleventh embodiment of the invention with a modified card retainer 304L. The carrier arm 162L (FIGS. 59 and 60) extends forward from a front end 212 of a vertically extending side 158 of the sheet metal cover. The retaining lip 160L is a V-shaped fold in the carrier. The point of the V projects laterally to form the lip edge 166L. As shown in FIGS. 57 and 58, the support 72L has a V-shaped cutout, or recess 214 that extends laterally into the front end of the card-receiving cavity and into the upper face of the plate-shaped portion that holds the contacts. The rear arm of the V-fold forms the lip edge while the arm front end 150L forms a cam that pushes the lip out of the way during insertion of the card.

FIGS. 64–70 show a twelfth embodiment of the invention with a different card retainer 304M. As shown in FIG. 67, the card retainer includes a carrier arm 162M with a retaining lip 160M having a retaining lip edge 166M that lies in the same plane as the rest of the carrier arm to avoid a 180° fold back. The lip 160M extends laterally to position the lip edge 166M to engage the polarizing edge of the card. The front edge 150'M of the carrier arm forms a chamfer or lead-in so insertion of the card deflects the lead-in and the front end of the carrier arm to automatically move the lip edge 166M out of the way of the card being inserted. As shown in FIG. 64, the support 72M has a cutout at 210M to allow the lip to lie in the same plane as the card-receiving cavity when not deflected down. The shape of cutouts depends upon whether or not there is a switch in the connector 70M.

FIGS. 71–77 illustrate a connector 70N of a thirteenth embodiment of the invention wherein the cover 74N (FIG. 72) does not lie over the card-receiving recess 88N. Instead, the card-receiving connector 70N is designed to be inserted into a card-receiving frame that holds down the card C against the contacts. Instead of the cover being used to hold down the cover, it is used to hold down the spring 130N shown in FIG. 71 and to form the card retainer 304N. As shown in FIG. 73, the cover forms a carrier arm 162N that is spaced under the top plate 142N. The carrier arm has holes 232 that receive studs 234 (FIG. 76) that are hot crimped to fix the front end of the carrier to the insulating support. It is possible to use a single hole and corresponding crimping stud.

FIGS. 78–83 illustrate a fourteenth embodiment of the invention which has a very small total thickness and a simplified construction. The carrier arm 162 (FIGS. 80 and 81) is similar to that of the previous two embodiments, but is not part of a cover. Instead, the carrier arm has a rear portion 206 with holes 232 that receive studs 234 (FIG. 83) on the insulative support 72P. The upper face 78P of the insulating support is of relatively simple construction and holds a helical spring 130 (FIG. 78). The support forms a crimped rim 236 which temporarily retains the spring until the connector has been inserted into a frame or casing which covers the top of the connector.

Figure 84:
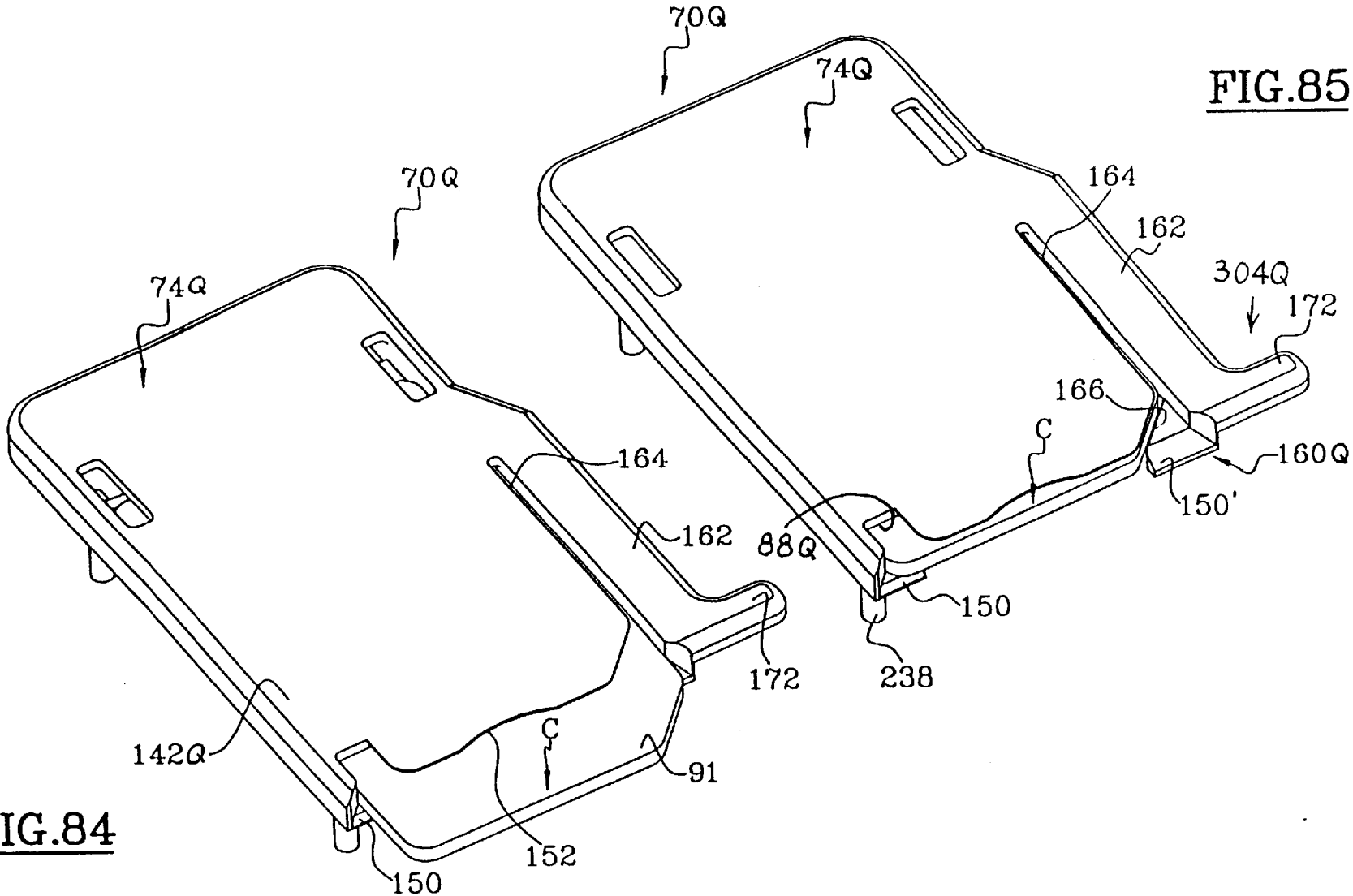
Figure 86:
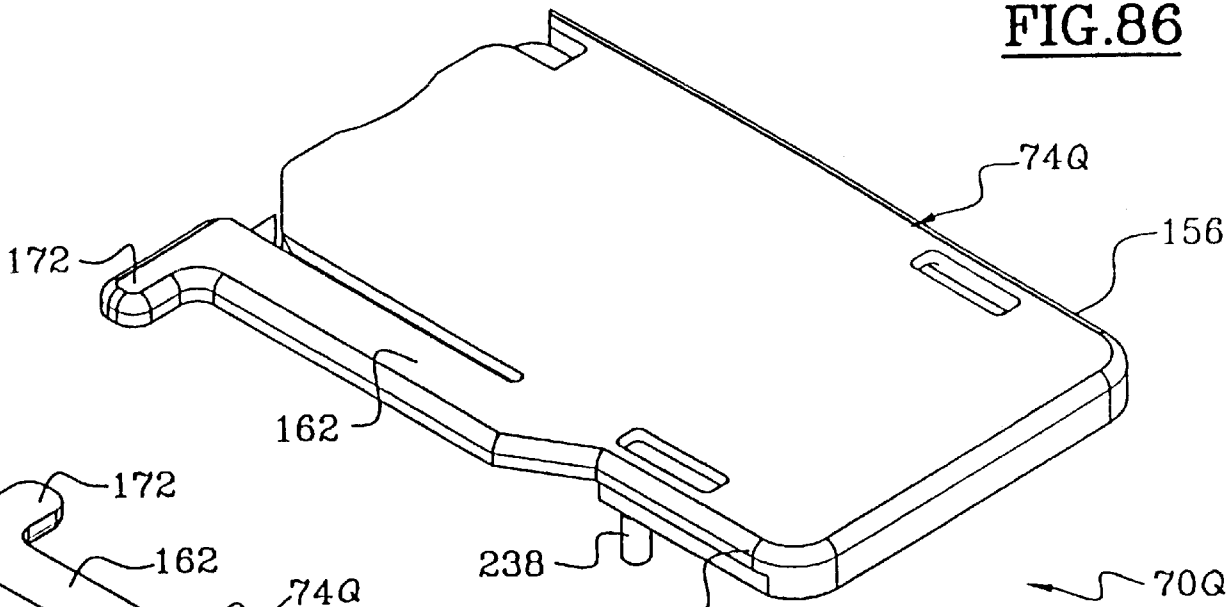
FIG. 86 is a rear and top isometric view of the connector of FIG. 84, without a card.
Figure 89:
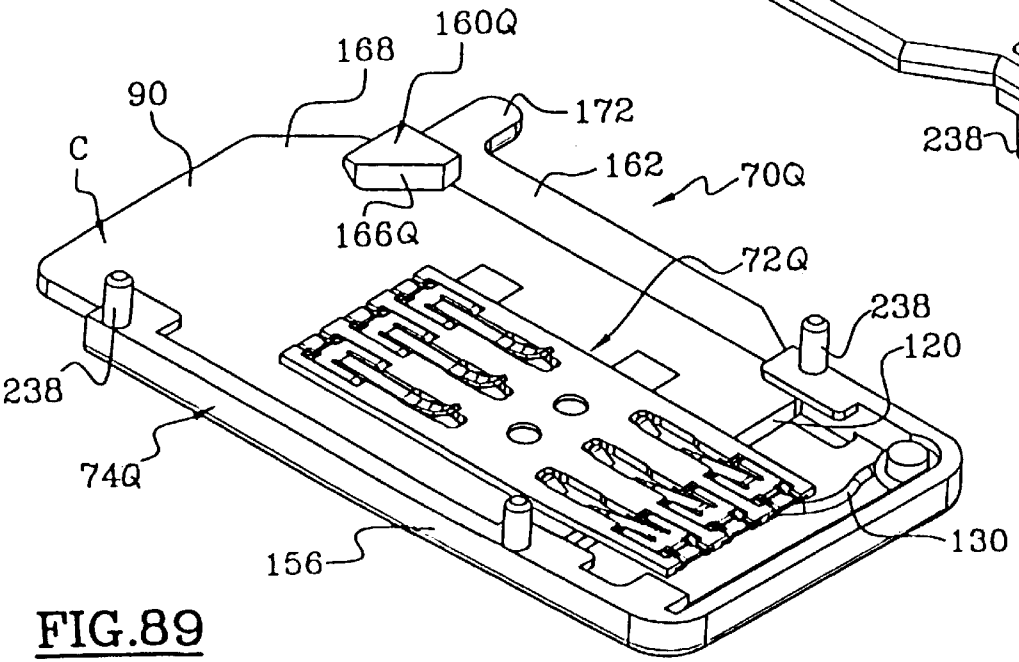
Figure 90:
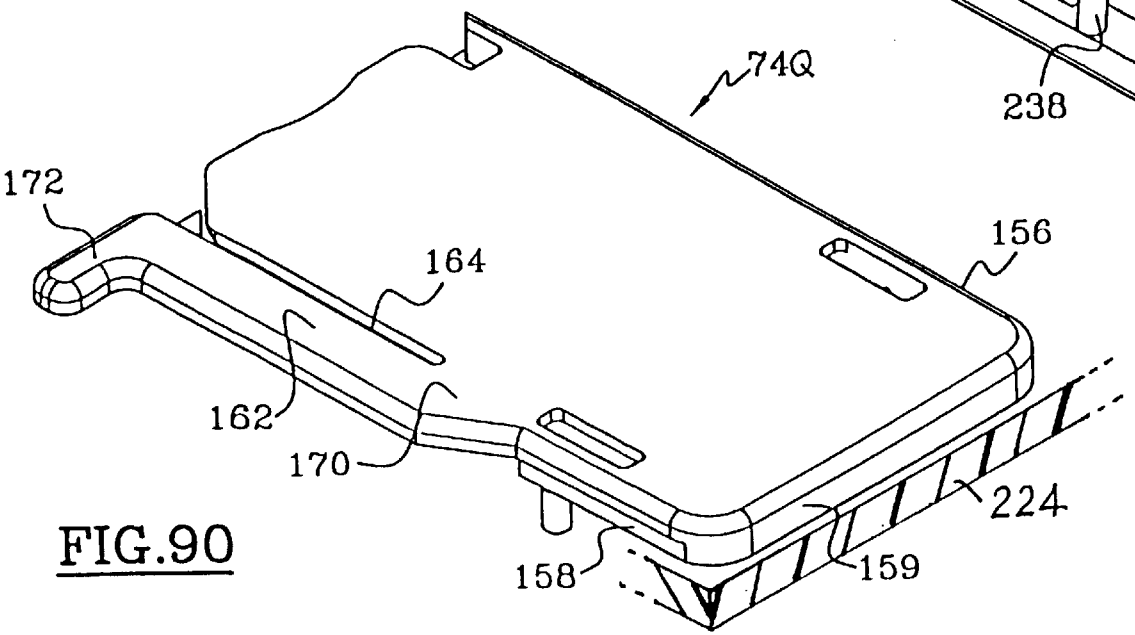

FIGS. 84–92 illustrate a connector 70Q with a molded plastic part 74Q that forms the card-receiving cavity 88Q. As shown in FIG. 84, the part 74Q has an upper plate 142Q that holds down the card. As shown in FIG. 90, the molded plastic part has opposite vertical side walls 156, 158 and a rear end wall 159. To fasten the plastic part 74Q to a circuit board 224, the lower face of the side and rear end walls have feet 238 (FIG. 91) that project into holes 242 (FIG. 92) of the circuit board, the feet being hot crimped after insertion.

Figure 101:
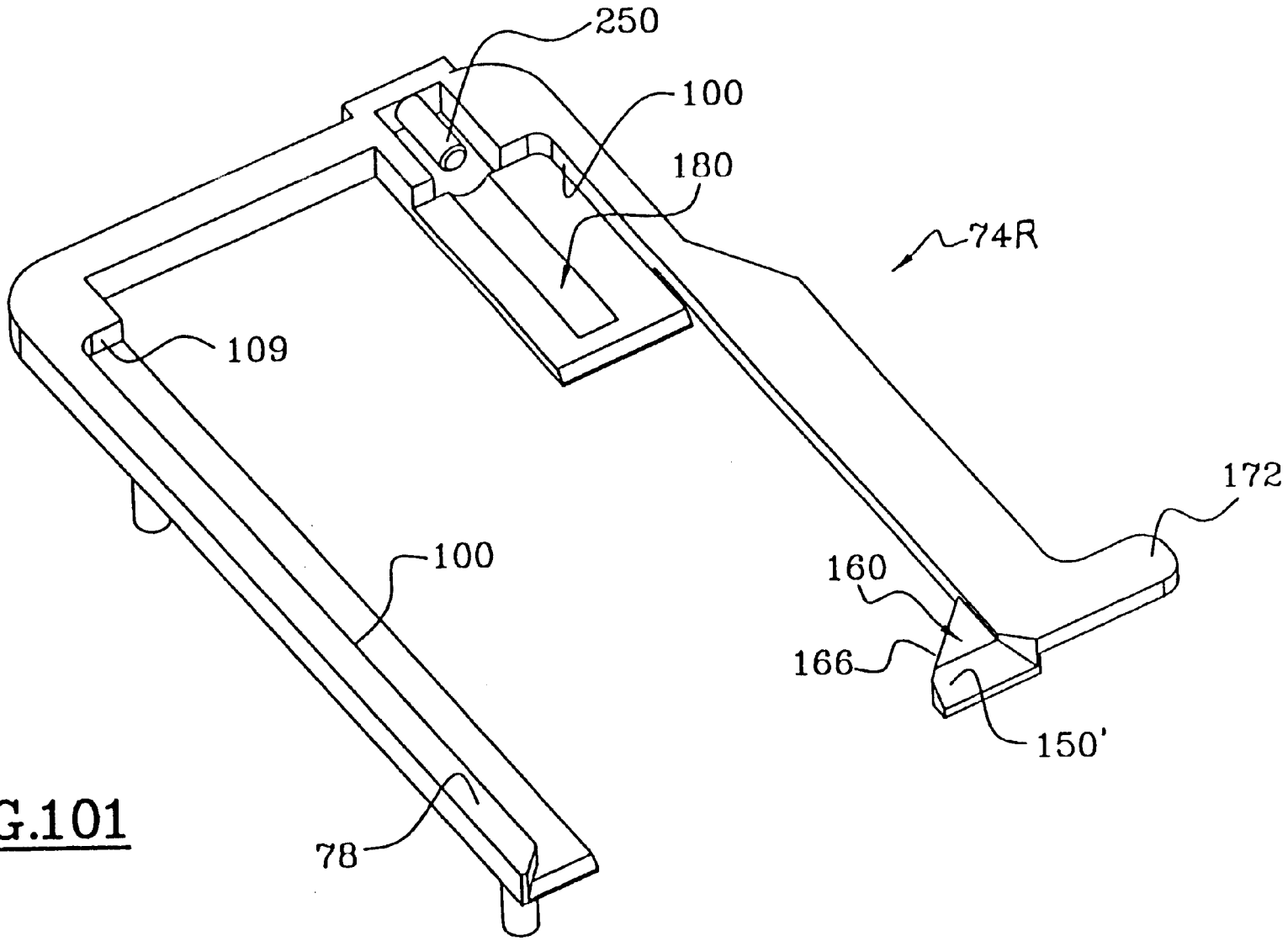
FIG. 101 is a view similar to that of FIG. 99, which shows the cover without the ejection spring.

As shown in FIG. 91, the card-receiving cavity 88Q is formed by two sides or slideways formed at edges 98, 100 along the opposite side walls. The molded part has a stud for holding the ejection spring 130Q. The carrier arm 162 is integrally molded with the rest of the plastic part 74Q and is separated from the upper plate by a slot 164 (FIG. 90) to enable the carrier arm to bend about the region 170. As shown in FIG. 91, the lip 160Q which forms the lip edge 166Q, is formed as an additional thickness of the front end of the carrier arm, and is laterally offset from the rest of the carrier arm. FIG. 89 shows a plate-shaped support 72Q of simple construction, which holds the contacts that engage the pads on the card. The plate-shaped support is separately fastened FIGS. 93–101 illustrate a sixteenth embodiment of the invention, which includes a molded plastic part 74P without a cover thereon, and a plate-shaped support 72R that holds the contacts. The connector 70R which is mounted on a circuit board, is inserted into a frame that holds down the inserted card to the contacts. A helical spring 130 is used. As shown in FIG. 101, the helical spring is held in place by a finger 250 of the molded plastic part 74R, with a spring lying in a groove 180.

While terms such as "upper" and "lower" have been used to describe the invention as illustrated, the connectors can be used in any orientation with respect to the Earth.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. Apparatus for connection to a smart card that has a card lower surface with contact pads thereon and that has front and rear end edges, which comprises a housing that includes a plate-shaped part of dielectric plastic material, said housing having a card-engaging face and laterally spaced opposite sides and longitudinally spaced forward and rearward ends, said apparatus including a plurality of contacts mounted on said plate part and having pad-engaging ends projecting above said card-engaging face, and said housing forming at least the sides and bottom of a forwardly-opening card-receiving cavity for rearward card insertion therein to a fully inserted position, said housing sides forming opposite sides of said cavity, including:

a card retainer that has a largely rearwardly-facing shoulder at the front of said cavity to resist withdrawal of the card after it has been fully inserted into said cavity;

a spring that has an integral spring end that lies in said cavity and that is positioned to directly engage the card rear edge to urge the card forwardly out of said cavity;

said card retainer being manually deflectable out of line with said card to allow said spring to push said card rearwardly so the card front edge moves out of said cavity.

2. The apparatus described in claim 1 wherein:

said spring comprises a spring wire with a looped middle that is looped about a vertical axis and mounted on said housing, with a rear wire leg captured in said housing, and with a front wire leg lying in said cavity and forming said integral spring end to directly engage said card rear end and to be deflected rearwardly by rearward movement of said card.

3. The apparatus described in claim 2 wherein:

said front wire leg of said spring (130B) has a major portion that lies in said cavity and that has a bend with a free end on a side of said bend opposite said major portion, with said free end extending primarily vertically from said main portion;

said housing has an arc groove that is curved about said looped middle, with said fee end lying in said arc groove.

4. The apparatus described in claim 2 wherein said card has a predetermined thickness, and wherein:

said housing includes a stop that is positioned to abut the card rear end edge when the card is fully inserted into said cavity;

said front wire leg and said stop each have a thickness that is less than said card thickness;

said stop occupies a first portion of said card thickness and said front wire leg occupies a different second portion of said card thickness.

5. The apparatus described in claim 1 wherein:

said housing includes a molded plastic base and a sheet metal cover (74D) that lies over said base, with said cover having a vertically-extending part and having an integral spring leg extending from said vertically-extending part, with said spring leg extending into said cavity and forming said spring.

6. The apparatus described in claim 5 wherein:

said spring leg of said cover (74F) has a U-shape with a bend of more than 90° at a middle of the U-shape, and with the U-shape having opposite sides with one side extending from said vertically-extending part and the other side extending into said cavity.

7. The apparatus described in claim 1 wherein:

said spring comprises a coil spring that lies in said housing and that has turns extending about a longitudinal axis, with a front end of said coil spring positioned to directly engage said card rear edge.

8. The apparatus described in claim 1 wherein:

said housing includes a fixed part and said card retainer comprises a carrier arm having a fixed end extending from said housing fixed part and a free outer end that forms said shoulder and that can be deflected to move said shoulder out of line with said cavity;

said arm has a tab that is positioned to be manually deflected to move said shoulder out of the way of a card being moved forwardly out of said cavity;

said arm is manually deflectable in a lateral direction wherein said shoulder is moved to a side of the path of a card that is moving forwardly out of said cavity.

9. The apparatus described in claim 1 wherein:

said housing includes a fixed part and said retainer comprises a carrier arm having a fixed end extending from said housing fixed part and a free outer end that forms said shoulder and that can be deflected to move said shoulder out of line with said cavity;

said housing is mounted on a circuit board and said arm is manually deflectable toward said circuit board to move said shoulder closer to said circuit board.

10. The apparatus described in claim 1 wherein:

said housing includes a fixed part and said card retainer comprises a carrier arm having a fixed end extending from said housing fixed part and a free outer end that forms said shoulder and that can be deflected to move said shoulder out of line with said cavity;

said housing includes a molded dielectric part that includes said plate-shaped part and that forms most of the bottom and sides of said cavity, and said housing includes a sheet metal cover part that forms a top wall of said cavity and that has laterally opposite sides and front and rear cover end portions;

said front end portion of said sheet metal cover forms said arm, with said arm extending laterally and with said fixed end and said free end being laterally spaced apart, with sheet metal of said free end being bent to form said shoulder.

11. Apparatus for connection to a smart card that has a card lower surface with contact pads thereon and that has front and rear card edges, which comprises a housing that includes a plate part of dielectric plastic material having an upwardly-facing face, said housing having laterally spaced opposite sides and longitudinally spaced forward and rearward end portions, and which comprises a plurality of contacts mounted on said plate part and having pad-engaging ends projecting above said face, with said housing forming a forwardly-opening card-receiving cavity for rearward card insertion therein with said housing sides forming opposite side of said cavity and with said housing forming a rear stop that limits rearward movement of said card, wherein:

said housing has a card retainer with a shoulder that faces at least partially rearward at the front of said cavity to resist withdrawal of the card after it has been fully inserted into said cavity, with said retainer being manually deflectable to a position out of line with said cavity to allow card withdrawal;

said housing includes a molded dielectric part that includes said plate part and that forms most of the bottom and sides of said cavity, and a sheet metal cover part;

said sheet metal cover part forms an arm, said arm having a fixed end and having a free outer end portion that can move up and down, with said arm free outer end portion forming said shoulder.

12. The apparatus described in claim 11 wherein:

said arm free outer end portion is bent 180° to form upper and lower layers lying facewise adjacent to each other, with said free outer end portion forming said shoulder.

13. The apparatus described in claim 11 wherein:

said arm free outer end portion has a front end that forms a lead-in, with said front end extending at an incline to guide a smart card during rearward insertion into said cavity, so the smart card rides under said shoulder during insertion.

14. The apparatus described in claim 11 wherein:

said free outer end portion of said arm (162G) has two vertically-spaced bends (309) of about 90° each to leave an arm front part between said bends that forms said shoulder.

15. The apparatus described in claim 11 wherein:

said arm free outer end portion has a recess in one surface that forms a projection (160H) in an opposite surface, with said projection forming said shoulder.

16. The apparatus described in claim 11 wherein:

said arm is downwardly depressible to move said shoulder downward out of the way of the card during forward movement of the card out of said cavity.

17. The apparatus described in claim 11 wherein:

said front end portion of said sheet metal cover forms said arm, with said arm extending laterally and with said fixed end and said free end portion being laterally spaced apart, with sheet metal of said free end portion being bent to form said shoulder.

18. The apparatus described in claim 11 wherein:

a major part of said arm (160L) of sheet metal lies in a vertical plane at a side of said cavity, with said major part of said arm having a vertical dimension that is a plurality of times as great as a lateral thickness dimension of the arm, and said free outer end portion of said arm is bent laterally to form said shoulder with said shoulder projecting laterally into a side of said cavity and with said shoulder being laterally deflectable out of the path of a card moving forwardly out of said cavity.

19. Apparatus for connection to a smart card that has a card lower surface with contact pads thereon and that has longitudinally spaced front and rear card edges and laterally spaced opposite edges, comprising:

a housing which has walls that form a forwardly-opening cavity for the reception of said smart card by rearward insertion of the card into the cavity;

a plurality of contacts with pad-engaging parts lying at a bottom of said cavity to engage the contact pads of a fully inserted card;

spring means that presses rearwardly against the card front edge;

means forming a shoulder positioned to engage the card front edge to retain the card, with said shoulder being manually deflectable to allow said card to move forwardly out of said cavity;

said housing includes a dielectric plastic housing part with said contacts mounted therein, and a metal housing part, with said metal housing part forming said spring.

20. Apparatus for connection to a smart card that has a card lower surface with contact pads thereon and that has front and rear end edges, which comprises a housing that includes a plate-shaped part of dielectric plastic material, said housing having a card-engaging face and laterally spaced opposite sides and longitudinally spaced forward and rearward ends, said apparatus including a plurality of contacts mounted on said plate part and having pad-engaging ends projecting above said card-engaging face; and said housing forming at least the sides and bottom of a forwardly-opening card-receiving cavity for rearward card insertion therein to a fully inserted position, said housing sides forming opposite sides of said cavity, including:

a card retainer that has a largely rearwardly-facing shoulder at the front of said cavity to resist withdrawal of the card after it has been fully inserted into said cavity;

a spring that has a spring end that lies in said cavity and that is positioned to engage the card rear edge to urge the card forwardly out of said cavity;

said card retainer being manually deflectable out of line with said card to allow said spring to push said card rearwardly so the card front edge moves out of said cavity;

said housing includes a fixed part and said card retainer comprises a carrier arm having a fixed and extending from said housing fixed part and a free outer end that forms said shoulder and that can be deflected to move said shoulder out of line with said cavity;

said housing includes a molded dielectric support that includes said plate-shaped part and that forms most of the bottom and sides of said cavity, and a sheet metal cover that forms a top wall of said cavity, with said support and most of said cover forming said fixed part;

said sheet metal cover forms said arm, with said arm having a rear end forming said fixed end with said arm having a front end forming said free end, and with said front end comprising sheet metal that is bent to form said shoulder.

* * * * *